US010214932B2

(12) United States Patent
Erlich et al.

(10) Patent No.: US 10,214,932 B2
(45) **Date of Patent: *Feb. 26, 2019**

(54) ROBOTIC POOL CLEANING APPARATUS

(71) Applicant: WATER TECHNOLOGY, LLC, East Brunswick, NJ (US)

(72) Inventors: Guy Erlich, Monroe Township, NJ (US); John Many, Surfside Beach, SC (US); Jon Elmaleh, Brooklyn, NY (US); James Kosmyna, Dover, NJ (US); Curtis Elliott, Washington, NJ (US); Thomas Lorys, Linden, NJ (US); Daniel Camisi, Tabernacle, NJ (US)

(73) Assignee: WATER TECHNOLOGY, LLC, East Brunswick, NJ (US)

( * ) Notice: Subject to any disclaimer, the term of this patent is extended or adjusted under 35 U.S.C. 154(b) by 350 days.

This patent is subject to a terminal disclaimer.

(21) Appl. No.: 15/210,354

(22) Filed: Jul. 14, 2016

(65) Prior Publication Data

US 2016/0340922 A1 Nov. 24, 2016

Related U.S. Application Data

(63) Continuation of application No. 14/549,712, filed on Nov. 21, 2014, now Pat. No. 9,399,877.

(51) Int. Cl.
*E04H 4/16* (2006.01)

(52) U.S. Cl.
CPC ..... *E04H 4/1654* (2013.01); *E04H 4/16* (2013.01); *E04H 4/1636* (2013.01)

(58) Field of Classification Search
CPC ..... E04H 4/16; E04H 4/1636; E04H 4/1654
See application file for complete search history.

(56) References Cited

U.S. PATENT DOCUMENTS 5,985,156 A 11/1999 Henkin et al.
6,039,886 A 3/2000 Henkin et al.
6,099,658 A 8/2000 Porat
(Continued)

FOREIGN PATENT DOCUMENTS

WO 2014/097304 A1 6/2014

OTHER PUBLICATIONS

International Search Report for Corresponding PCT/US15/61742, filed Nov. 20, 2015.

*Primary Examiner* — Randall Chin
(74) *Attorney, Agent, or Firm* — Notaro, Michalos & Zaccaria P.C.

(57) ABSTRACT

Robotic apparatus cleans swimming pools and has road and pulley wheels with belts thereon, on opposite sides and drive motors that rotate a wheel on each side to move the frame along a pool surface. Pairs of outside wheels have friction surfaces to engage pool surfaces to also moving the frame. Forward and rearward brush assemblies are driven to brush the pool surface. Oppositely facing and angled duck bill valves allow water into free volumes in the frame and are covered by a filter bag for filtering out debris under the action of a dual pump assembly that pumps water out through a pair of outlet opening in a top of the frame. A computer processor controls the drive motors and pump assembly to move the frame along programmed paths and rechargeable batteries power the drive motors, pump assembly and computer processor.

25 Claims, 44 Drawing Sheets

(56) References Cited

U.S. PATENT DOCUMENTS

| | | | |
|---|---|---|---|
| 6,155,657 | A | 12/2000 | Erlich et al. |
| 6,212,725 | B1 | 4/2001 | Porat |
| 6,299,699 | B1 | 10/2001 | Porat et al. |
| 6,309,468 | B1 | 10/2001 | Sommer |
| 6,412,133 | B1 | 7/2002 | Erlich et al. |
| 6,473,927 | B1 | 11/2002 | Sommer |
| 6,742,613 | B2 | 6/2004 | Erlich et al. |
| 6,758,226 | B2 | 7/2004 | Porat |
| 6,815,918 | B2 | 11/2004 | Porat et al. |
| 6,842,931 | B2 | 1/2005 | Porat et al. |
| 7,682,461 | B2 | 3/2010 | Sommer et al. |
| 7,827,643 | B2 | 11/2010 | Erlich et al. |
| 7,849,547 | B2 | 12/2010 | Erlich et al. |
| 7,987,543 | B2 | 8/2011 | Sommer et al. |
| 8,118,943 | B2 | 2/2012 | Erlich et al. |
| 8,241,430 | B2 | 8/2012 | Erlich et al. |
| 8,266,752 | B2 | 9/2012 | Henkin et al. |
| 8,424,142 | B2 | 4/2013 | Garti |
| 8,696,821 | B2 | 4/2014 | Erlich et al. |
| 8,800,088 | B2 | 8/2014 | Garti |
| 8,869,337 | B2 | 10/2014 | Sumonthee |
| 2008/0250580 | A1 | 10/2008 | Lavabre et al. |
| 2011/0197932 | A1* | 8/2011 | Mastio ..... E04H 4/16 134/110 |
| 2013/0000677 | A1 | 1/2013 | Sumonthee |
| 2013/0133145 | A1* | 5/2013 | Pichon ..... E04H 4/1654 15/1.7 |
| 2014/0137343 | A1 | 5/2014 | Correa et al. |
| 2014/0246050 | A1 | 9/2014 | Klintberg |
| 2014/0259464 | A1 | 9/2014 | Renaud et al. |
| 2014/0262401 | A1 | 9/2014 | Renaud |
| 2014/0263087 | A1 | 9/2014 | Renaud et al. |
| 2014/0326652 | A1 | 11/2014 | Gart |
| 2015/0102772 | A1 | 4/2015 | Witelson et al. |

* cited by examiner

ROBOTIC POOL CLEANING APPARATUS

RELATED APPLICATIONS AND PRIORITY

This application is a continuation of U.S. application Ser. No. 14/549,712, filed Nov. 21, 2014, now U.S. Pat. No. 9,399,877, and claims priority therefrom. This application is also related to international application PCT/US15/61742, filed Nov. 20, 2015.

FIELD OF THE INVENTION

This invention relates in general to apparatuses and methods for automatically cleaning swimming pools or other bodies of water with surfaces to be cleaned, and in particular, to a new and useful robotic apparatus for autonomously and cordlessly cleaning swimming pool surfaces. For the purpose of this disclosure, any body of water, including but not limited to swimming pools, pools around fountains, decorative pools or any other body of water that has surfaces in need of periodic or continuous cleaning, will be referred to herein as a swimming pool.

BACKGROUND OF THE INVENTION

There are various devices known in the prior art for cleaning swimming pools by crawling along their surfaces. These devices usually use power from the surface, provided by wires, or a flow of water from the surface, provided by a hose, or both. Few, if any, can clean swimming pool surfaces cordlessly and autonomously, especially in larger pools and irregularly shaped pools.

For example, Patent Publication US2014/0137343 defines a pool cleaning vehicle driven by an internal electric motor which receives power from a power cord which connects to a remote power source. The direction in which the vehicle is propelled is determined by the direction of rotation of the electric motor, which is in turn controlled by signals received from the external power supply via a floating cable. U.S. Pat. No. 8,266,752 describes automatic swimming pool cleaners which use a cleaner body traveling through a water pool in which the cleaner body is tethered to a conduit which supplies power (e.g., positive pressure water flow, negative pressure (i.e., suction) water flow, electricity, etc.) for propelling the body through the water pool. Water flow received from outside the cleaner can be coupled to a generator subsystem within the pool cleaner body, and the pressure of the water flow used to generate electric power for a controller. U.S. Pat. No. 5,985,156 defines a pool cleaner which is hydraulically powered, either by pressure or by suction, using an external hydraulic pump. Proximal and distal ends of a flexible supply hose are respectively coupled to the pump and to the pool cleaner body for producing a water supply flow through the body for powering the device. The hose is preferably configured so that it primarily lies close to the interior pool wall surface during use, with the hose being dragged along by the movement of the body through the pool.

The tethering cables required for nearly all prior submersible robotic pool cleaners, including all cleaners of comparable performance, can cause problems as the unit moves through the pool. The cables and hoses used with older units can become tangled and knotted, can become looped over obstacles inside or outside the pool, can physically obstruct the cleaning unit, and otherwise limit proper movement. Cables also limit the range of the prior art devices, and their out-of-water portions are an unsightly tripping hazard.

These problems are recognized in U.S. Pat. No. 6,299,699. It explains that in order to clean a large pool, a conventional electrical power source external to the pool is typically required. The movement and turning of the cleaner over a prolonged period of time can cause the pool cord extending to the surface to become tightly coiled and/or twisted to such an extent that it interferes with the movement of the cleaner, which can pull the cleaner off of its programmed cleaning course. To address this problem, U.S. Pat. No. 6,299,699 teaches a cleaner programmed to follow a course in which a turn in one direction that is likely to induce a right-hand twist in the power supply cord is followed by a turn in a direction that is expected to induce a left-hand twist in the cord. U.S. Pat. No. 8,266,752 similarly teaches a control subsystem for a pool cleaning robot configured to perform repositioning operations while preventing conduit tangling by avoiding excessive rotation of the body. It is simpler and more efficient, however, to program pool cleaning robots without having to worry about cords and conduits. The pool cleaner described herein avoids these conduit-related problems entirely.

If a tethered unit has its connection cut or unplugged, the unit is typically rendered inoperable with no convenient way to return it to the surface from the bottom of the pool. A user is forced to hook the unit using a long tool, or climb into the pool to retrieve the device manually.

Prior art robotic pool cleaners frequently have a problem with flipping over and getting stuck in that position, particularly if they attempt to clean the sides of pools. A user returning to check on their pool is likely to find the cleaner "belly up" at the bottom, or flipped sideways and immobile. This obviously prevents the robot from completing its task, and the user is left guessing at what point the device stopped cleaning. Typically, the user will have to right the device manually and restart the cleaning program. Thus, there is a need for autonomous pool cleaners which do not flip over, which land tracks down or wheels down when released in open water, and which can independently correct their orientation if they do settle on their back or side.

FIG. 31 in this disclosure shows a prior art apparatus 900 with known one way flap valve members 902 and 912. Valve member 902 is rotatably connected by a pivot pin 904 to a housing portion 906 and is illustrated in its closed position, while valve member 912 is rotatably connected by a pivot pin 914 to another housing portion 916 and is illustrated in its open position. In operation, water with debris pushes the valve member 912 into its open state in the direction of arrow D1 that is substantially horizontal. This occurs when a pumping system connected to apparatus 900 is operating to draw water into the system. When the pumping system is deactivated, water flow stops and a back pressure in the direction of arrow D2 moves the valve member to its closed position as illustrated by valve member 902. A problem with the prior art apparatus 900 is that debris can get caught in the joint of pivot pins 904 and 914 to prevent the valve member form closing. This in turn permits debris to empty from the filter compartment and back into the swimming pool water. Furthermore, the flow of water in the direction D1, for the open valve, can be impeded because the water has to exert force to keep the valve member 912 open, which may also be jammed closed by excess debris above the member 912. When not in a cleaning mode for the apparatus 900, water with debris applies force in the direction D2, and the flap 902 should not open and should not allow the water and/or debris to escape. However, in practice, debris may prevent the flap 902 from completely closing, leaving a partial opening where water and/or debris may escape. Flaps could also open and leak debris under force of gravity when a pool cleaning robot is tilted at an angle or vertically, such as when cleaning pool walls, especially if there is a lapse in water flow. The present invention improves on this valve arrangement.

Another shortcoming of prior art robotic pool cleaners is that they are poorly adapted to continue forward, such as by pivoting to follow a wall and/or by moving upward, when they encounter a wall or other obstacle. This is at least partially because they have all of their propulsion means—whether tracks or wheels—oriented downwards towards the ground or pool bottom. To the extent the forward-motion tracks or wheels are also exposed to the area in front of the device, in addition to the ground below, the forward-facing portion is generally at and near ground level. See, for example, U.S. Pat. No. 6,212,725 (tracks oriented down), U.S. Pat. No. 6,299,699 (tracks oriented down), U.S. Pat. No. 6,473,927 (running wheels on bottom), U.S. Pat. No. 7,849,547, (tracks oriented down), U.S. Pat. No. 8,424,142 (tracks oriented down), U.S. Pat. No. 8,800,088 (tracks oriented down), Patent Publications US 2014/0259464 (wheel assemblies at bottom corners), and US2014/0137343 (wheels at bottom corners), etc. Notably, wide spin brushes for sweeping debris generally lack sufficient motive power to lift and push a cleaning vehicle upwards. Pool cleaner vehicles which are better suited for driving directly from a horizontal pool floor up a vertical pool wall, and vice versa, are therefore desirable.

Pool cleaning vehicles which are able to at least partly climb up a pool wall, as opposed to stopping and changing direction as soon as the front of the vehicle contacts the wall, could also better clean both corner areas of pools with angular corners, and sloped areas of pools with more rounded bottom-side transition regions. This applies to both walls+floors cleaning modes, and floor-only modes where climbing just slightly up a wall can assist in cleaning the edges of a pool floor by briefly positioning water inlets on the bottom of the vehicle closer to corners.

The above designs are also not well suited for pivoting and continuing forward in the event they hit a wall at an angle, at a side or front corner of the vehicle, because they have little or no motive traction at their corners or on their left and right sides. Pool cleaning robots which are adapted to automatically pivot and continue forward on a pool floor when they intersect a wall at an angle would also provide advantages. For example, improved cleaning along the edge of pool walls by directing a vehicle which intersects a wall at an angle to conduct a pass along the edge of the wall, as opposed to stopping and pivoting in an entirely new direction. Pool robots which can push over and off of obstacles they hit at an angle will not get stuck as often, and will reach more different areas of the pool than, for example, a robot that stops and reverses or stops and pivots every time it encounters an obstacle.

SUMMARY OF THE INVENTION

An object of the present invention is to provide a robotic, autonomous and cordless apparatus that cleans swimming pool surfaces on its own, and that comprises multiple road and pulley wheels on each side of an apparatus frame, each defining a belt path, with a traction belt extending around each belt path. A drive motor rotates a pulley wheel on each side to move the belt and thereby move the apparatus along a swimming pool surface to be cleaned. Driven outside wheels, each with outer friction surfaces to engage the pool surface for also moving the frame, are connected at upper and lower, and forward and rearward sides of each belt path. These outside wheels help turn the apparatus away from side walls if a programmed cleaning path for the apparatus seeks to maintain the apparatus on a floor of the pool, and helps turn the apparatus to move up a side wall and to climb steps or stairs of a pool, for cleaning these surfaces as well.

Another object of the invention is to provide the apparatus with driven, forward and rearward brush assemblies, to brush the pool surfaces, and oppositely facing and acutely angled one way valves between the brush assemblies, that allow water into a free volume in the frame. Outlets of the valves are covered by a free form filter bag of porous material for filtering out debris before the water leaves the free volume by moving through the porous filter bag material, into a remaining volume in the frame under the action of a dual pump that pumps the water out through a pair of outlet openings in a top cover of the frame.

Another object of the invention is to provide the apparatus with computer processor controls for the drive motors and pump motors to move the apparatus along programmed paths, and rechargeable batteries that power the drive motors, pump motors and computer processor for a fully cordless operation.

The batteries may be NiMH, lead acid, NiCad, lithium ion or any other known or yet to be discovered rechargeable source of electrical power that is self-contained and stored in the apparatus frame for underwater use. The type of power source or combination thereof is not limiting and the use of preprogrammed cleaning logic and onboard power makes the apparatus completely cordless in design and autonomous in operation.

Two pump motors are provided in a preferred form of the invention, further preferably to provide side-by-side water flow from the top of the frame. In this way the pump assembly can run one or both motors at a time. Strong pump flow provided by multiple pumps increases the ability of the apparatus both to flip itself over when the apparatus is belly-up, and to hold itself against walls or other non-horizontal surfaces during cleaning. Paired or spaced upward-facing pumps, positioned one in front of the other or side-by-side, and other arrangements are also contemplated. In preferred embodiments, the apparatus includes 1, 2, 3, 4, or more pumps, optionally all positioned side-by-side. Preferably all of the pumps and their corresponding outlets are aimed to provide water flow in an upward direction, and corresponding pressure in a downward direction which pushes the apparatus against the surface "below" it, such as a pool floor or wall.

Side handles are provided in the frame with quick open, one way drain valves for efficiently lifting the apparatus from a pool while simultaneously draining water from its inner free volume, without having to also lift the weight of water.

A pair of one way valves, which may also be referred to as duckbill valves, are angled at an acute angle to the travel direction of the apparatus for more efficient cleaning and for easier user removal and replacement for upgrade and cleaning of the valves. The valves are oriented at about a 30 degree angle with respect to the horizontal axis, when the apparatus is upright, and the angle is preferably about 10 to 60 degrees, and more preferably about 20 to 40 degrees.

A computer processor assembly of the invention which is water-sealed and mounted in the frame, includes a computer memory for storing an operating program for controlling operation of the drive motors and pump assembly, and for moving the frame along unique programmed cleaning paths along swimming pool surfaces. The invention includes a method to produce these cleaning paths, herein referred to as a drive stutter.

Multiday programmed run, continuous, and adjustable cleaning modes are possible due to the programmability of the computer processor. For example, run until dead, clean every day for a week, clean walls and floors, clean floors only, clean floors daily and walls weekly, to name a few illustrative options. Poolside charging and solar charging are also available due to the design of the apparatus. Although preferred modes of operation are described herein, the disclosed pool cleaning apparatus can also be operated otherwise by any known method.

The total mass of the apparatus is adjusted so that its total density is no more than about 10% (e.g. 0% to 15%) more than the density of water so that the apparatus has nearly neutral buoyancy. A center of gravity of the apparatus is below its center of buoyancy near a central area of its vertical axis so that the apparatus is self-righting when in the water at any orientation other than with its vertical axis extending vertically or when climbing steps or an incline or cleaning walls. The near neutral buoyancy of the apparatus also allows it to climb and therefore clean side walls and steps of a pool, with the drive belts and outer wheels pressed against the wall mainly by the jet propulsion thrust of the water being pumped from the cover of the apparatus. This near neutral buoyancy also allows the apparatus to drive itself into and out of the pool.

Forward and rearward concave body panels of the frame above the brush assemblies allow the apparatus to properly traverse up inclines, walls and steps, and to clean debris floating just in front of the unit and at the water line of the swimming pool.

A preferred embodiment includes outside wheels which are domed or convex, and are textured for increasing a frictional engagement of the outside wheels with swimming pool surfaces the outside wheel contacts, including surfaces towards a side of the apparatus made of materials that do not damage the surfaces of the pool. Preferably there are two track belts, on each left and right side, and each in an inverted or upside-down trapezoidal configuration. Each trapezoid shaped track belt has four corners defined by four pulley wheels, with a shorter of the two horizontal sides of each trapezoidal track belt oriented downward for contacting a pool surface, while a longer of the horizontal sides is oriented upward. The vehicle may be generally square or rectangular, with a pair of two outside wheels at or near each corner. Typically each pair includes an upper and a lower outside wheel, with the upper outside wheel positioned further out than the lower outside wheel in both the transverse and directional axes so that the upper outside wheel(s) will usually contact walls or other obstacles first as the device travels. Each outside wheel can be axially aligned with a pulley wheel at a corner of the trapezoidal shaped track belt. Since the trapezoid shaped belt has the wider side at the top, the outside wheels aligned with the upper corners will project out beyond the outside wheels which are near the ground, aligned with the lower corners. A portion of the belt that is up away from the ground similarly projects out further than the other parts of the belt, and in some embodiments and orientations could contact obstacles at the same time as or before the corresponding outside wheel(s). It is contemplated that similar advantages could be provided with tracks which have their widest point above the ground, rather than at ground level, using shapes other than a classic trapezoid.

A battery protection circuit is provided and solar panels may be used on the frame to extend running time for the system. The batteries, all valves, major pump and drive assemblies are easily accessible so that the apparatus is user friendly for operation, upgrade and repair. The apparatus is thus adapted for easy upgrade and modifiable into new configurations, with interchangeable batteries, interchangeable driver motors, and other easily replaceable parts.

The filter bag and duck bill valves are preferably mounted to a bottom panel or cover that is removable from the bottom of the apparatus frame. Detents and a simple rotating lock of the invention locks the bottom panel in place for reliable and easy removal of the bag for cleaning and access to the valves for removing debris or, if necessary, replacing, as well as opening easy access to the interior of other frame to access the pump assembly, the batteries and other replaceable components for repair and/or replacement.

A ballast tank system is contemplated that allows the unit to float at the end of a cleaning cycle. Such a system works by rendering the apparatus neutrally buoyant or with a slightly positive buoyancy. The pump assembly can push the apparatus to the bottom of the pool when the apparatus turns on. The apparatus is typically neutrally buoyant or has a slightly negative buoyancy. The apparatus may include dive planes, preferably adjustable dive planes, which produce downforce by deflecting water upward (with regard to the top of the apparatus) as the cleaner moves forward, resulting in a downforce on the cleaner to help hold it against a surface it is moving across, be it a wall or a floor. The apparatus may include a compressible ballast chamber, positive displacement pump ballast chamber, tethered retractable buoy and, when dead, a buoy can be released for retrieval by a hook and claw system.

Self-correction is possible utilizing tilt sensors housed within the control unit in combination with controlling pump motors and/or drive motors, among other methods to be discussed. The driver motors may also provide a form of self-correction under specific circumstances. The apparatus preferably has a low center of gravity which, combined with the apparatus being overall preferably slightly denser than water when submerged, bias the apparatus to settle tracks-down at the bottom of a pool.

Reorientation of the apparatus is assisted by a low center of gravity and high flotation foam parts located in the frame volume.

The brush assembles typically each include one or more cylinder brushes with a combination of angular and straight flexible, e.g. rubber, blades or bristles, in conjunction with one or more polyvinyl acetate (PVA) brush cylinders or rings, for optimal cleaning. Shapes other than cylindrical are also possible.

In some embodiments a magnetic clutch system or other form of safety clutch provides perfectly sealed drive trains, as well as safety for the user and the pump assembly. Instead of or in addition to a safety clutch, the apparatus can use electrical current sensors. When a motor or blade gets jammed, current draw increases drastically. The apparatus can be configured to detect the increased current draw and, in response, automatically shut off the relevant motor(s) to prevent damage.

A robot vision system may be included to detect and target dirt patches as a first location to be cleaned.

Self-docking is possible when the batteries are near dead or the apparatus is finished cleaning. The apparatus can target and dock with its station to recharge.

A scum line cleaning mode is also programmable into the computer memory, i.e. to require wall cleaning at the water level.

A control panel is typically mounted on the apparatus with, for example, only three triple water sealed buttons for simple and intuitive operation. For example, one button controls ON/OFF, a second button selects between either "FLOOR & WALL" or "FLOOR ONLY" operation, and a third button selects either "WEEKLY" or "DAILY" operation. The control panel is protected by three rubber bumpers positioned around the panel. In an alternative design, the control panel may be attached and tethered to a buoy that floats on the water surface.

Variable speed cleaning operation is possible by selective programming.

A unique battery casing design using metal and plastic together provides optimal reliability and protection.

The free form filter bag of the invention, unlike most bags that use wire frames, has an internally sewn frame that allows the opposing end to easily fill the entire free volume in the apparatus.

There are multiple ways of attaching the PVA plus rubber brushes to the brush assembly, e.g., via pins, glue, snaps, or the like.

The outer wheels can be made to stop rotating and act as side wipers.

The pool cleaner preferably includes a breach sensor which detects when the sensor is submerged in water or not. The sensor is checked by the pool cleaner computer processor at regular intervals to determine if the apparatus, or at least part of the apparatus, is out of the water. When the breach sensor detects that it has left the water, it is typically because either a) the user has deliberately removed the pool cleaner from the pool, b) the device is in wall cleaning mode and has reached the top of a pool wall, or c) the pool cleaner is floating at the surface, likely because air trapped in its inner space is increasing its buoyancy. When the breach sensor check confirms that the pool cleaner is in water, the device continues its normal routine. If the breach sensor detects that the pool cleaner has left the water, the computer processor initiates an attempt to return the device to the water. In wall cleaning mode, this will often mean the pool cleaner reached the top of a wall, and it simply reverses direction. The pool cleaner may also respond to a dry reading by turning off the pump motors which, if the cleaner is floating at the top of a pool, will help allow the inside of the device to completely fill with water so that the device sinks to the bottom again. If the breach sensor determines that the pool cleaner has been out of the water for a sufficient number of consecutive checks, the device shuts down. This is based on an assumption that if the pool cleaner has been out of the water for a substantial period, it has probably been deliberately removed from the pool.

The pool cleaner also preferably has one, two or more tilt sensors, typically one near each end of the device. The tilt sensors detect when each respective end is tilted upwards by, for example, 20°, 30°, 45°, 60°, or more, as compared to the pull of gravity. When the pool cleaner encounters a wall it will begin to drive up the wall, tilting upwards in the process. One of the tilt sensors will detect this tilting once it reaches the required angle. If the pool cleaner is in wall cleaning mode, it continues up the wall. If the pool cleaner is in floors-only mode, the device preferably simply reverses direction and returns to the pool floor. The pool cleaner preferably uses both drive motors simultaneously to drive the unit straight backwards off of pool walls in the floor cleaning mode.

Other advantageous objects and feature of the invention are disclosed in the following.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

With reference to FIGS. 1 to 11, a preferred embodiment of a cordless and autonomous robotic apparatus for cleaning surfaces of a swimming pool includes a frame with side frame parts 73 and 73, each with a side frame cover 74. The frame also includes a top cover 76 and front and rear frame body covers 75. The frame has a travel direction axis extending in a forward direction in FIG. 1 that is to the left and angled upwardly, and a rearward direction to the right and angled downwardly. The frame also has a transverse axis that is horizontally perpendicular to the travel direction and a vertical axis extending vertically in FIG. 1.

Figure 8A:
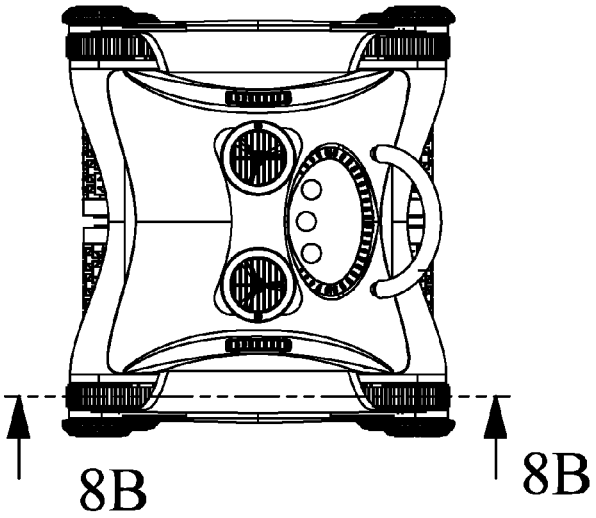
FIG. 8A is a top plan view of the apparatus of FIG. 1 with a section line 8B-8B.
Figure 8B:
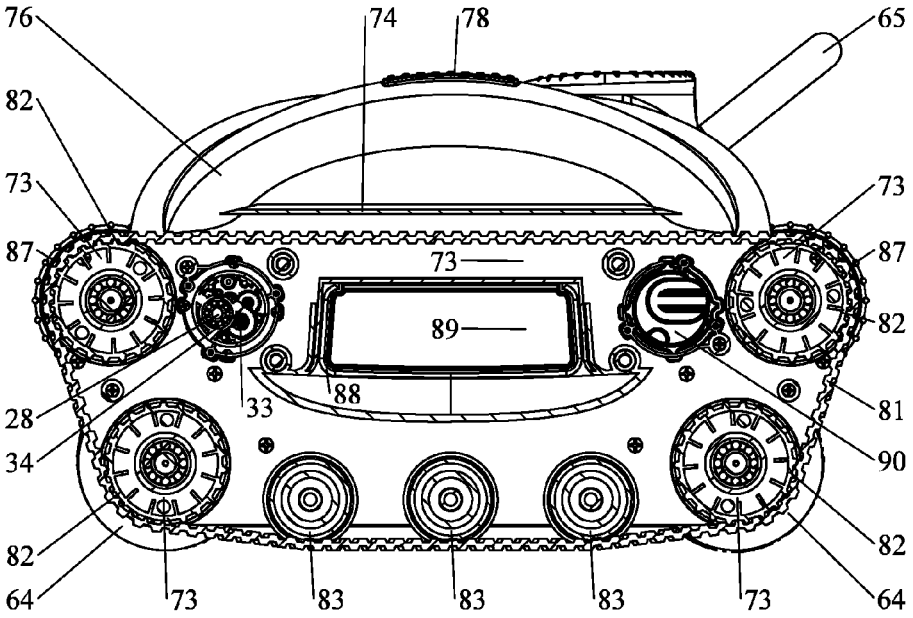
FIG. 8B is a sectional view taken along line 8B-8B of FIG. 8A.
Figure 9A:
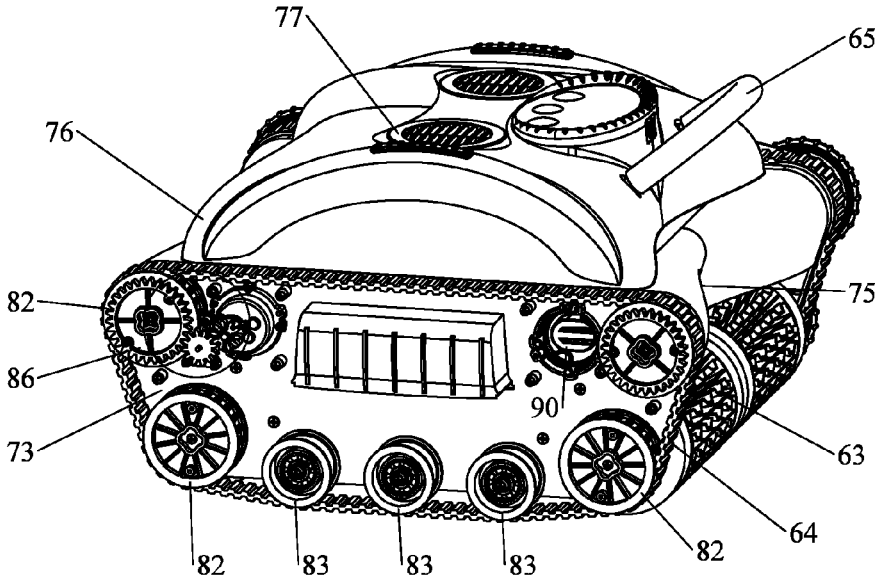
FIG. 9A is a top, left, rear perspective view of the apparatus of FIG. 1, with a side cover removed and a detail area 9B circled.
Figure 9B:
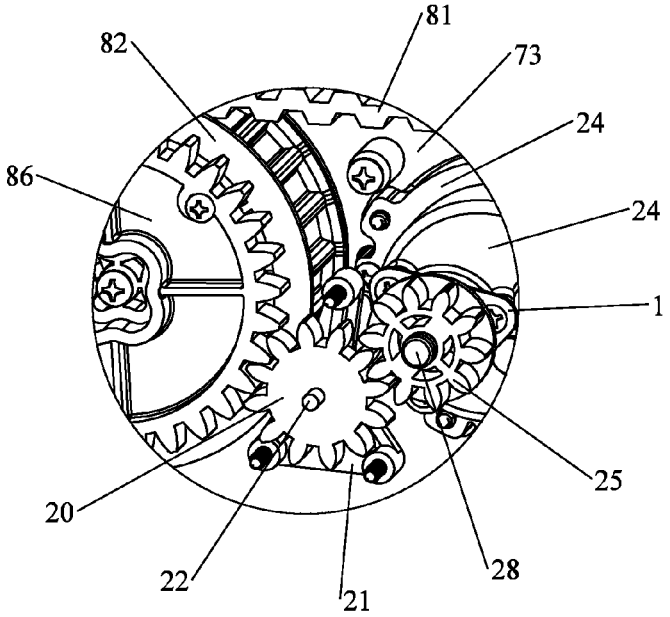
FIG. 9B is an enlarged detail taken from 9A showing a drive train for a drive motor of the apparatus of FIG. 1.
Figure 14:
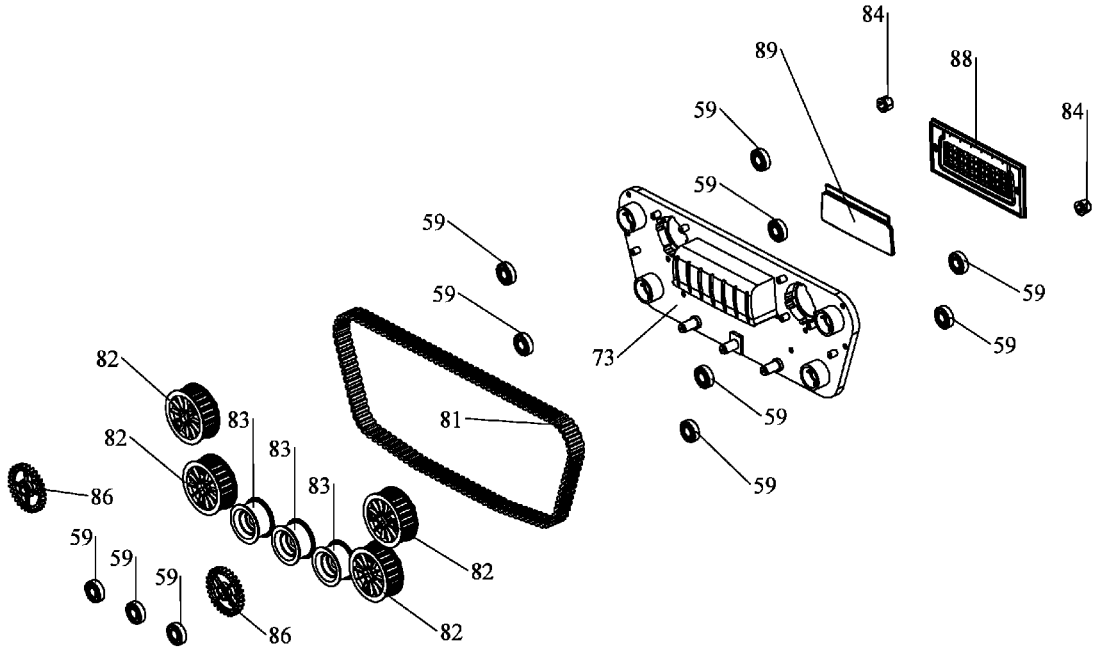
FIG. 14 is an exploded, front, top, right perspective view of a right frame assembly of the apparatus of FIG. 13, showing components of a drive train, lift handle and drainage valve of the apparatus.

As best shown in FIGS. 8B and 9A, four pulley wheels 82 and three road wheels 83 are mounted for rotation to each side frame 73 on rotation axes shown in FIG. 14, that are parallel to the transverse axis. The road and pulley wheels define a trapezoidal belt path of each side of the apparatus frame. First and second track or traction belts 81 extend around each respective belt path, with a portion of each belt under the centrally located road wheels 83 as shown in FIG. 8B, for engaging a swimming pool surface to be cleaned. The pulley wheels 82 at the four corners of each trapezoidal belt path are toothed pulleys for driving and/or only for positively guiding the belts on their paths. The belts each have internal teeth for positively engaging outer teeth of each pulley wheel 82 as shown in FIGS. 9A and 9B.

Figure 5A:
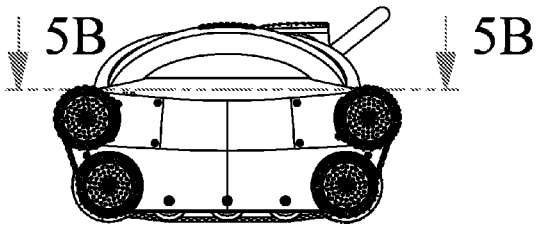
FIG. 5A is a left side elevational view of the apparatus of FIG. 1 with a section line 5B-5B.
Figure 5B:
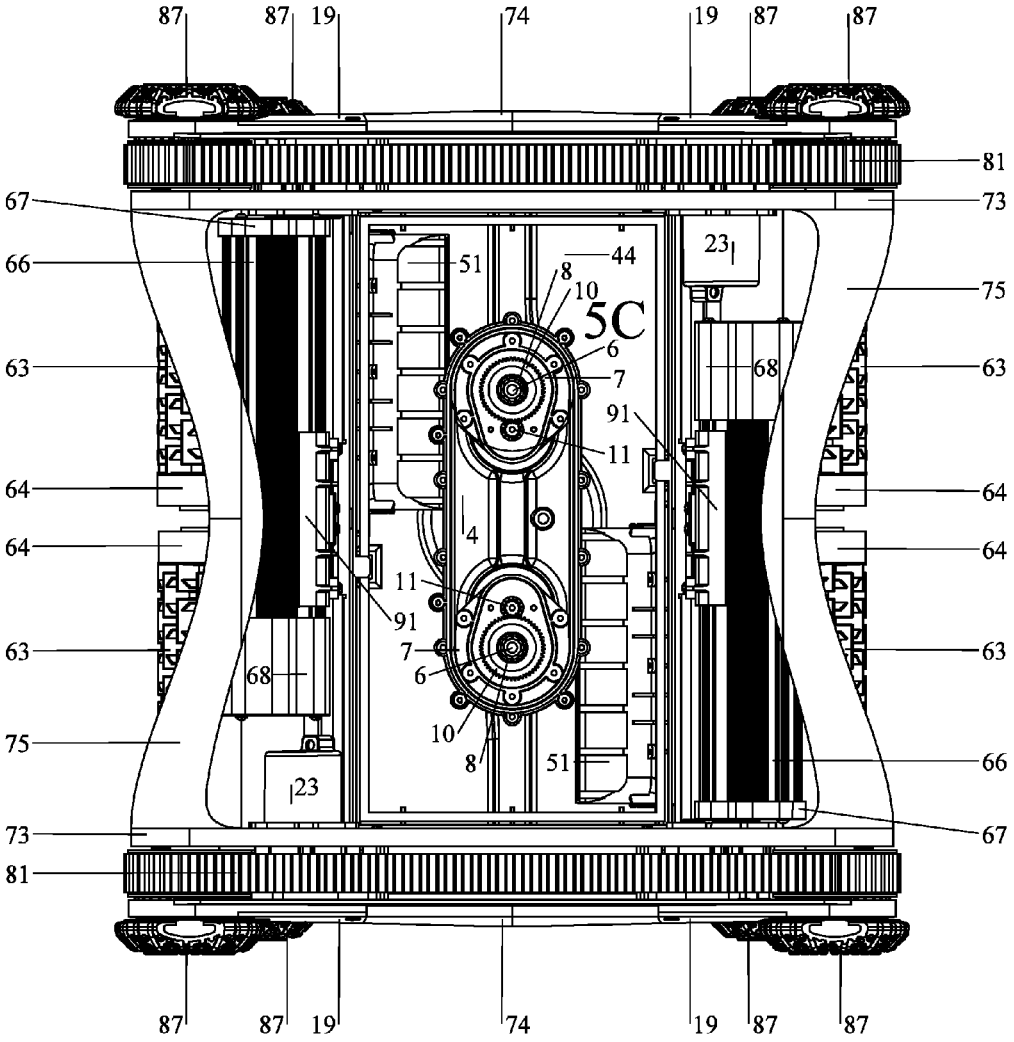
FIG. 5B is a sectional view taken along line 5B-5B of FIG. 5A.
Figure 5C:
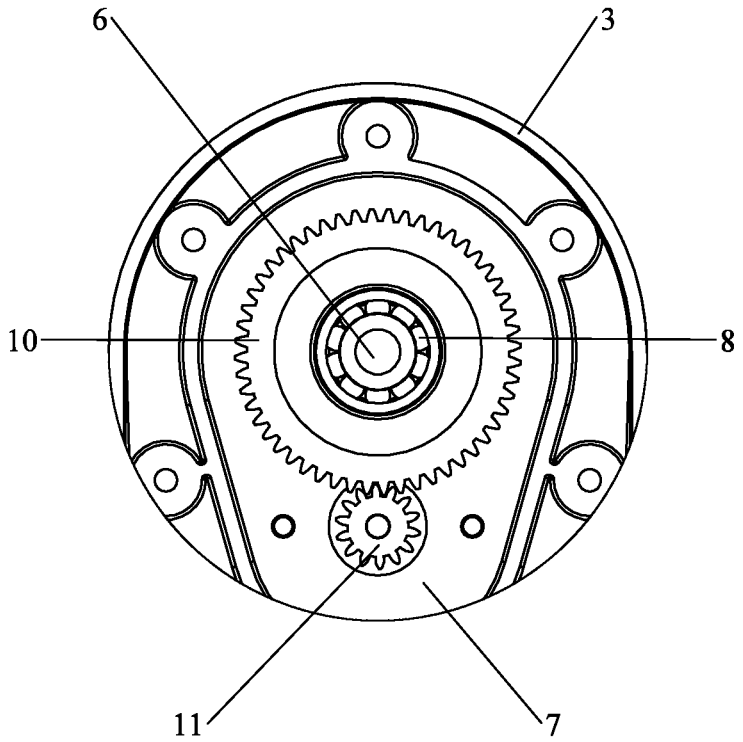
FIG. 5C is an enlarged detail taken from FIG. 5B showing a drive train for a pump assembly of the apparatus of FIG. 1.
Figure 10:
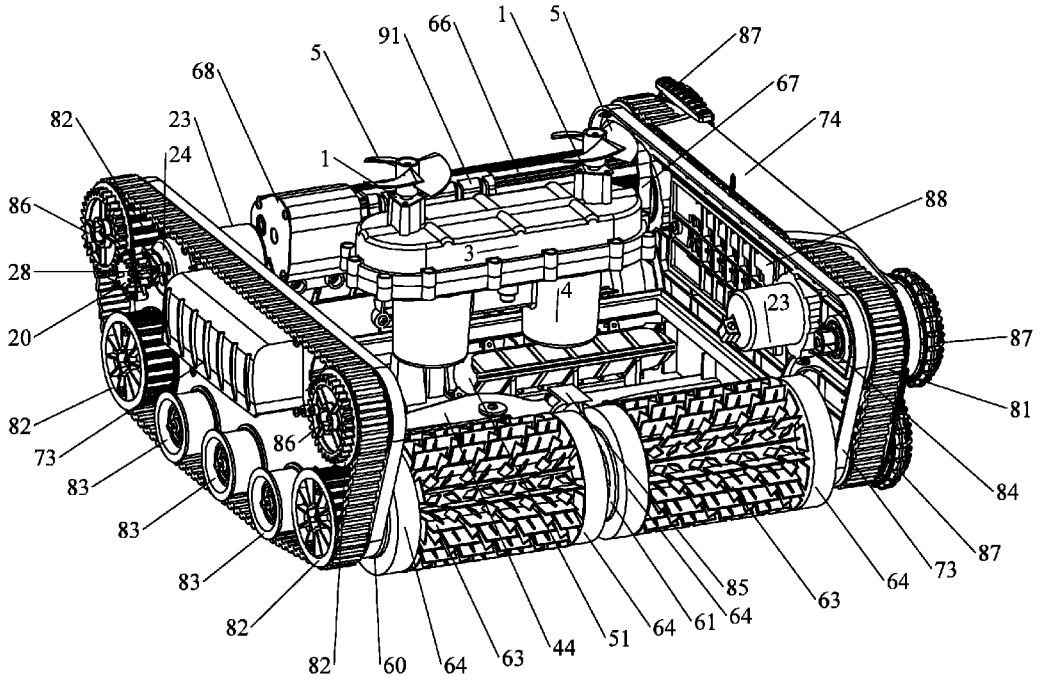
FIG. 10 is a top, right, front perspective view of a main frame of the apparatus of FIG. 1 with top, side and front panels removed and a forward one of its two battery assemblies removed, to reveal underlying features of the apparatus.
Figure 11:
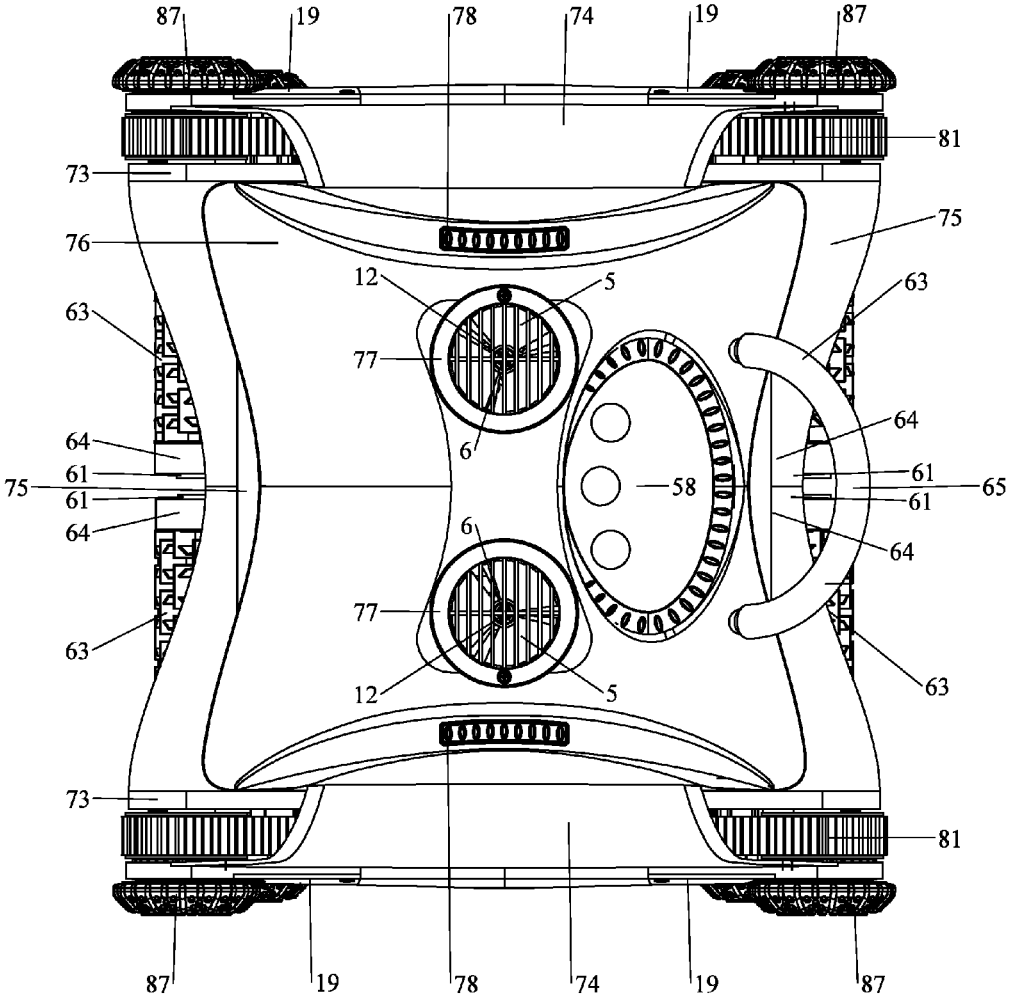
FIG. 11 is a top plan view of the apparatus of FIG. 1.
Figure 15:
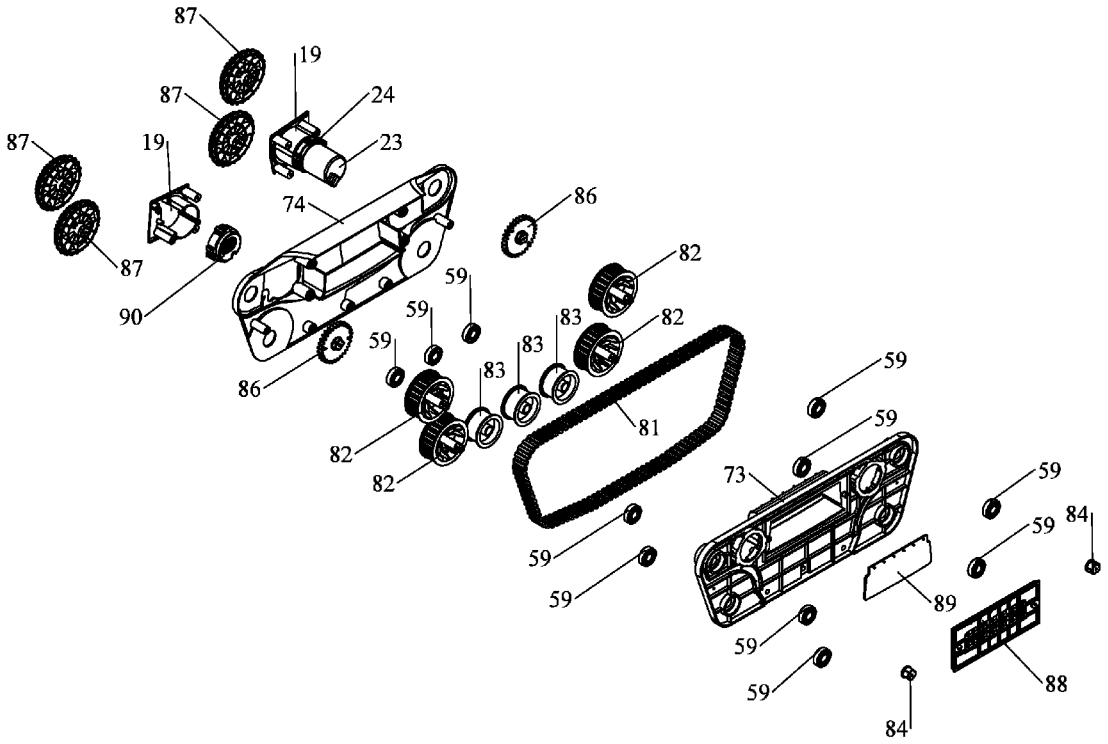
FIG. 15 is an exploded, front, top, interior perspective view of the right frame assembly of FIG. 13, with additional components not shown in FIG. 14.

As best shown in FIGS. 5B, 10 and 15, drive motors in respective motor housings 24 and caps 23 are mounted to the frame by cover mounts 19 that are connected to each housing 24. The drive motors are operatively engaged to upper, opposite pulley wheels 82 for driving the pulleys to move the respective belts 81 to thereby move the frame along a swimming pool surface. In the embodiment disclosed and as shown in FIG. 5B, a forward one of the motors drives the forward left pulley 82 and a rearward one of the motors drives the rearward right pulley 82.

Figure 1:
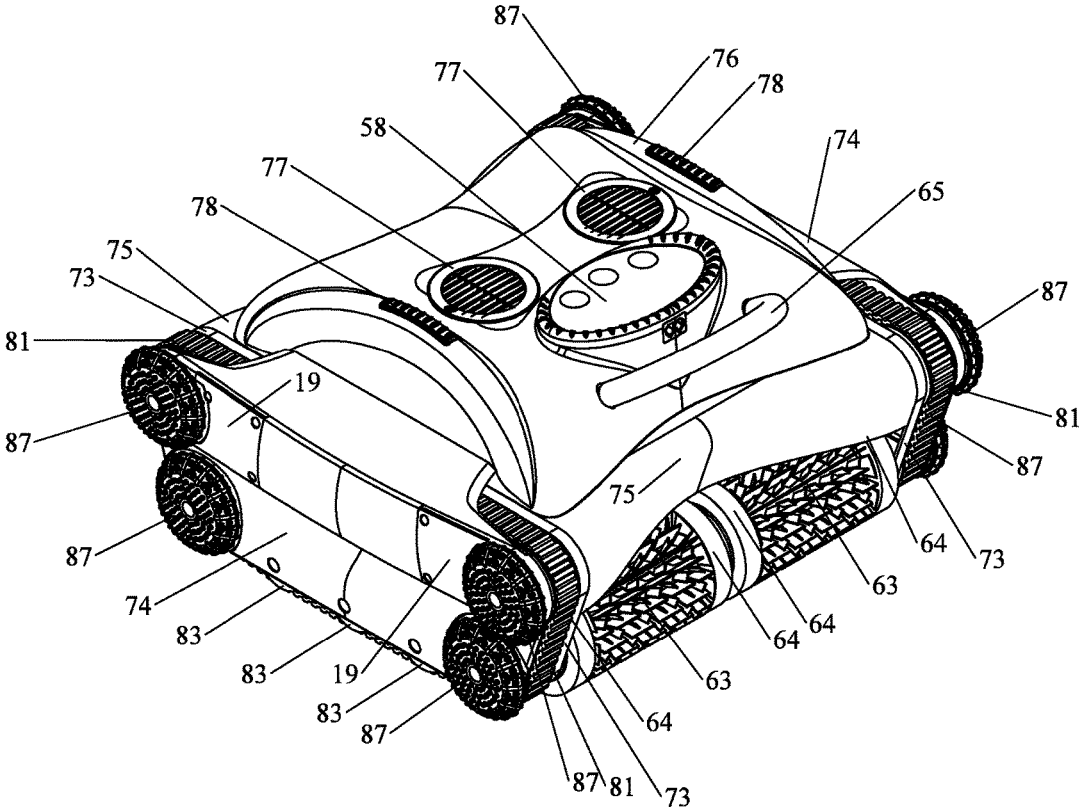
FIG. 1 is a top, left, rear perspective view of a pool cleaning apparatus in accordance with an embodiment of the present invention.
Figure 7A:
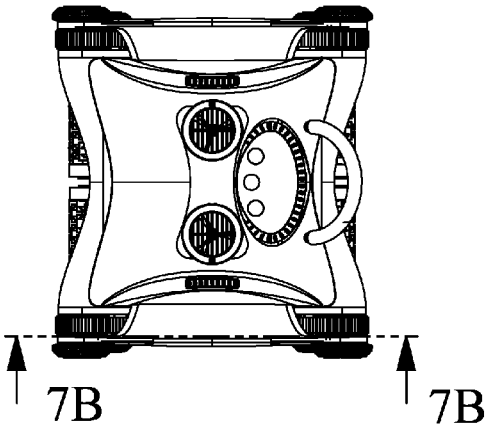
FIG. 7A is a top plan view of the apparatus of FIG. 1 with a section line 7B-7B.
Figure 7B:
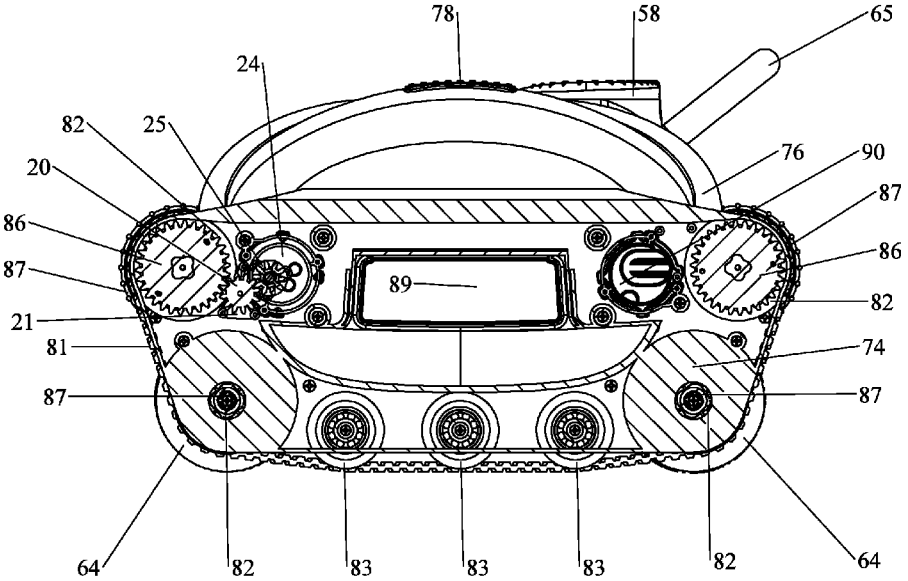
FIG. 7B is a sectional view taken along line 7B-7B of FIG. 7A.

With reference to FIGS. 1 and 5B, the apparatus of the invention also includes eight outside wheels 87, each connected to one of the pulley wheels 82 and each at a corner of one of the trapezoidal belt paths. Most preferably an inverted trapezoid, where the bottom side of the trapezoid is shorter than the top side, as shown in FIGS. 1, 7B, 8B, etc. In this way, forward and rearward, upper and lower outside wheels 87 are provided with respect to the travel direction axis and vertical axis. Each outside wheel 87 has an outer friction surface for engaging a swimming pool surface for moving the frame with respect to the swimming pool surface. This is particularly useful when an included surface, a step, or a side wall is in the path of movement of the apparatus. In such cases the outside wheels 87 will roll against these non-horizontal surfaces and help turn the apparatus away, or, if so programmed, allow the apparatus to climb the step of vertical wall to continue the cleaning operation along such non-horizontal surfaces. This ability to turn the apparatus and allow it to climb is further enhanced by mounting the upper outer wheels 87 slightly outwardly of the lower outer wheels 87 as shown, for example in FIGS. 2 and 11. Using this design, the apparatus contacts the wall or other obstacle well above the ground level, which the inventors have found provides much better leverage for directing the device upwards and/to the side away from the wall. Prior art designs which first contact the wall/obstacle near the level where it meets the pool floor have significantly more difficulty initiating wall climbing or reorienting continued forward motion.

For example, in a preferred embodiment, when the cleaner intersects a wall it will usually be one or both upper, front outside wheels 87 with a textured, gripping surface which actually makes contact. If the device hit the wall squarely or nearly squarely, the rotating upper outside wheels 87 will pull and tilt the front of the device upwards, almost immediately bringing the lower front outside wheels 87 and/or the front surface of the belt 81 tracks also into contact with the wall. This, in turn, increases the motive contact tilting and pulling the device upwards. This floor-to-wall transition is fluid and continuous with regard to the motion of the vehicle across the floor. Depending on the program and mode, the cleaner will typically either continue up the wall, or reverse direction after climbing only partially onto the wall (and cleaning the floor near the corner) to return to the floor. In contrast, devices with standard tracks or wheels—i.e. all on the floor—will contact the wall at or near ground level where the leverage to begin climbing the wall is much weaker, and any floor-to-wall transition much less fluid, involving a full stop and a change of direction.

In a second, related example, in a preferred embodiment, when the cleaner intersects a wall at a substantial angle it will usually be one of the upper, front outside wheels 87 with a textured, domed gripping surface which actually makes first contact. The inventors have found that the domed, spinning, gripping wheel at a front, upper corner of the device tends to steer the device at an angle away from the wall or obstacle when hit at a substantial angle. This often allows the device to continue forward (albeit at a modified angle) in situations where other devices are usually stopped and forced to actively redirect themselves. For example, a device in floor cleaning mode which hits a pool wall at a low 30° angle can be redirected by an outside wheel 87 to continue forward roughly parallel to that side wall, instead of stopping the device and performing a redirect step. This allows an autonomous robot to reach more different areas of the pool, and is better for cleaning along the edges of the floor, near walls, than arrangements which stop and pick an entirely new direction (never or almost never parallel to the edge) when they hit a wall. This automatic redirect functionality also make the device less apt to get stuck on obstacles. Similar advantages and results are provided in collisions with stairs or other pool obstacles.

To help effect cleanings of surfaces of a swimming pool or any other body of water with surface to be cleaned, the apparatus uses both moving brushes and a water flow suction system.

The brushing effect is provided by forward and rearward brush assemblies each including a pair of rubber brushes 63 and four PVA (polyvinyl acetate) brushes 64, mounted for rotation to the forward and rearward sides of the frames 73, for brushing swimming pool surfaces over which the apparatus moves. The forward and rearward brush assemblies 63, 64 each have one side driven by being connected to respective lower pulley wheel 82 on one side of the apparatus and an opposite side driven by being connected to the pulley wheels 82 on the opposite side of the apparatus. The left and right sides of each of the forward and rearward brush assemblies can thus rotate independently of each other as will be more fully explained in connection with FIGS. 4B, 24 and 25. Outside wheels 87 can also play a role in brushing the pool, and preferably have a textured outer surface suitable to that purpose.

Figure 4A:
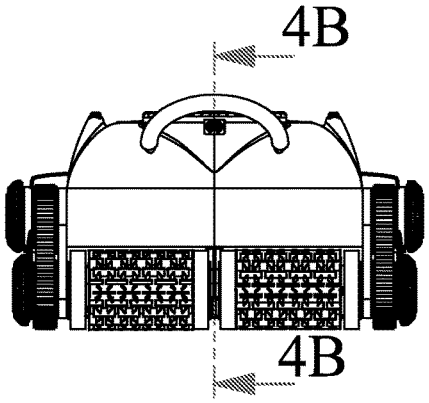
FIG. 4A is a rear elevational view of the apparatus of FIG. 1 with a section line 4B-4B.
Figure 4B:
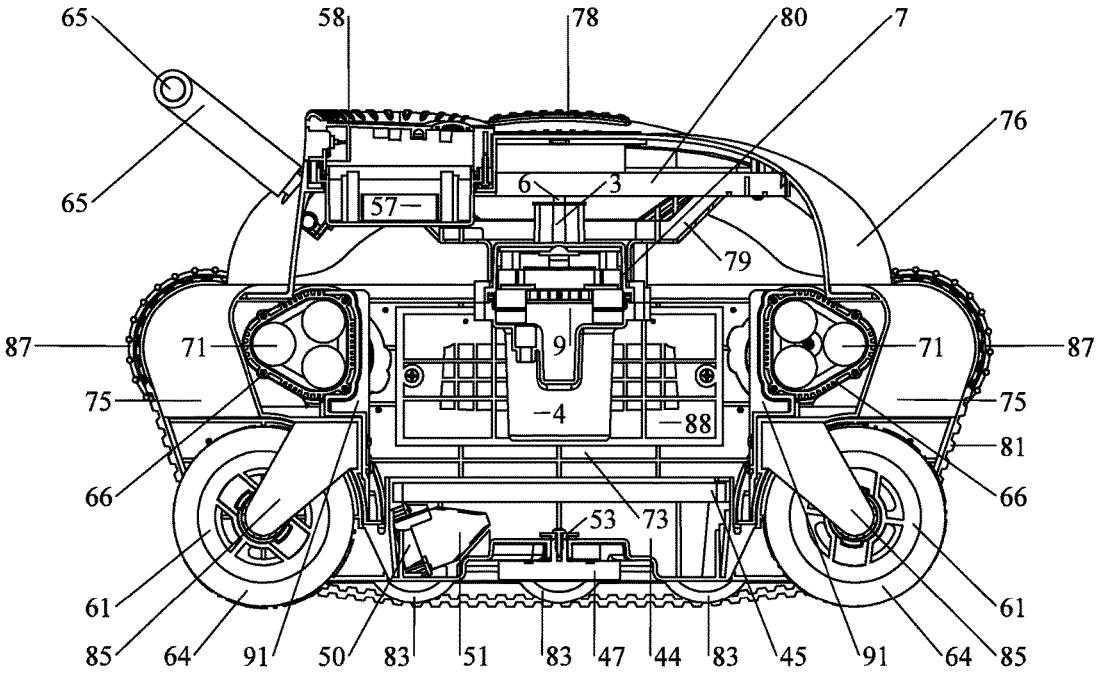
FIG. 4B is a sectional view taken along line 4B-4B of FIG. 4A.
Figure 32A:
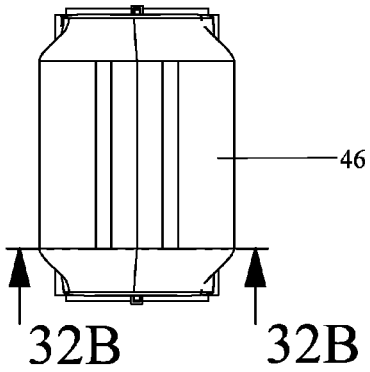
FIG. 32A is a top view of the bottom cover with filter bag of the apparatus of FIG. 1 with a section line 32B-32B.
Figure 32B:
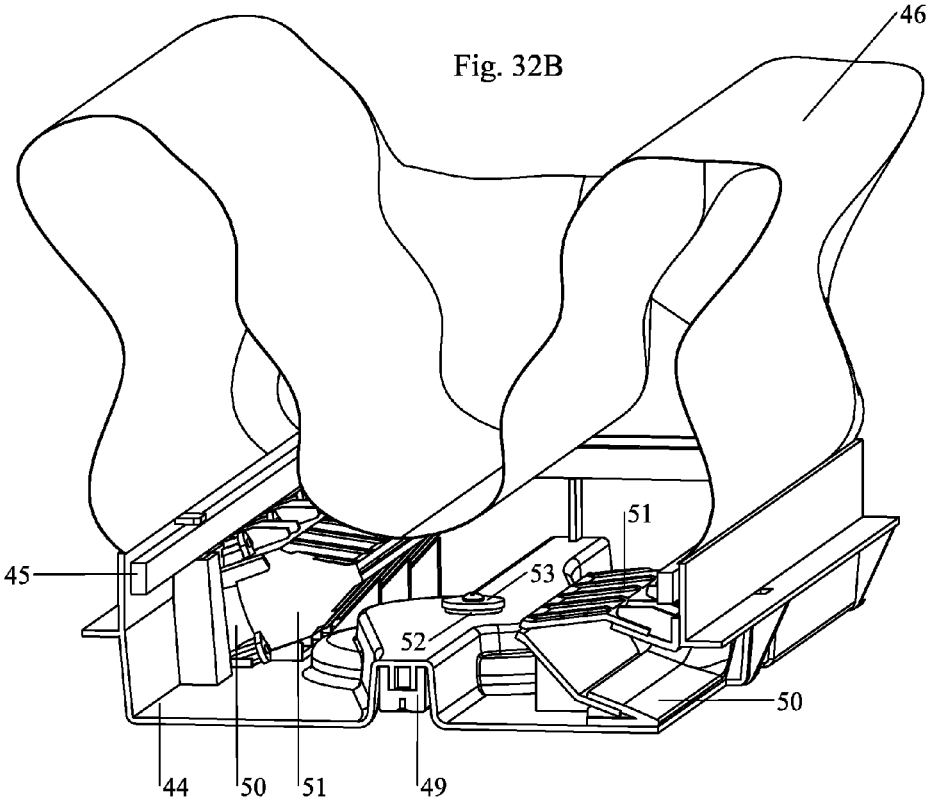
FIG. 32B is a sectional view taken along line 32B-32B of FIG. 32A.
Figure 33A:
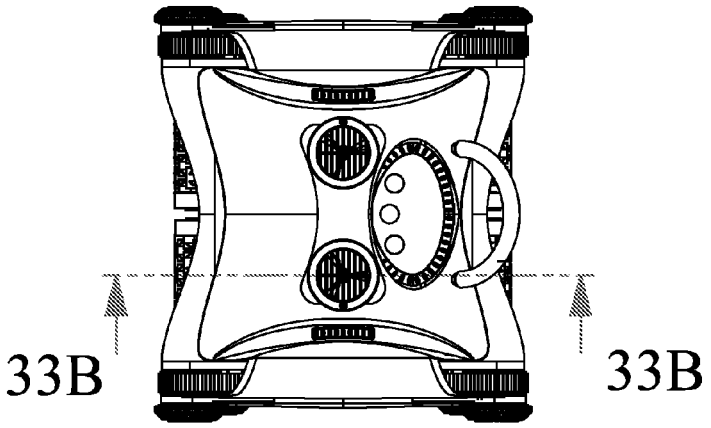
FIG. 33A is a top plan view of the apparatus of FIG. 1 with a section line 33B-33B.
Figure 33B:
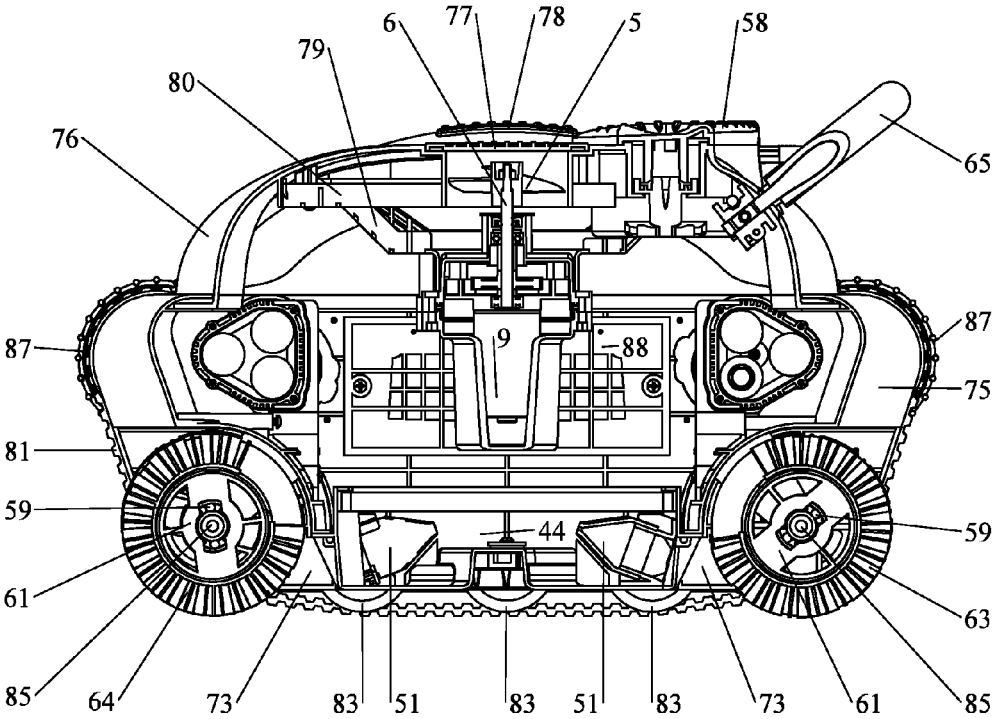
FIG. 33B is a sectional view taken along line 33B-33B of FIG. 33A.
Figure 34A:
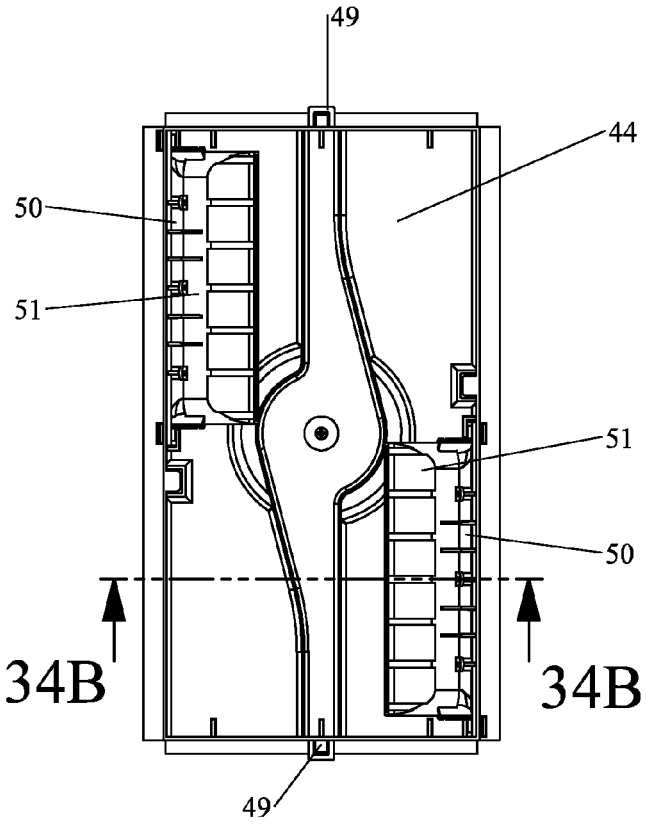
FIG. 34A is a top plan view of the bottom cover without the filter bag of the apparatus of FIG. 1 with a section line 34B-34B.
Figure 34B:
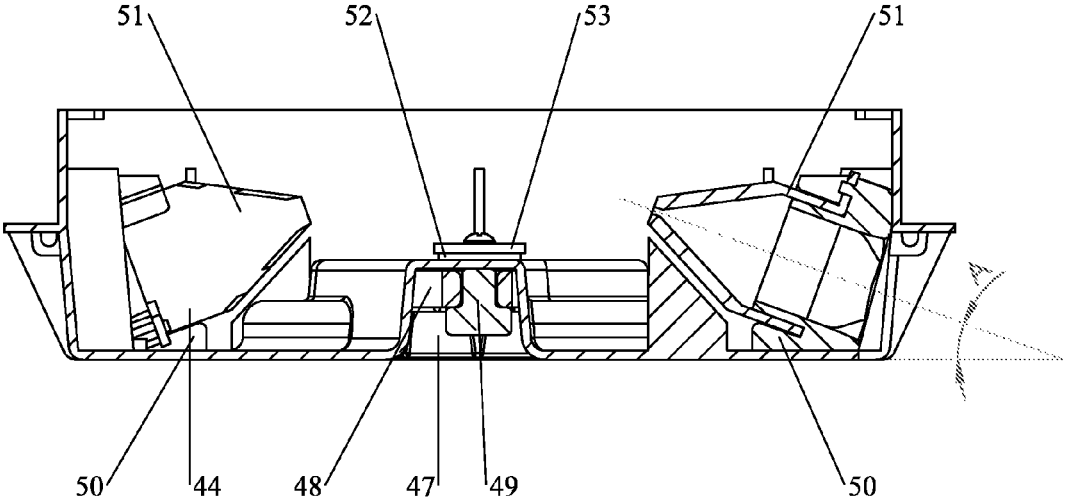
FIG. 34B is a sectional view taken along line 34B-34B of FIG. 34A.
Figure 42:
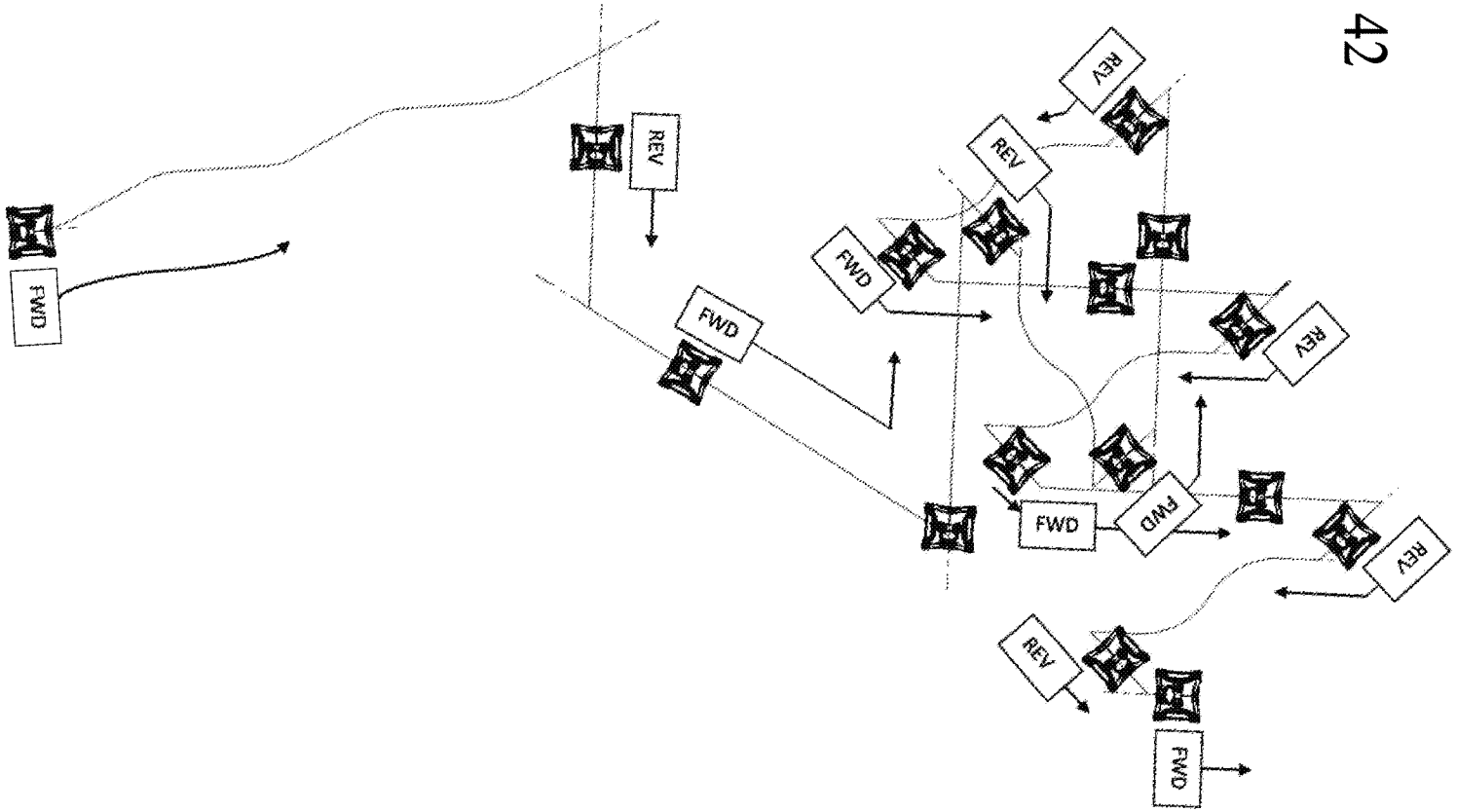
FIG. 42 is a time elapse image of another path taken by the apparatus of the invention according to another embodiment of its programming.

With reference to FIGS. 4B, 5B and 10, as well as FIGS. 12, 28B, 30, 32B, 33B 34A, 34B and 42 a pair of oppositely facing, acutely angled one way valves 51 are provided in the frame between the forward and rearward brush assemblies and near a lower side of the frame with respect to the vertical axis. Each one way valve has an inlet for receiving water from a swimming pool into a lower free volume of the frame, and an outlet in the lower volume of the frame. The valves 51 are advantageously duck bill valves, each with a flexible rubber flapper part 51 having opposite flapper blades with engaged together outlet edges extending in the transverse direction, and an open inlet end mounted to a valve mount 50 connected to a bottom cover 44 removably connected to the bottom of the apparatus frame. Each valve is importantly oriented at an acute angle A to the travel direction of the apparatus as best shown in FIGS. 34B and 42, for more efficient cleaning over prior art valve orientations that used flap valves extending substantially parallel to the travel direction axis as shown in FIG. 31. The valves are oriented at about 30 degree angles with respect to the horizontal axis, when the apparatus is upright, and the angle is preferably about 10 to 60 degrees and more preferably 20 to 40 degrees. Using a separate flapper part 51 and mount 50 and connecting these to the removable bottom cover 44, makes easier user removal and replacement for upgrade and cleaning of these parts.

Figure 12:
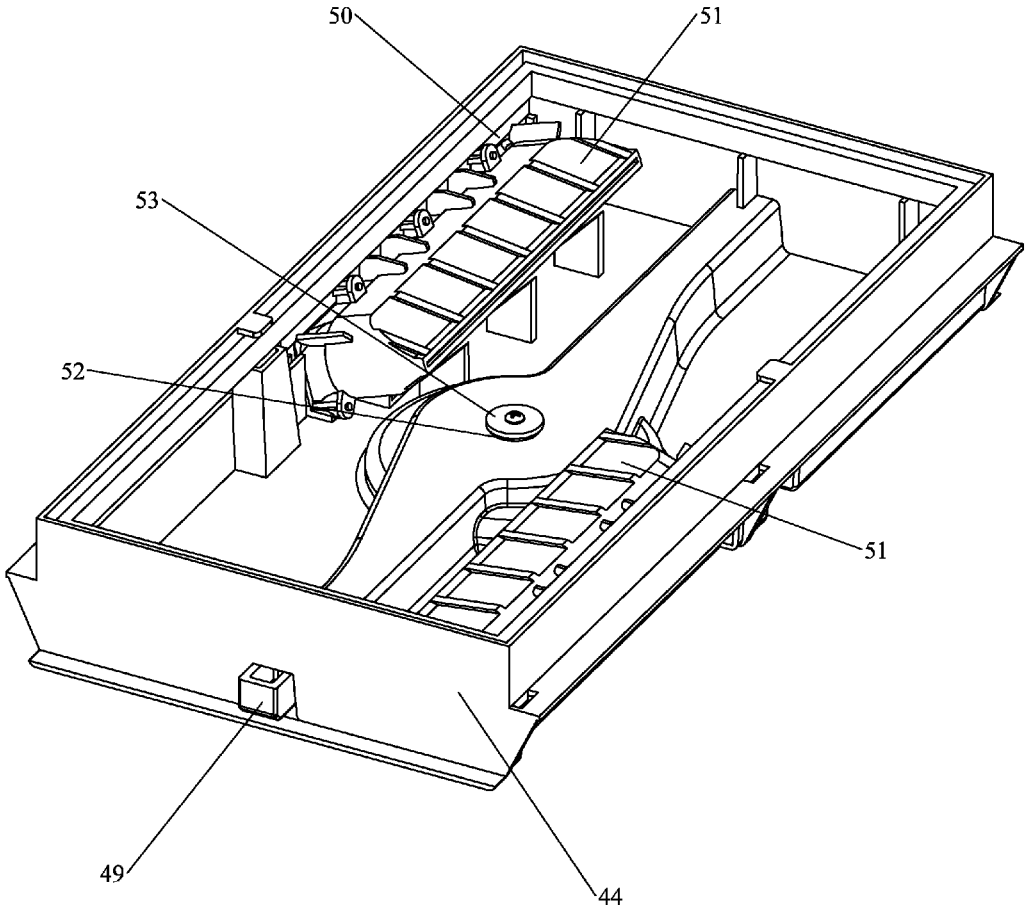
FIG. 12 is a top, right, front perspective view of a bottom cover of the apparatus of FIG. 1, with a pair of one-way, duck bill valves and an internal housing of a quick latch mechanism visible.

The removable bottom cover 44 also carries an easily removable filter bag 46 having an opening with a semi-rigid filter bag ring 45. The filter bag 46 is engaged over the outlets of the valve 51 and is expandable as shown in FIG. 32B, into a lower free volume of the frame shown in FIG. 30, for filtering debris from water received by the one way bill valves before water exits the filter bag and enters a remaining free volume of the frame. The bag 46 is removably connected to the bottom cover by placing the rectangular bag ring 45 in the rectangular space in bottom cover 44, with long sides of the ring 45 captured under a pair of tabs near the center of each long side of bottom cover 44 as shown in FIG. 12. The bag 46 is easily removed for cleaning or replacement by bending the long sides of ring 45 inwardly and removing the ring 45 and the bag 46, from the bottom cover 44.

Figure 30:
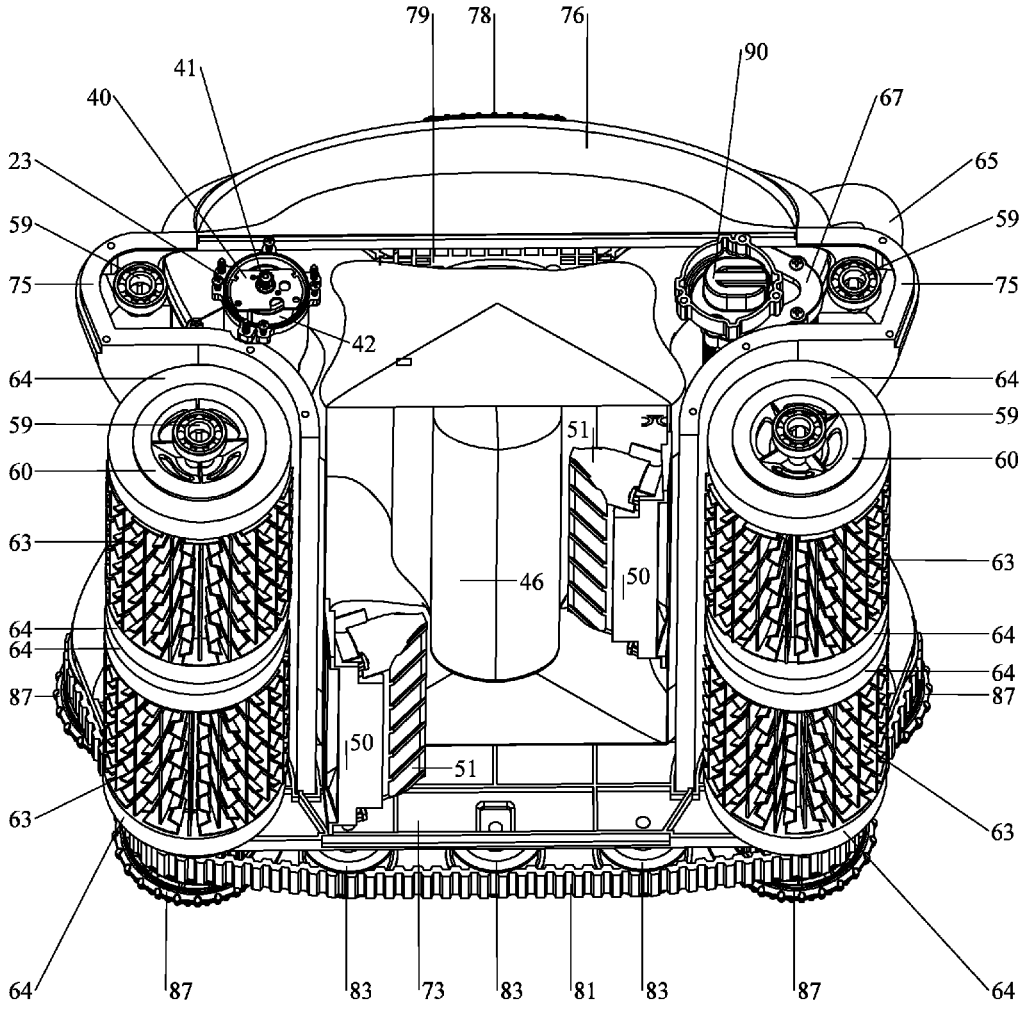
FIG. 30 is a bottom, left, perspective view of the apparatus of FIG. 1, with left side frame and bottom covers removed to reveal underlying details.
Figure 31:
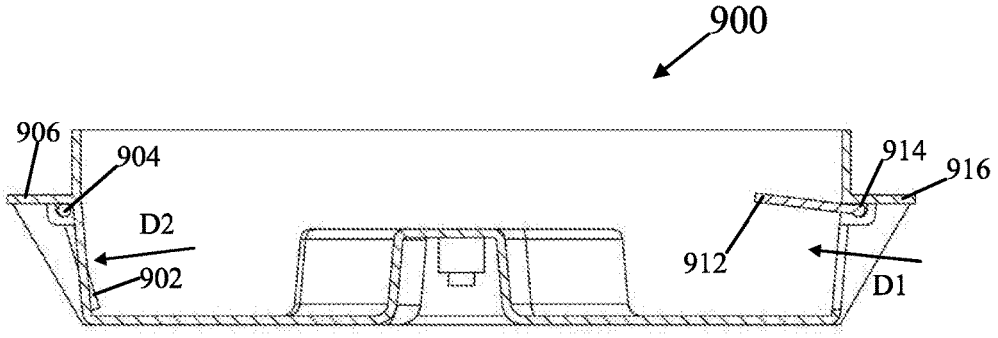
Fig. 31 (Prior Art)
FIG. 31 is a sectional view of a prior art inlet valve arrangement for a prior art swimming pool cleaning apparatus.

Water flow suction for the apparatus is provided by a pump assembly best shown in FIGS. 3B, 4B, 5B, 5C,10, 16, 17, 20, 26 and 29B, and mounted in the frame for pumping water in through the valves 51, through the porous fabric of the filter bag 46 in the free volume in the frame visible in FIG. 30, past a screen 79 and out through a pair of upper exhaust grills 77 in the top cover 76 of the frame, with respect to the vertical axis of the frame. Screen 79 is provided to protect the impellers 5 for being contacted by the filter bag material, twigs, or other large debris that may be drawn near the impellers, hindering their operation or damaging them.

Figure 18:
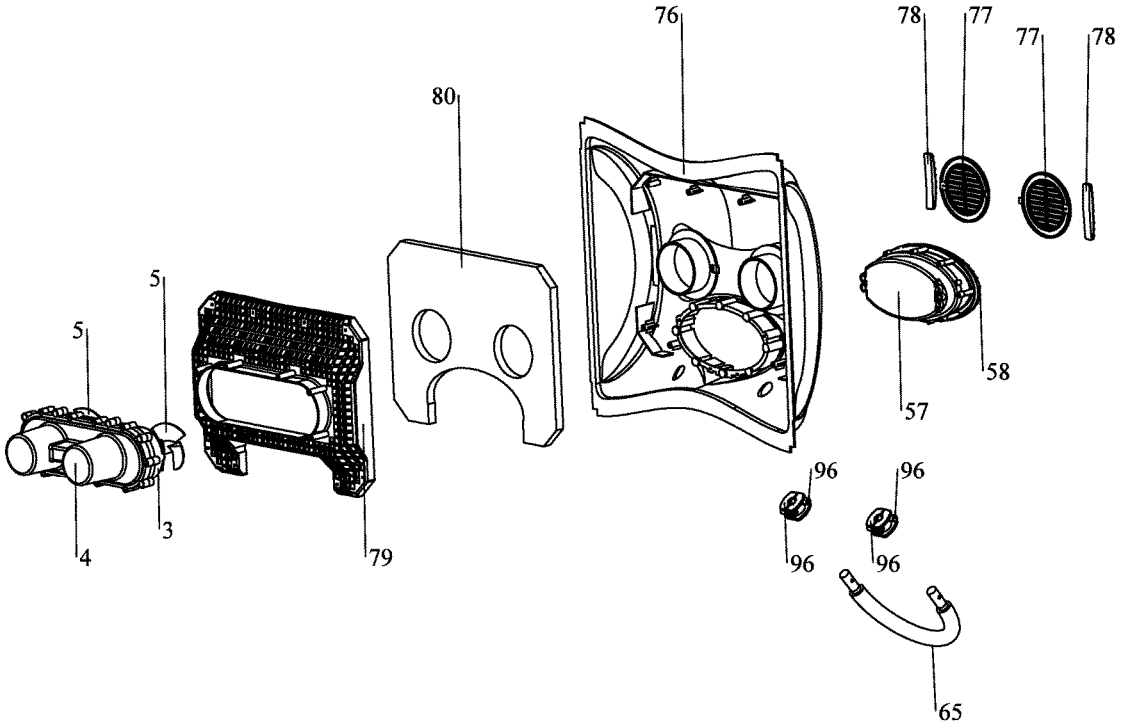
FIG. 18 is an exploded, bottom, front, left perspective view of a top cover of the apparatus of FIG. 1, showing the pump assembly, a control panel, exhaust grills, handle, and an exhaust screen of the apparatus that are connected to the top cover.
Figure 19:
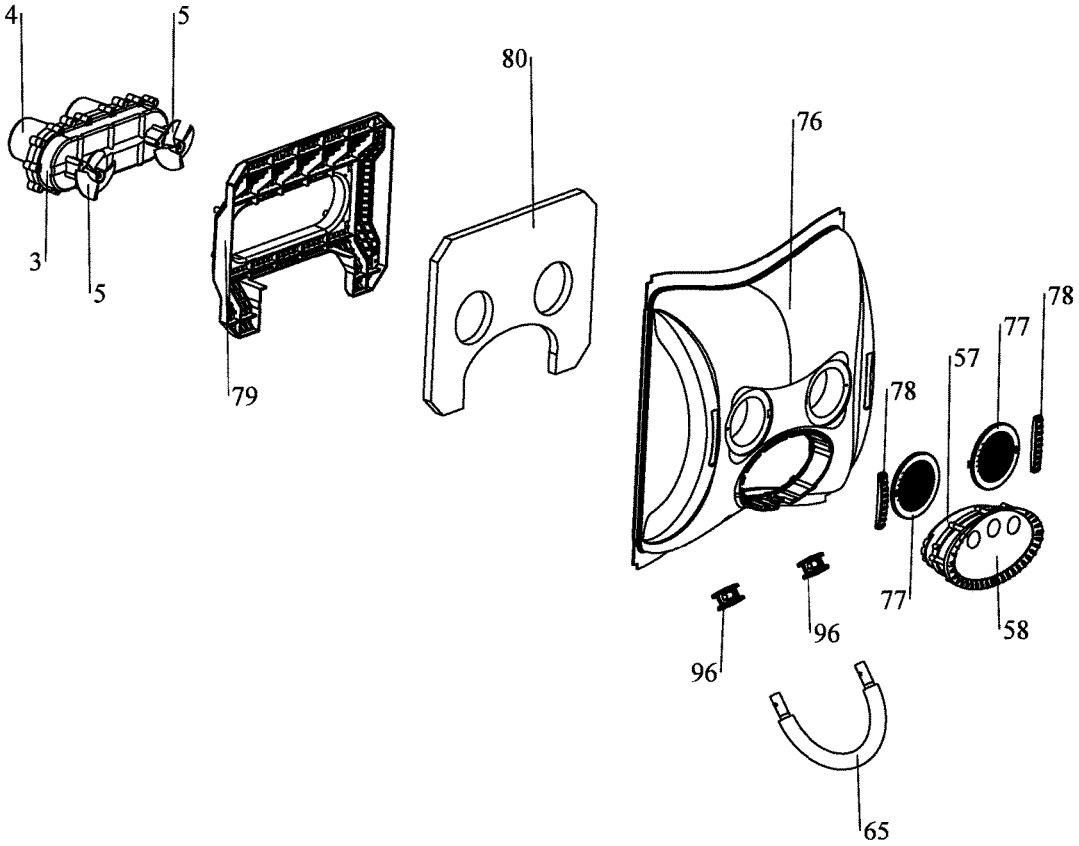
FIG. 19 is an exploded, top, front, left perspective view of the components of FIG. 18.

With reference to FIGS. 18 and 19, the apparatus includes a computer processor assembly in an electronics package mounted inside a sealed control box with a bottom housing 57 and a body top 58 in the frame. The computer processor assembly is electrically connected to the drive motors and a pair of pump assembly motors for controlling the drive motors and pump assembly. As illustrated schematically in FIG. 35, the computer processor assembly 300 includes, among other components, a computer processor 306 and a computer memory 302 for storing an operating program for controlling the operation of the drive motors and pump assembly motors for moving the frame along various selected programmed paths along swimming pool surfaces, and for pumping water through the free volumes of the frame. This makes the apparatus automatous and cordless with respect to control.

In alternative embodiments, some or all of the controls and the processing may be located physically apart from the apparatus, such as outside the pool and/or in a docking station. Preferably known wireless communications methods would be used for communication between a separate control box and the apparatus. A floating control box is possible. Control by an outside electronic application, such as a smart phone application, is also contemplated.

The apparatus is made otherwise cordless by including at least one, but preferably two rechargeable battery assemblies 66 shown in FIGS. 4B and 10, and mounted in the frame. Each battery assembly contains at least one, but preferably eighteen battery cell packs that are electrically connected to the computer processor assembly, to the drive motors and to the pump assembly motors, for powering them. Various battery and rechargeable battery arrangements are usable with this invention. The number and arrangement will vary according to the type(s) of battery used, apparatus power requirements, desired charge life, rechargeability features, weight considerations, price, evolving technology, etc.

In the depicted embodiment, the two rechargeable battery assemblies are mounted in the frame at locations spaced apart from each other on the travel direction axis, and each rechargeable battery assembly extends parallel to the transverse axis. Each is also aligned with one of the drive motors. The pump assembly is between the rechargeable battery assemblies. Together this arrangement of relatively heavy components balances weight distribution in the frame and keep the center of gravity low. Other placements of the battery packs are possible, including asymmetrical arrangements.

With the use of strategically sized and located foam insert 80 above the outlet screen 79 and four cylindrical foam members respectively tucked above the drive motors and, on opposite sides of the frame, above the battery assemblies, the total density of the apparatus is no more than about 10% more than the density of water. Thus the apparatus has nearly neutral buoyancy and a center of gravity of the apparatus below a center of buoyancy of the apparatus, near a central area of the vertical axis so that the apparatus tends to be self-righting when in the water at any orientation other than with its vertical axis extending vertically.

In alternative embodiments, the apparatus has a density of from 95%-105%, from 90%-110%, from 80%-120%, from 100%-120%, from 100%-110%, from 100%-120%, from 101%-105%, from 101%-110%, from 101%-120%, or from 90%-99% of the density of water.

In preferred embodiments the apparatus has a low center of gravity to prevent flipping over and to encourage wheels down and tracks down settling in water. This can be achieved by positioning of the heavier elements of the apparatus generally lower, and positioning open spaces and foam or other low density materials generally higher. Thus, the center of gravity is preferably below the vertical midpoint of the apparatus. Considering an apparatus having a frame or body with a top and a bottom, with the top of the body being at a relative height of 100% from the bottom, the vertical midpoint being a relative height of 50% from the bottom, and the very bottom of the device being at a relative height of 0% from the bottom, the center of gravity is preferably no higher than 50%, than 45%, than 40%, than 35%, than 33%, than 30%, than 25%, or than 20% of the relative height from the bottom of the device.

Figure 16:
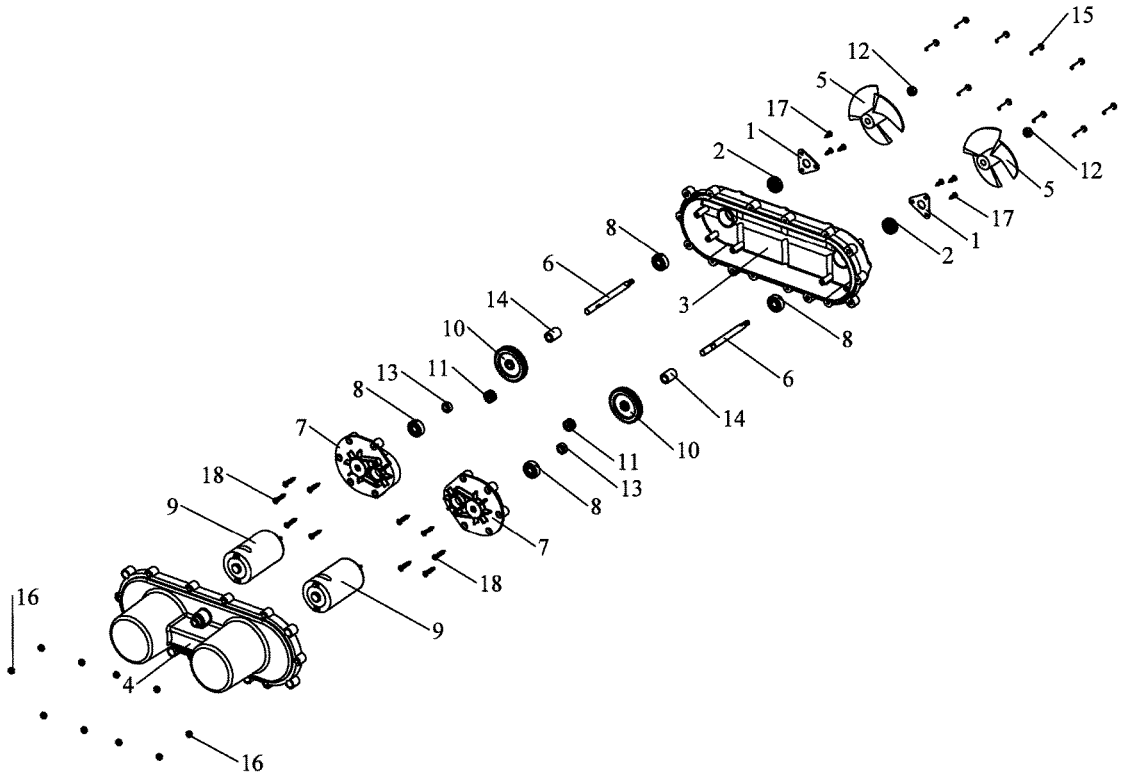
FIG. 16 is an exploded, front, bottom right perspective view of the components of a pump assembly of the apparatus of FIG. 1, showing dual pump motors with their drive trains and impellers.
Figure 17:
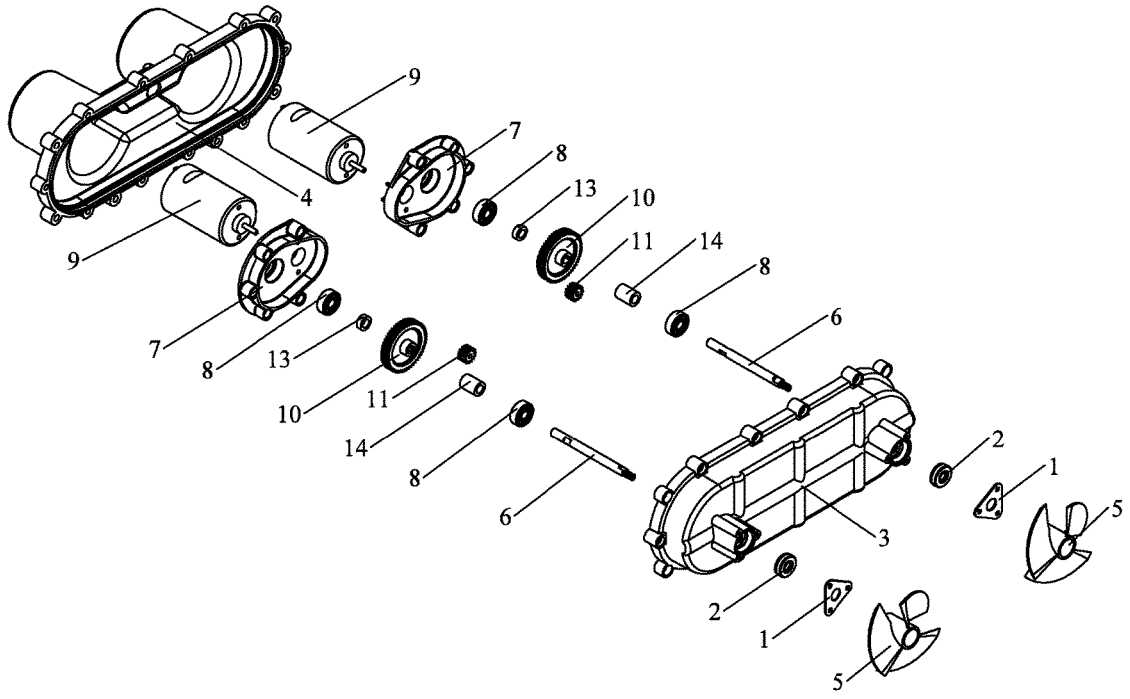
FIG. 17 is an exploded, front, top perspective view of components of the pump assembly of the apparatus of FIG. 1.

The apparatus includes the top cover 76 connected to the frames 73 and side frame covers 74, for covering an upper side of the remaining volume inside the frame above the expanded filter bag 46. The top cover 76 includes two water outlet openings spaced side by side with respect to the transverse axis, opening upwardly with respect to the vertical axis and positioned intermediately with respect to the travel direction axis. These openings are covered by the exhaust grills 77. The pump assembly as best shown in FIGS. 16 and 17 has two electric pump motors 9, 9 spaced side by side with respect to the transverse axis, each pump motor being operatively connected to a impeller 5, 5, for rotating the respective impeller to move water upwardly through respective water outlet openings.

The apparatus also includes the pair of opposite side frame covers 74, each defining a downwardly facing drain handle opening for lifting the apparatus. A flexible drain valve member 89 is in each handle opening and covers a drain valve opening in frame 73 that is in communication with the remaining free volume in the frame. The drain valve member 89 is a flexible rubber flap member mounted for outward movement over a drain valve holder 88 connected to the frame 73. Valve member 89 is movable outwardly under internal water pressure to drain water from the free volume in the frame when the apparatus is lifted out of the water. This quickly reduces the total weight of the apparatus as it is being moved from the swimming pool. The flap member 89 also stops a flow of water into the frame volume when the pump assembly operates because of reduced water pressure in the frame volume that pulls the valve member 89 against its valve holder 88, creating a watertight seal.

Figure 13:
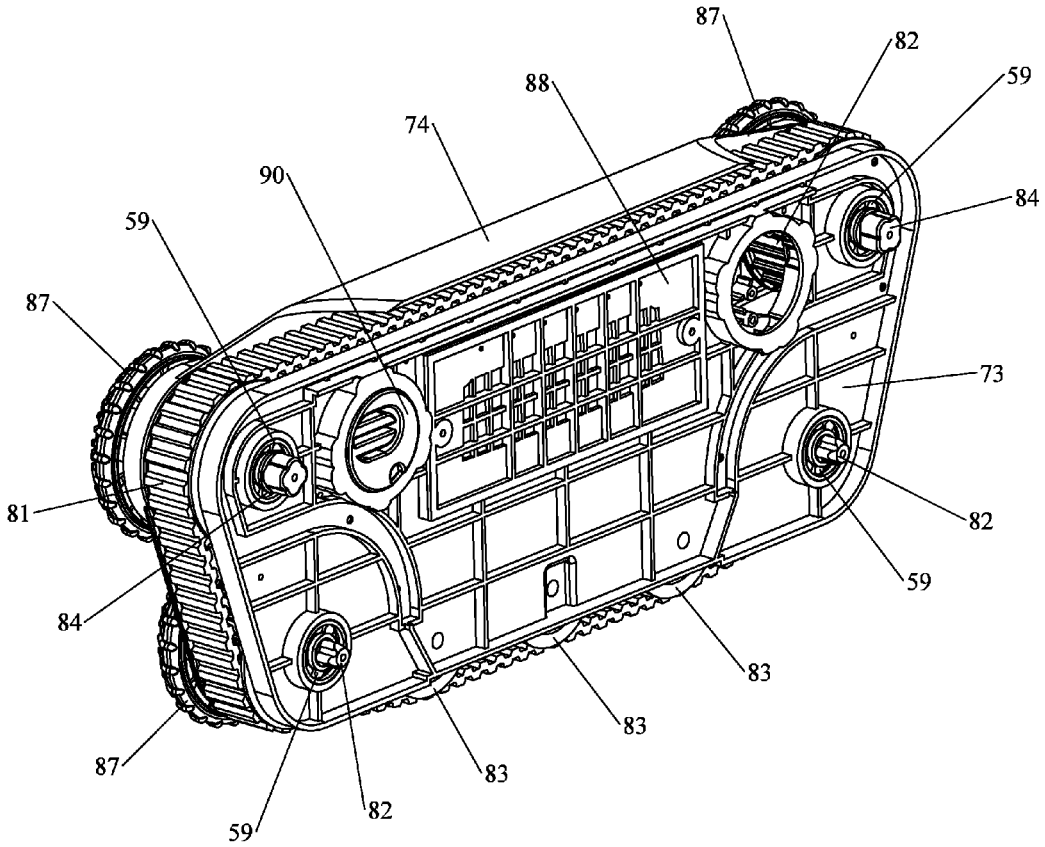
FIG. 13 is a rear, top, interior view of a left frame assembly of the apparatus of FIG. 1 with parts of a left belt and three left outside wheels visible.

The front and rear frame panels 75 are fixed between the side frames 73 to form a ridged chassis for the apparatus. As shown in FIG. 13, each side frame 73 has an interior surface with an S-shaped channel at the front and rear, for receiving a correspondingly shaped edge of a front or rear panel 75 that is connected, e.g. by screws, to the side frame 73. As best illustrated in FIGS. 1, 11, 28B, 30 and 3B, each front and rear panel 75 has an upper concave portion for exposing central portions of the forward and rearward brush assembles 63, 64. These concave portions have central areas that are spaced inwardly of brush assemblies and each entire panel 75 is spaced inwardly of forward and rearward portions of the track belts 81 and inwardly of the outside wheels 87, so that at least one of a belt or an outside wheel will contact all swimming pool surfaces before a panel contacts the surface. Each panel 75 also has a lower curved portion that extends closely and about one quarter of the distance around an inboard circumference of a respective brush assembly as seen in FIGS. 30 and 33B. The front and rear panels 75 thus expose three quarters of each brush assembly while also enclosing forward and rear parts of the free volume inside the apparatus.

The apparatus also includes an exposed charging socket at the rearward side of the control panel 58 as shown in FIG. 1, for receiving an external charging plug for recharging the battery assemblies. The apparatus also has a flexible retrieving rope handle 65 connected to the top cover panel 76, by having opposite ends extending through opposite holes in the rear of the top cover panel 76, on opposite sides of the charging socket as seen in FIGS. 1, 18 and 19, each handle end being fixed to a rope holder 96 inside the top cover to strongly fix handle 65 to the apparatus. A hook on a pole could be used to hook handle 65 to retrieve the apparatus from a swimming pool. Other options for surfacing the apparatus and/or removing it from a pool include using dive planes, preferably adjustable dive planes, tethers, ballasts, and driving it out of the water, optionally using a ramp.

Figure 2:
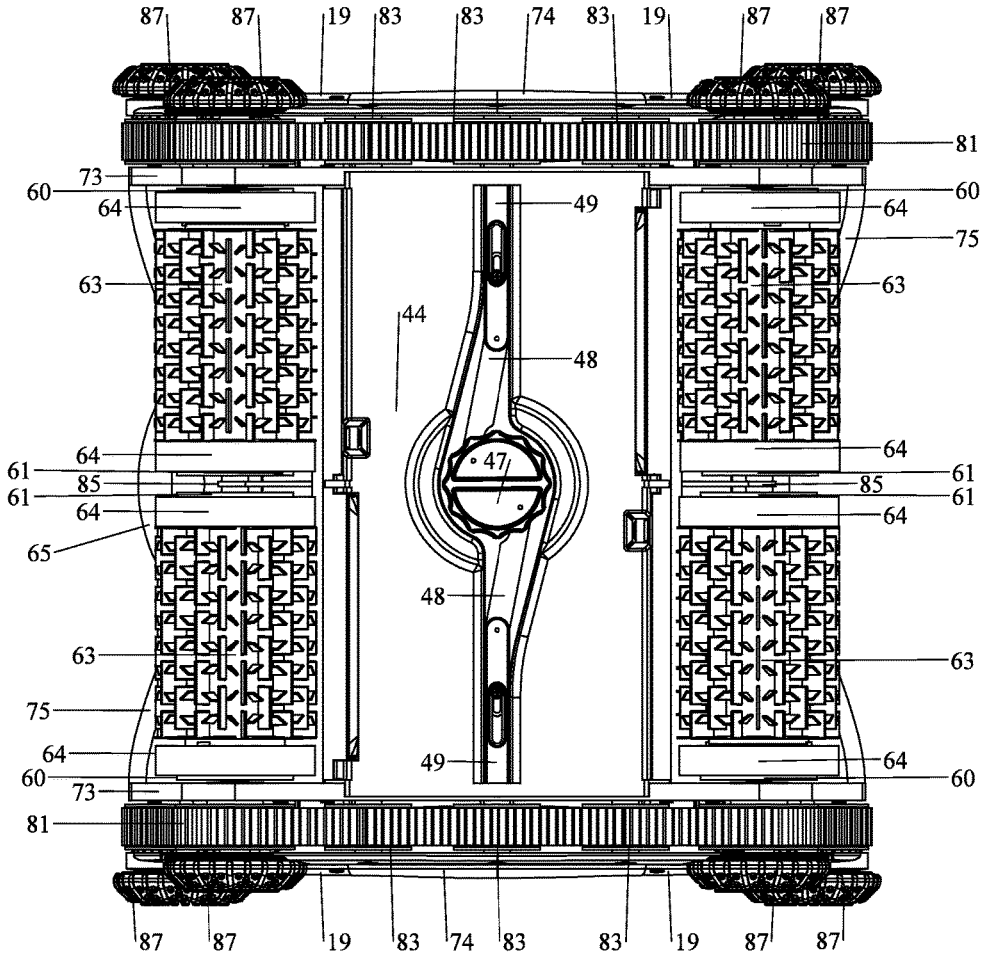
FIG. 2 is a bottom plan view of the apparatus of FIG. 1.
Figure 3A:
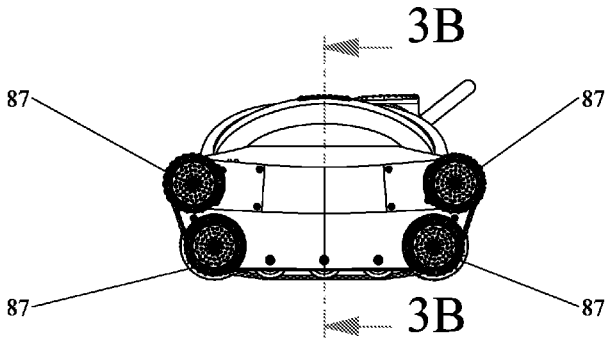
FIG. 3A is a left side elevational view of the apparatus of FIG. 1 with a section line 3B-3B.
Figure 3B:
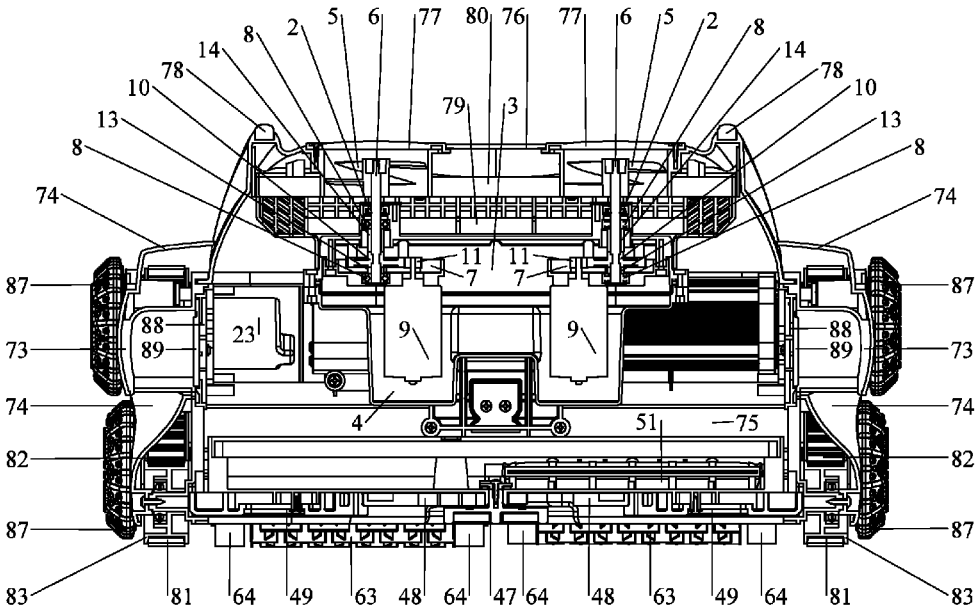
FIG. 3B is a sectional view taken along line 3B-3B of FIG. 3A.

The duck bill valves 51 are mounted in bottom cover 44 as shown in FIG. 12 and spaced from each other along the travel direction axis, each comprises a pair of facing flexible walls extending parallel to the transverse axis of the frame and between the valve inlet and the valve outlet. The flexible walls of each valve 51 have spaced apart inlet edges connected to the valve mount 50, and engaged together outlet edges as shown in FIG. 12 when no water is passing through the valve. The bottom panel 44 covers at least a portion of the bottom of the apparatus and closes the lower free volume in the frame. The duck bull valves 51 and the filter bag 46 (shown in FIGS. 28B and 32B) are connected to the bottom panel 44 for removal as a unit from a remainder of the apparatus when the bottom panel is removed. A linkage device has a rotatable dial 47 shown in FIG. 2, that retracts and extends two linkages 48 each with a linkage stops 49, that latches and unlatches the bottom panel 44 to the apparatus by engaging and disengaging lower central recesses in each side frame 73 as is visible in FIG. 13 above the lower central road wheel 83 in that figure. The dial 47, linkages 48 and stops 49 are mounted for movement in a latch housing formed as part of the hard plastic bottom cover 44, and a silicone spring 52 and spring cap 53 bias an upper surface of the dial 47 against dents in the latch housing for securing the dial and stops in the latched position. FIG. 2 shows the retracted and unlatched position of the dial 47, linkages 48 and stops 49.

The bottom cover 44 is easily removed from the apparatus frame for ready access to the internal volume of the apparatus with its various components which may or may not be designed to be user replaceable. Such components include, but are not limited to, the pump assembly, the drive motors and components related to the drive motors, the batteries, the electronics package in control box 57, 58.

Figure 24:
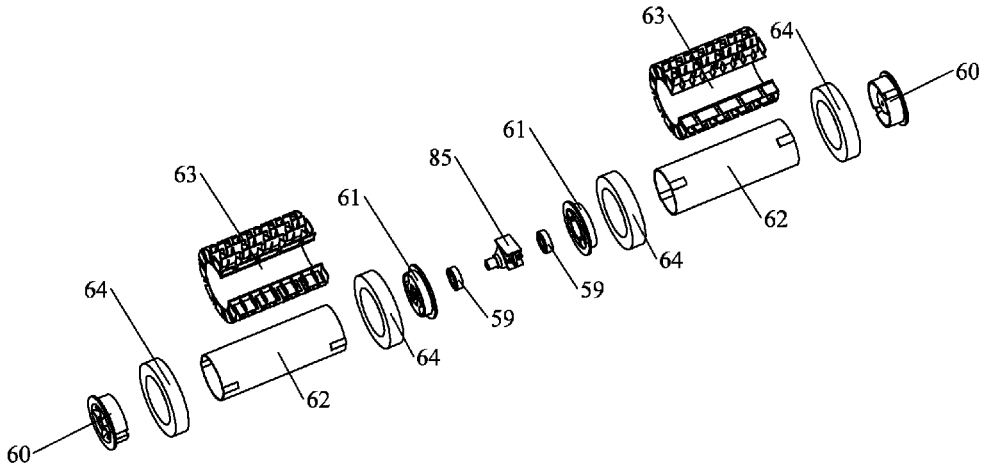
FIG. 24 is an exploded view of a brush assembly of the apparatus of FIG. 1.
Figure 25:
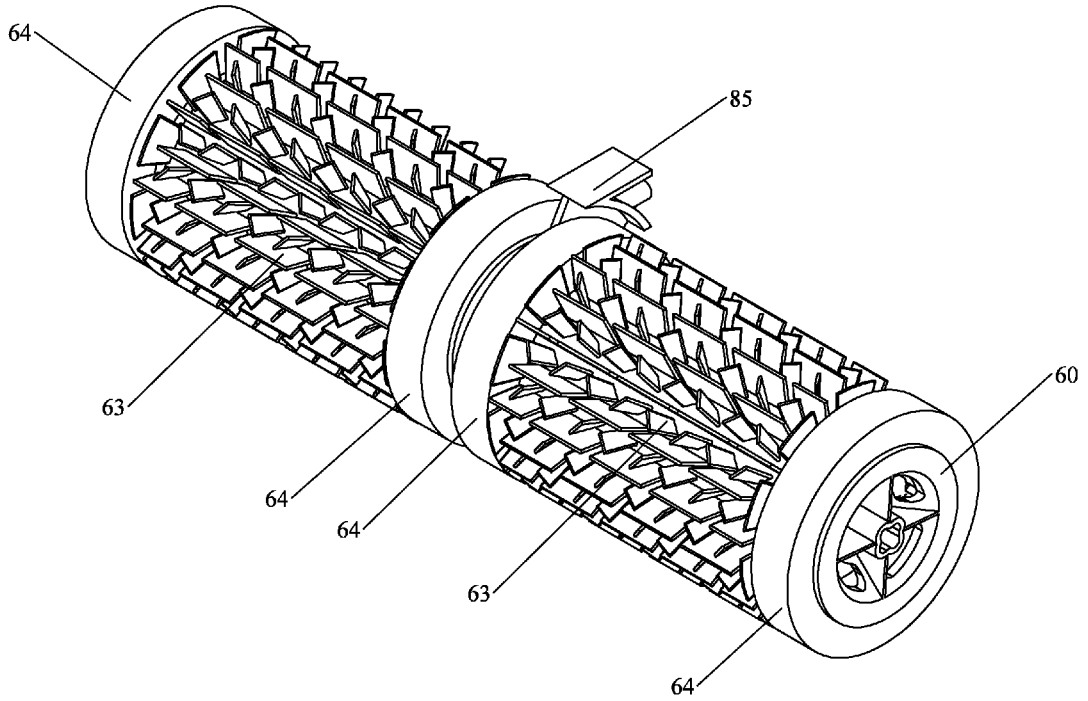
FIG. 25 is a front, perspective view of the assembled brush assembly of FIG. 24.
Figure 26:
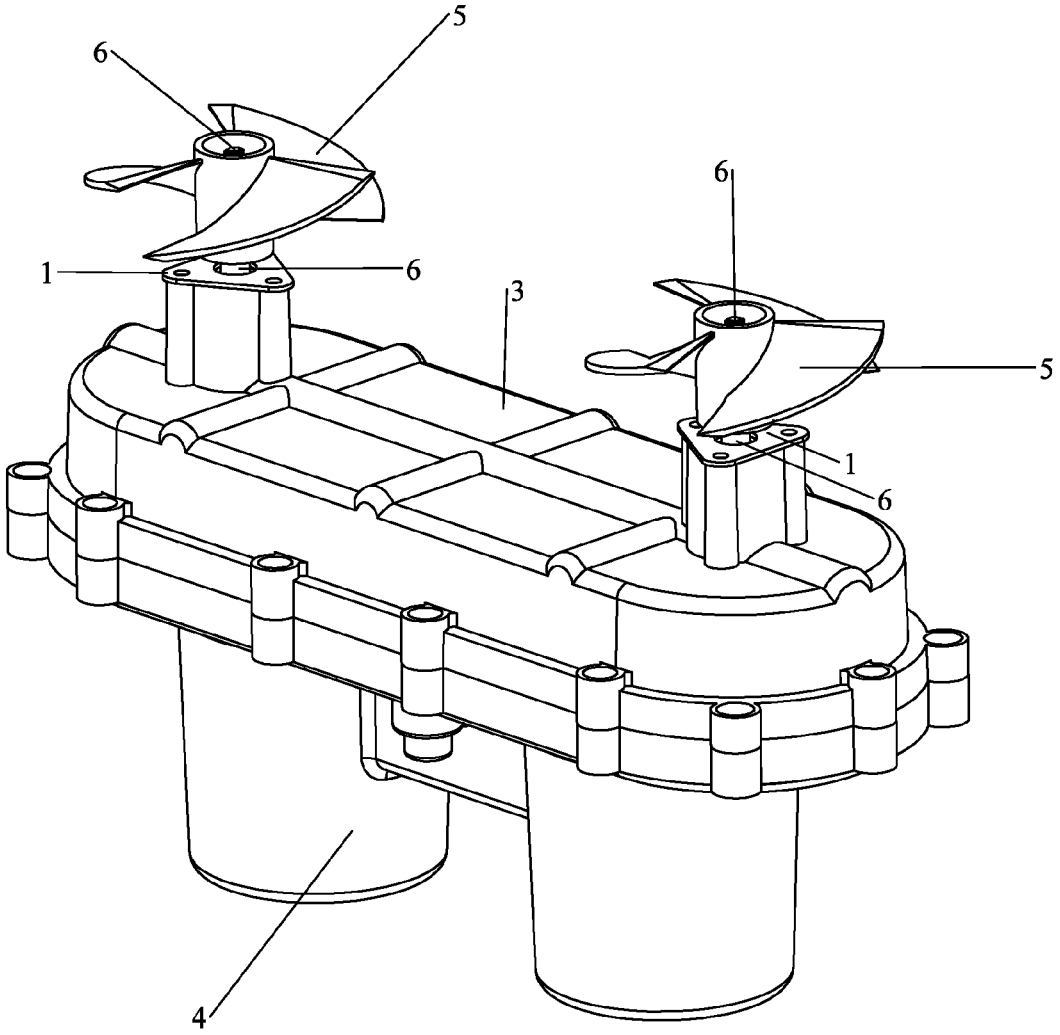
FIG. 26 is a front, top, left perspective view of the assembled pump assembly of FIGS. 16 and 17.
Figure 27:
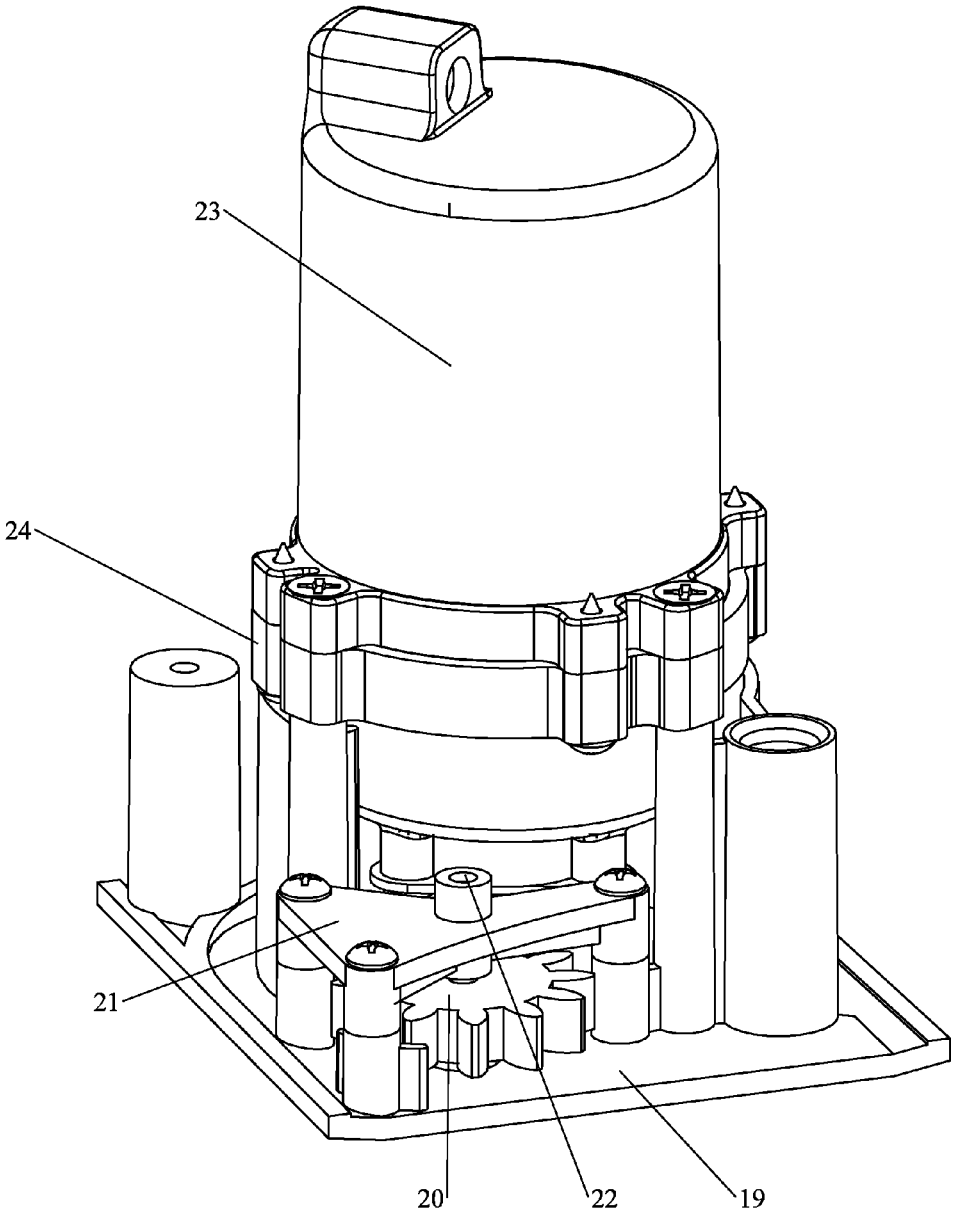
FIG. 27 is an interior, perspective view of the assembled drive assembly of FIG. 21.
Figure 28A:
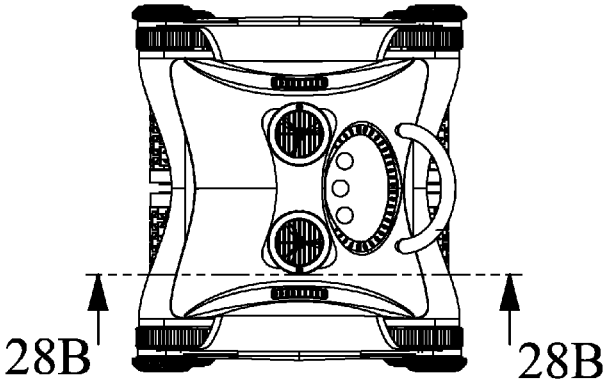
FIG. 28A is a top plan view of the apparatus of FIG. 1 with a section line 28B-28B.
Figure 28B:
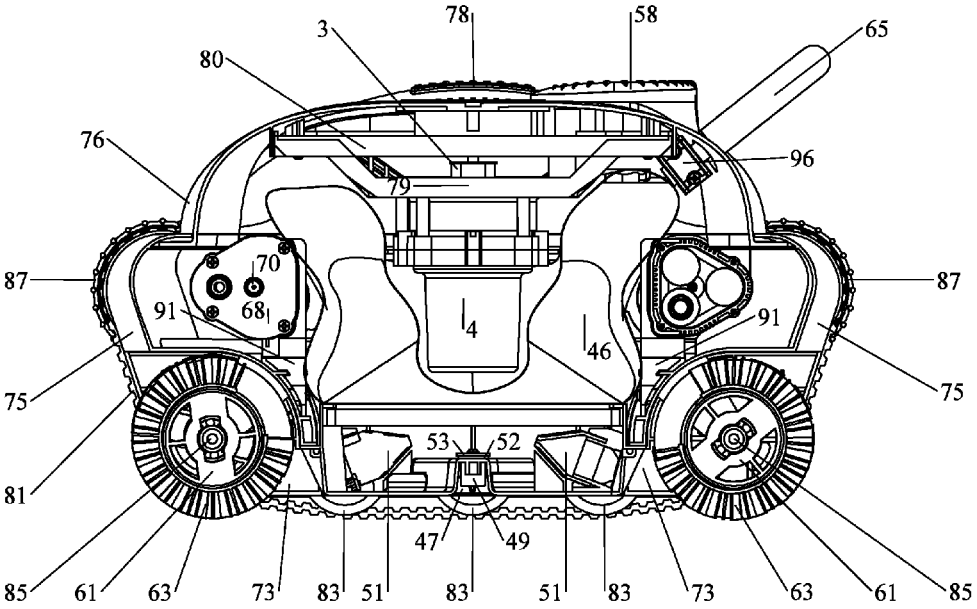
FIG. 28B is a sectional view taken along line 28B-28B of FIG. 28A.
Figure 29A:
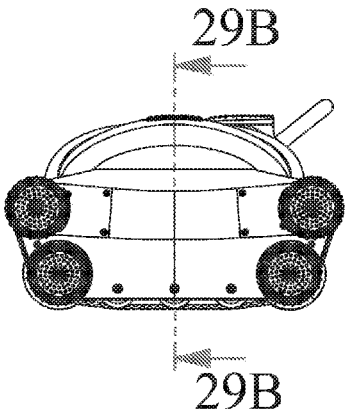
FIG. 29A is a left side elevational view of the apparatus of FIG. 1 with a section line 29B-29B.
Figure 29B:
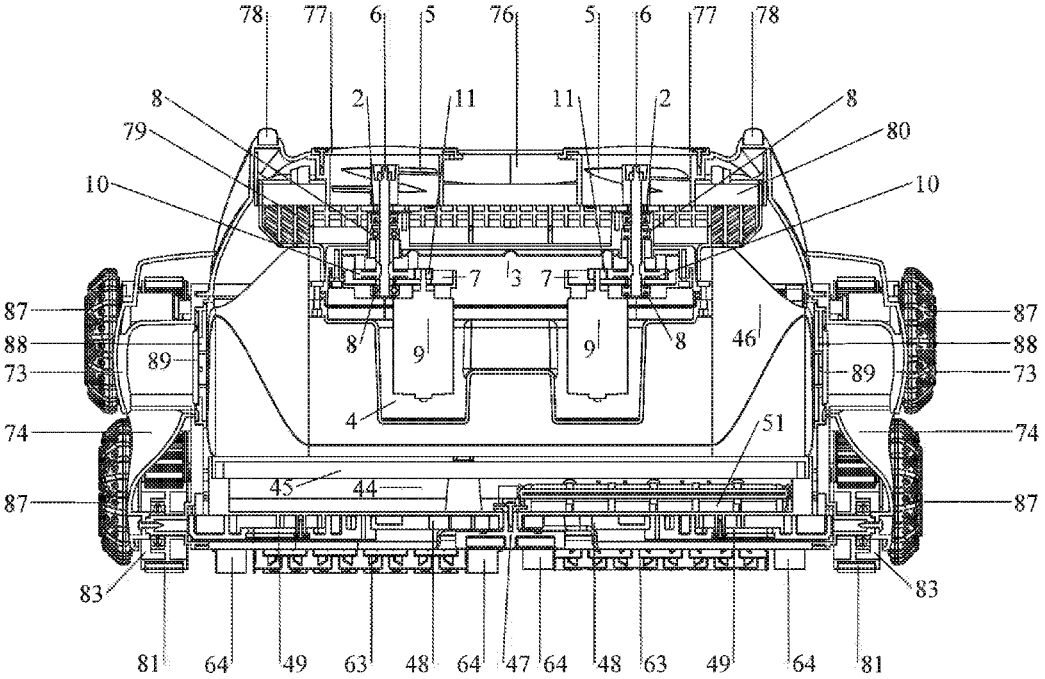
FIG. 29B is a sectional view taken along line 29B-29B of FIG. 29A.

With reference to FIGS. 24 and 25, each of the brush assembles includes two flexible blade brush cylinders 63 wrapped on and fixed to a brush tube 62, for example by adhesive and/or mechanically. Each brush cylinder 63 comprises a first plurality of flexible transversely spaced and transversely extending blades or bristles in circumferentially spaced rows around the flexible blade brush cylinder as best seen in FIG. 25, and a second plurality of flexible transversely spaced blades or bristles at alternating acute angles to the transverse axis and in circumferentially spaced rows around the flexible blade brush cylinder that alternate with the rows of the first plurality of blades. This has been found to most efficiently brush debris on the surfaces to be cleaned. Each brush assembly also includes a pair of polyvinyl acetate (PVA) cylinder or ring shaped brushes 64 on opposite transverse sides of each flexible blade brush cylinder 63. These have been found to swell when wet and further increase the efficiently of cleaning a swimming pool surfaces.

As best shown in FIGS. 2, 10, 13, 15, 24 and 25, each brush assembly is made up of a pair of rubber brushes 63 and four PVA brushes 64, one on either sides of each brush 63, with one rubber brush 63 and two PVA brushes 64 fixed on a hollow tube 62. A central assembly mount 85 that acts as a central bearing for each brush assembly, is connected to a respective front or rear frame body panel 75, by sliding into a central slot in each panel 75. This holds the center of each brush assembly on an axis of each assembly while allowing each one of the rubber brushes 63 with its set of PVA 64 brushes, to rotate independently of each other on either side of mount 85, on either side of the frame. As best seen in FIG. 24, relative rotation is allowed by using ball bearings 59, engaged to both sides of each mount 85, and inner tube caps 61 each pressed into the open end of an adjacent tube 62 with one of the PVA brushes 64 there around. Each axial end of each brush assembly has an outer tube cap 60 pressed into an outer end of a tube 62 with one of the PVA brushes 64 there around. Each cap 60, as shown in FIG. 25, has a non-round, e.g. star shaped, central female hub opening that non-rotatably engages a correspondingly shaped, inwardly extending male hub portion of each pulley wheel 82 as best shown in FIGS. 13 and 15 that extend through the frame 73. A ball bearing 59 is also mounted between each pulley 82 and the frame 73 for easy rotation of each pulley. This engagement of the outer ends of each brush assembly 63, 64 to a pulley 82, makes removal, and therefore replacement of the brush assemblies easier.

In addition to its cleaning function, the PVA brush is preferably sized and positioned to contact the pool surface to improve motive traction. Softer rubber brushes, in contrast, usually will not provide significant force to move the apparatus. Embodiments such as the example of FIGS. 1-2 where 1, 2, 4, or more PVA brushes are interspersed between softer brushes can provide both cleaning and motive force. This is particularly helpful for cleaning difficult surfaces such as walls, stairs, and pool surfaces made of unusual materials, among others.

Figure 6:
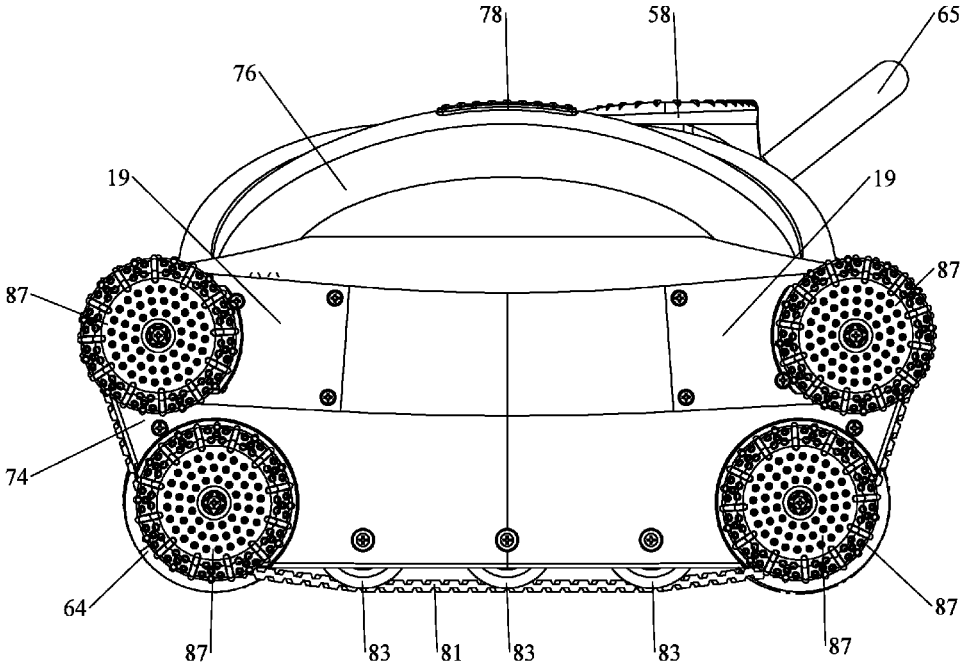
FIG. 6 is a left side elevational view of the apparatus of FIG. 1.

Each outside wheel 87 has an outer dome surface and circular periphery with a plurality of high-friction projections for increasing frictionally engagement of the outside wheels with a swimming pool surface. These are visible in many of the figures and are best seen in FIGS. 1, 2 and 6. These projections along with the strategic locations of the outside wheels 87 at the corners of trapezoidal belt paths and with upper outwardly spaced outer wheels both transversely on both sides, and forwardly and rearwardly, further enhance the apparatus' resistance to becoming stalled anywhere in a swimming pool.

The filter bag 46 can be made of flexible porous material with no stiffening parts so that it forms freely to the shape in the free volumes inside the unit under a flow of water into the bag. This is to allow the maximum amount of debris to be collected by the unit during its cleaning duration.

The top cover 76 has a pair of outer rubber bumpers 78 on upper transversely spaced sides of the top cover, a control and display panel 58 on the top cover that is electrically connected to the computer processor assembly, and a control and display panel bumper around the control and display panel. This is to protect the upper surface of the apparatus, including the upper surface of the control unit, when the apparatus is set upside down. For example, when the apparatus is placed upside-down on the ground to be serviced or emptied by the user or technician, or if it somehow lands on its top surface during operation in a pool.

Referring to FIGS. 3B, 5B, 10, 16, 17 and 26, the pump assembly includes two pump motors 9, 9. These motors may operate together in one embodiment of the invention for thrust that is parallel to the vertical axis of the frame, or may be operated independently of each other to provide an angled thrust for the apparatus in the water, to one side or the other according to another embodiment of the invention. Pump motors 9, 9 are mounted in a housing or body 3 with a housing cap or cover 4 that is hermetically sealed to the housing to exclude water and is connected to the housing by nuts 16 threaded to bolts 15 that extend through aligned holes in the housing 3 and cover 4. DC motors 9 are held in the housing by motor mounts 7 engaged over collars on the motors around each motor shaft. Motor mounts 7 are connected to the housing 3 by screws 18. Two gear trains are connected between the shafts of the respective pump motors 9 and the impeller 5 for spinning the impellers when the pump motors are running. Each gear train has a motor spur gear 11 fixed to a respective motor shaft and having teeth meshed with an impeller spur gear 10. A pair of bearings 8 on opposite sides of each spur gear 10 provide free rotation of the spur gear 10 on the mount 7 and to provide stability. Gear 10 is fixed to an impeller shaft 6 that is fixed to one of the impellers. Bushings 13 and 14 provide proper spacing for the gear 10 and shaft 6. A lipseal 2 is provided outside housing 3, around each impeller shaft 6 to exclude water from the pump housing, and a stuffing box cover 1 is fixed to the housing 3 and over the seals 2 by screws 17. Impellers 5 are fixed to their shafts 6 by nuts 12.

Powering motors 9 spins impellers 5 which causes water to flow into the duck bill valves 51, into and through the bag 46, through the screen 79 and out through the exhaust grills 77, thereby vacuuming up debris from the swimming pool surface and simultaneously pressing the belts 81, some outside wheels 87 and the brush assemblies against the surface for traction and brushing effect, due to the oppositely directed thrust caused by the water flow from grills 77. This flow of water through the apparatus also creates reduced water pressure in the free volume as compared to the water pressure outside the apparatus, to pull flap members 89 against their valve holders 88 to close these drain valves in each side handle. With the pump motors 9 off, and lifting of the apparatus out of the water, the flap members 89 flex open to allow water to quickly drain from the free volume in the apparatus frame.

Figure 20:
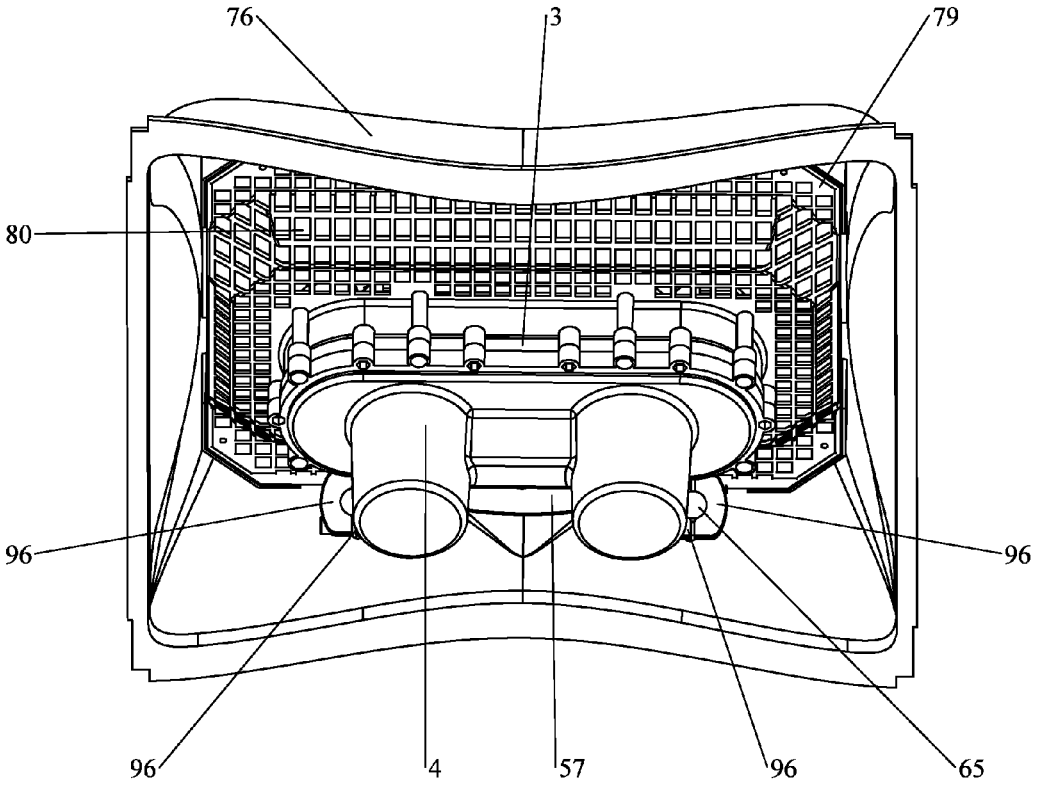
FIG. 20 is a bottom, front perspective view of the top cover with connected pump assembly and exhaust screen illustrated in FIGS. 18 and 19.

With reference to FIGS. 18, 19 and 20, the pump assembly is made up of housing cover 4 and housing 3 with their contained pump motors and drive trains, as well as impellers 5. This pump assembly is fixed in an opening in the screen 79. A porous foam sheet provided in top cover 76, under screen 79 provides the bulk of the buoyancy for the unit. Impellers 5 rotates in a respective pair of cylindrical impeller guides in top cover 76. FIGS. 18 and 19 also show the relative position and orientation of control box 57, 58, handle 65 with its holder 96, the exhaust grills 77 and bumpers 78.

FIGS. 13, 14 and 15 show additional details of the mountings for the pulley wheels 82 and road wheel 83. Each pulley wheel 82 is attached to pairs of ball bearings 59 that are fixed in cylindrical casings in frame 73 for rotatably attaching the pulley wheels 82 to the frame 73. Each road wheel 83 is mounted for rotation via additional ball bearings 59, to respective road wheel axles that are formed as one piece with, and extends from a major plane of, the frame 73, as seen in FIG. 14. Pulley caps 84 are connected to each pulley wheel 82. Each pulley wheel 82 and each road wheel 83 has a peripheral indentation or groove in which track belt 81 is placed and is guided as it moves alone its respective belt path. Pulley spur gears 86 that are connected to each upper outer outside wheel 82 are also shown in FIGS. 14 and 15 and these will be discussed in connection with details of the drive motors later in this disclosure. Each belt 81 is internally toothed to engage the teeth of the pulley wheels 82 and has a plurality of spaced exterior ridges along its length to increase traction with swimming pool surfaces to be traversed. The outside wheels 87 are each fixed to one pulley wheel 82 as mentioned above.

With reference to FIGS. 7B, 8B, 9A, 9B, 10, 15, 21, 22, 23 and 27, the two drive assemblies that are controlled to move the apparatus over the surfaces to be cleaned, will now be described in greater detail. Each drive assembly shown in exploded view in FIG. 21 and assembled in FIG. 27, has a drive or gear train shown in FIGS. 22 and 23, that is driven by a DC motor 42 and drives a pulley spur gear 86 that is fixed to and is concentric with one of the upper, corner pulley wheels 82 as illustrated in FIGS. 7B, 9A, 9B and 15. Preferably, only the front left and rear right pulley wheels 82 are driven, with the remaining pulley and road wheels 82 and 83 rotating due their engagement with their belt 81. Despite this, a spur gear 86 is fixed to each upper corner pulley wheel 82 for manufacturing expediency, i.e., so that all upper pulley wheels 82 are assembled in the same manner and can be used with or without a drive assembly, or allow upgradeability for the apparatus.

Referring again to FIGS. 21, 22 and 23, each drive assembly has a housing cap 23 containing a drive motor 42 and a gear train and is closed by a housing 24 connected by screws to, and hermetically sealed to, the housing cap 23. A spur gear 41 is fixed to the drive shaft of motor 42, and extended through openings in a motor mount 40 and a gear box base 38 to mesh with a larger of two gear segments of a compound gear 26. The gear box base 38 is connected to a gear box plate 39 and together they enclose the gear box for the drive assembly. The gear box also contains a second compound gear 27 with a larger gear segment meshed with the smaller gear segment of gear 26. The smaller gear segment of second compound gear 27 is meshed with a spur gear 30 that is fixed to a drive shaft 28. Shaft 28 extends through a ball bearing 34 mounted to plate 39. An opposite end of shaft 28 is engaged to a ball bearing 37 mounted to base 38. Gears 26 and 27 are mounted for rotation in the gear box on a pair of shafts 33 each with suitable washers 31, spacers 32 and bushings 35 and 36.

Figure 21:
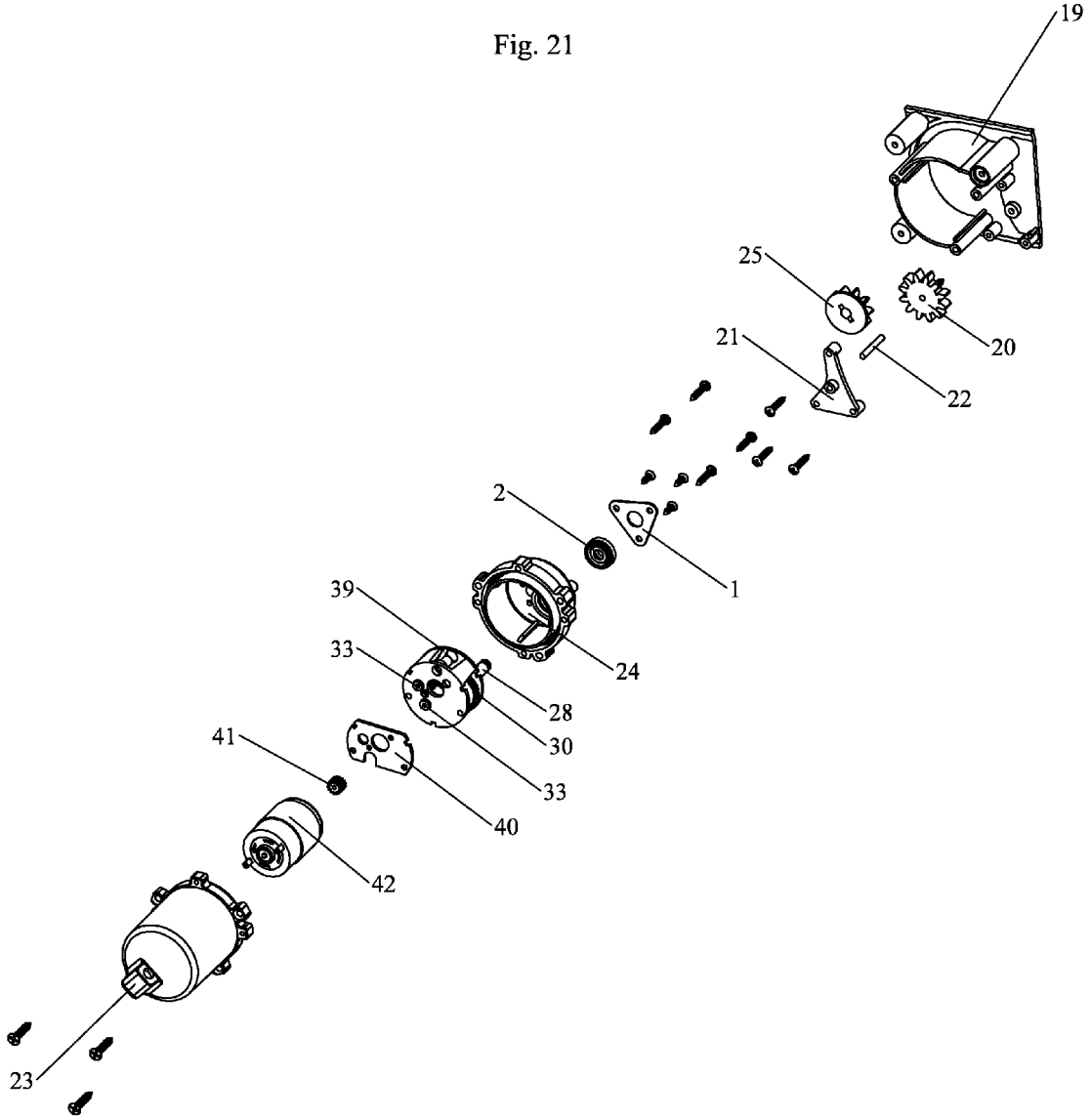
FIG. 21 is an exploded view of a drive assembly of the apparatus of FIG. 1.
Figure 22A:
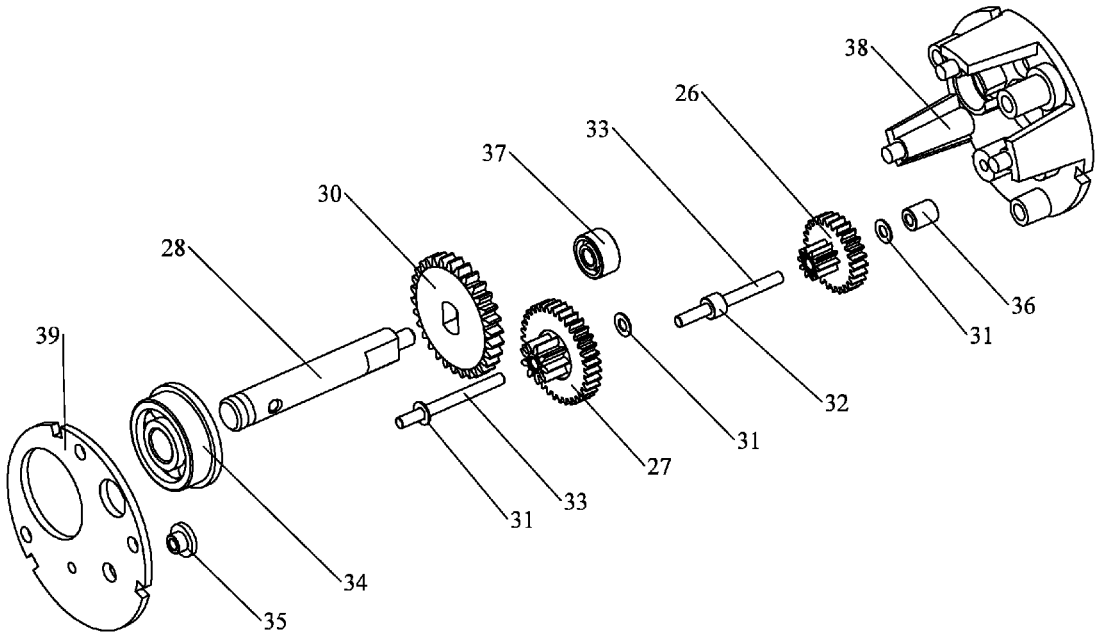
FIG. 22A is an exploded view of a gear train for the drive assembly of FIG. 21.
Figure 22B:
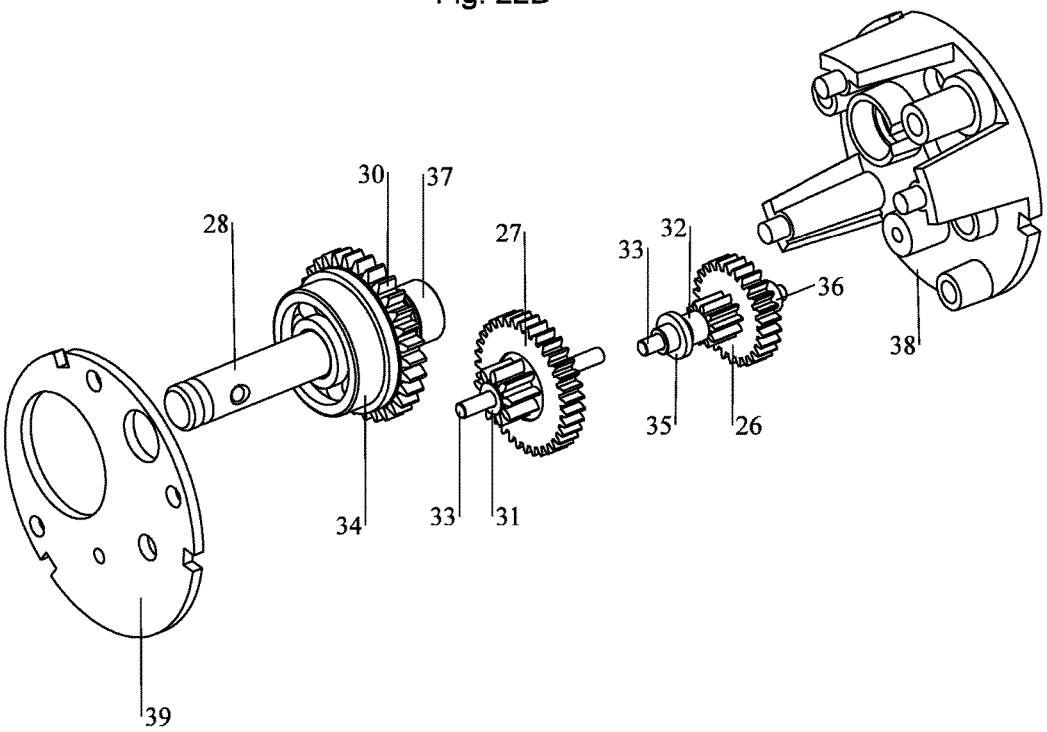
FIG. 22B is a partially exploded view of a gear train for the drive assembly of FIGS. 21 and 22A.
Figure 23:
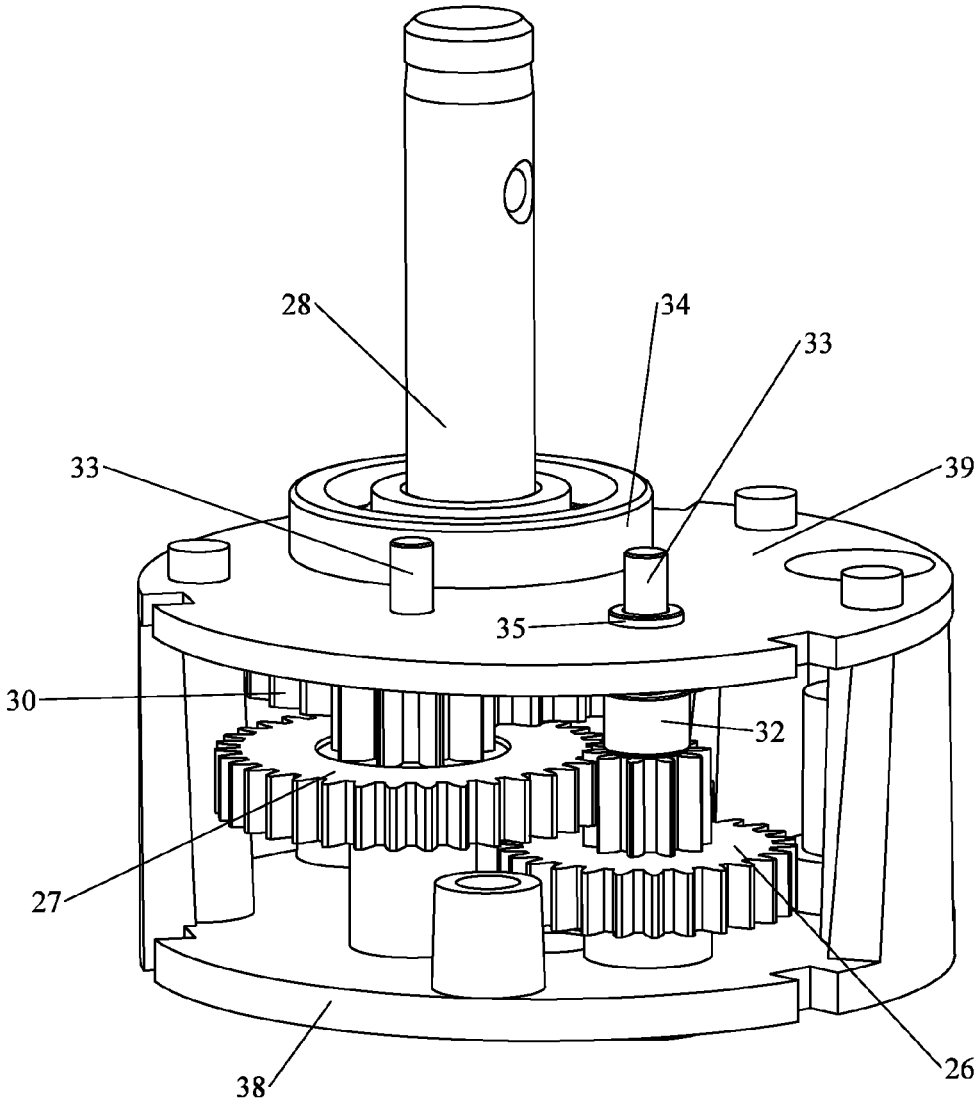
FIG. 23 is a perspective view of the assembled drive train of FIG. 22.

As best seen in FIG. 21, each drive assembly also includes lipseal 2 to be engaged around the drive shaft 28 to seal it from the interior of the motor housing 23, 24, a stuffing box cover 1 screwed to the housing 24 and pressing the seal 2 and a gear mount 21 screwed to the frame cover 19. Gear mount 21 mounts a spur gear 20 in a gear shaft 22 to cover 19 and this gear 20 is meshed with a spur gear 25 that is fixed to the outer end of drive shaft 28. As best shown in FIGS. 9A and 9B, spur gear 20 also meshes with pulley gear 86 to transfer the high speed rotation of the DC motor shaft to slower and controlled rotation of pulley wheel 82 that is fixed to pulley gear 86.

The housing 24 has a circular part that is closely mounted in a corresponding opening in side frame 73 as seen in FIGS. 7B and 8B and the drive assembly is held in place by frame cover 19 being connected by screws to the side frame 73 as shown in FIGS. 1 and 6, for example. In this way, an entire drive assembly can easily be removed and replaced or repaired by the user.

With reference to FIGS. 4B, 5B, 10, 13, 28B and 33B, the apparatus includes two rechargeable battery assemblies that are elongated parallel to the transvers axis of the frame and where each include a battery tube 66 of rounded triangular cross section, containing three rows of NiMH (nickel-metal hydride) batteries 71. The tube 66 is closed at one end that is connected to one of the side frames 73, by a battery pack cap 67 that is connected to a battery packing mount 90 fixed to the frame to support the battery assembly. A battery tube brace 91 further supports the assembly in the frame. The opposite end of battery tube 66 is closed by a battery pack cap top 68. While at present NiMH batteries are preferred, any kind of rechargeable battery or even other rechargeable sources of electrical power may be used to power the apparatus of the invention. It has been found that using charged NiMH batteries, however, the apparatus of the invention can be powered for a full week of long cleaning cycles. The battery tubes 66 may be configured to opposite orientation with respect to each other, as shown in FIG. 5B. However, the batteries 71 could be mounted in any configuration or direction that is effective to power the pump and drive motors and the electronics package. In at least one embodiment, the batteries 71 are mounted in opposite orientations to maintain a structural symmetry. This symmetry and with balance is enhanced by spacing the battery assemblies from each other in the travel direction axis.

To further balance the weight distribution in the apparatus frame, each drive assembly is substantially aligned along the axis of one battery assembly, as shown for the rear combination of battery and drive assemblies in FIG. 10, and to balance buoyancy and provide added structural support for each assembly, a foam cylinder is pressed under each drive assembly and under the end of each battery assembly that is connected to a side frame 73 near a battery packing mount 90. In preferred embodiments foam is provided towards the top of the apparatus to help create a low overall center of gravity, which encourages self-righting in the water and tracks-down landings when the unit settles from a pool wall or surface down to the pool floor.

Figure 35:
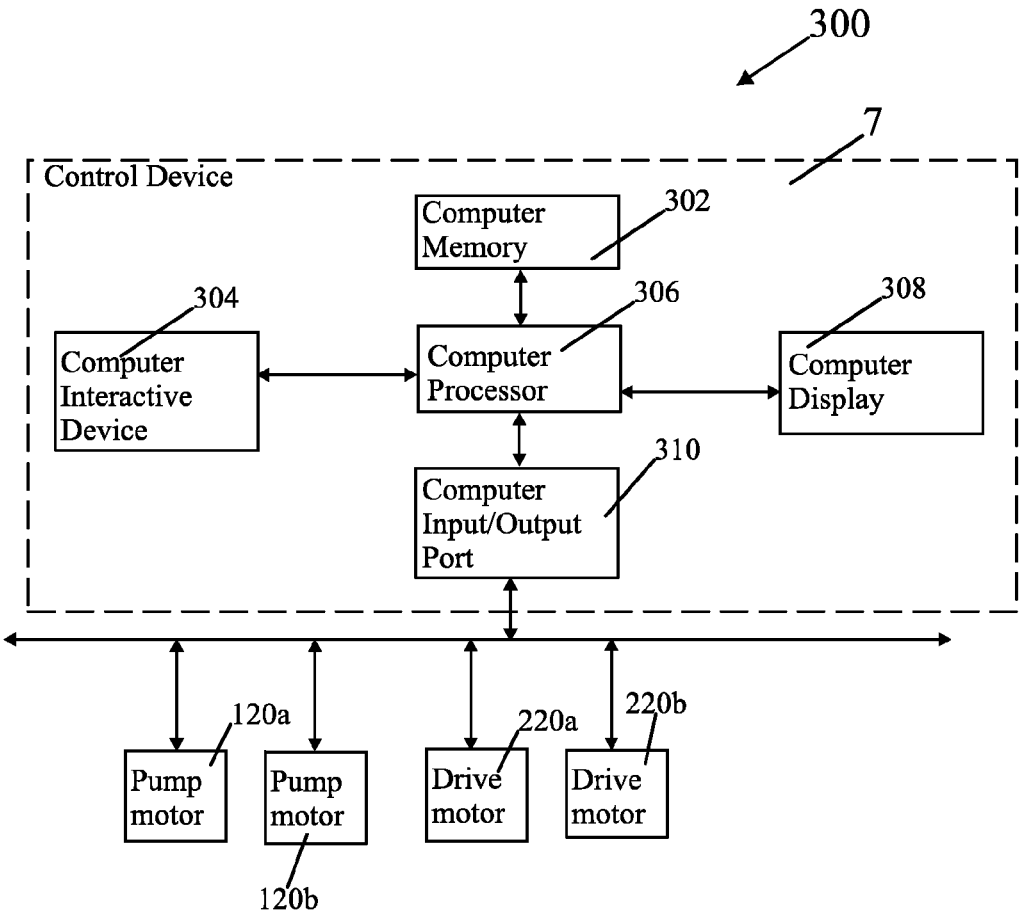
FIG. 35 is a block diagram of components involved in control of movement and various operations of the apparatus of FIG. 1.

FIG. 35 schematically illustrated the electronics package 300 that acts as a control unit for the apparatus and that is housed and sealed in the chamber between the control box body top 58 and the control box body bottom 57 shown in FIGS. 1, 4B and 18, for example. Electronics package 300 includes a computer memory 302, a computer interactive device 304 such as a keyboard and/or touch screen or simply the three push buttons on the housing 58, a computer processor 306, a computer display 308 that may simply be LEDs lights on the housing 58, and a computer input/output port 310. A computer program is stored in computer memory 302 which is executed by the computer processor 306 for controlling operation of the apparatus. Specifically, the computer processor 306 is programmed by a computer program and/or computer software to control the pump motors 9 the drive motors 42.

The use of two pump motors 9, 9 to rotate of impellers 5, 5 is important because this helps maximize performance. By using the two motors together for water flow in the same direction outwardly of the exhaust grills 77, flow rate can be maximized while energy consumption can be minimized from the pump motors. This is not a limiting factor in the operation of the apparatus since the apparatus may be redesigned to use any number and configuration of pump motors and impellers.

A typical pump assembly 3 includes multiple pump motors. The pump motors are preferably mounted in a housing with a housing cap or cover 4 that is hermetically sealed to the housing to exclude water. The pump motors spin propeller-shaped impellers 5 which push water upwards. This water flow causes water suction in through two duck bill valves 51, which receive water and debris from the pool surface under the Pool Cleaner. Water passes through the duck bill valves into the interior region of the Pool Cleaner. See FIGS. 5 and 6. The water then continues upward and exits the unit through exhaust grills at the top of the unit. The water flow exiting from the grills 77 creates a downward pressure on the unit. The pressure holds the apparatus against pool floor and walls, depending on the orientation of the unit.

In a preferred embodiment the pool cleaner resembles a tracked tank. The pool cleaner typically has spinning brushes 63,64 at both its front end and rear end. The spinning brushes are positioned to contact the pool surface to sweep detritus as the pool cleaner travels. The brushes, however, do not generally propel or support the pool cleaner. Instead, the pool cleaner is mostly supported and moved by track belts 81 at its left and right sides. The track belts have a trapezoidal shape, with the top side of the trapezoid being wider than the bottom side which is in contact with the pool surface below. The pool cleaner is preferably propelled forward or backward by moving the tracks on each side of the pool cleaner in unison, and is turned by only moving only one track, or by moving the tracks in different directions and/or at different speeds.

In a preferred embodiment the tracks 81 are wrapped around four pulley wheels 82 on each side of the device. The pulley wheels 82, define the four corners of the trapezoidal track paths. In addition to the pulley wheels 82, preferably three road wheels 83 engage the tracks at ground level on each side. The road wheels are preferably free spinning, and help support the weight of the apparatus. A domed, textured outside wheel 87 is coaxial with and rotates in unison with the pulley wheel 82. The outside wheels extend beyond the tracks for engaging pool walls and other obstacles.

In a preferred embodiment, on each left and right side of the pool cleaner, one of the two upper pulley wheels 82 is driven by a drive motor. A drive shaft 28 extending from a DC motor turns a gear which, through intermediary gears, rotates the nearest pulley wheel 82. Each of the two tracks 81 on the pool cleaner is preferably powered and controlled by just a single drive shaft turning one of the four pulley wheels on that side of the cleaner. The tracks, in turn, transfer power to and rotate all of the wheels 82,83 and all of the spin brushes 63,64, on their respective side of the apparatus. Preferably all of the brushes 63,64 and wheels 82,83 on each left and right side of the pool cleaner rotate as a group. They are collectively powered by one left drive motor or one right drive motor, respectively. The tracks, brushes, and wheels on the left side and right side are thus separately controlled via the left and right drive motors.

In one embodiment, each front and rear brush assembly is made up of two larger rubber brushes 63 and four narrow PVA brushes 64. A PVA brush 64 is fixed to the opposite ends of each rubber brush 63. The left and right halves of the brush assemblies each include one rubber brush 63 and two PVA brushes 64 fixed on a hollow tube 62. Each half rotates as a unit. One end of each left and right side of each brush assembly is supported by a central assembly mount 85. The mount 85 acts as a central bearing, and is connected to either the front or rear frame body panel 75. The bearing mounts 85 allow the left and right side of each assembly to rotate independently of each other on opposite sides of the mount 85. Each brush assembly is axially aligned with two lower pulley wheels 82, and also with two lower outside wheels 87, with one of each 82,87 at each outside end. The forward and rearward brush assemblies can each have a left side driven by axial connection to a lower pulley wheel 82 on the left side of the apparatus, and an opposite right side driven by a pulley wheel 82 on the opposite, right side of the apparatus. The left and right sides of each of the forward and rearward brush assemblies can thus preferably rotate independently of each other.

Figure 36:
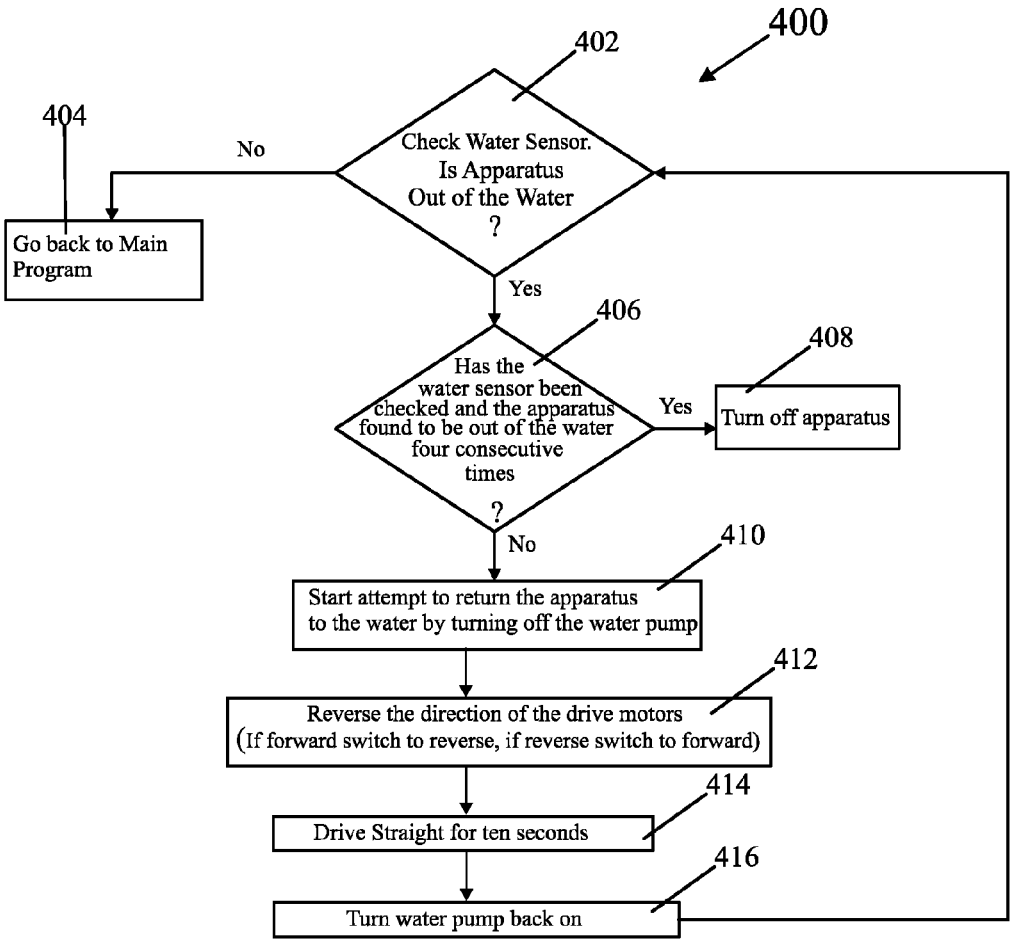
FIG. 36 is a flow chart illustrating an Out of Water routine used in programming for a pool cleaning apparatus of the invention.
Figure 37:
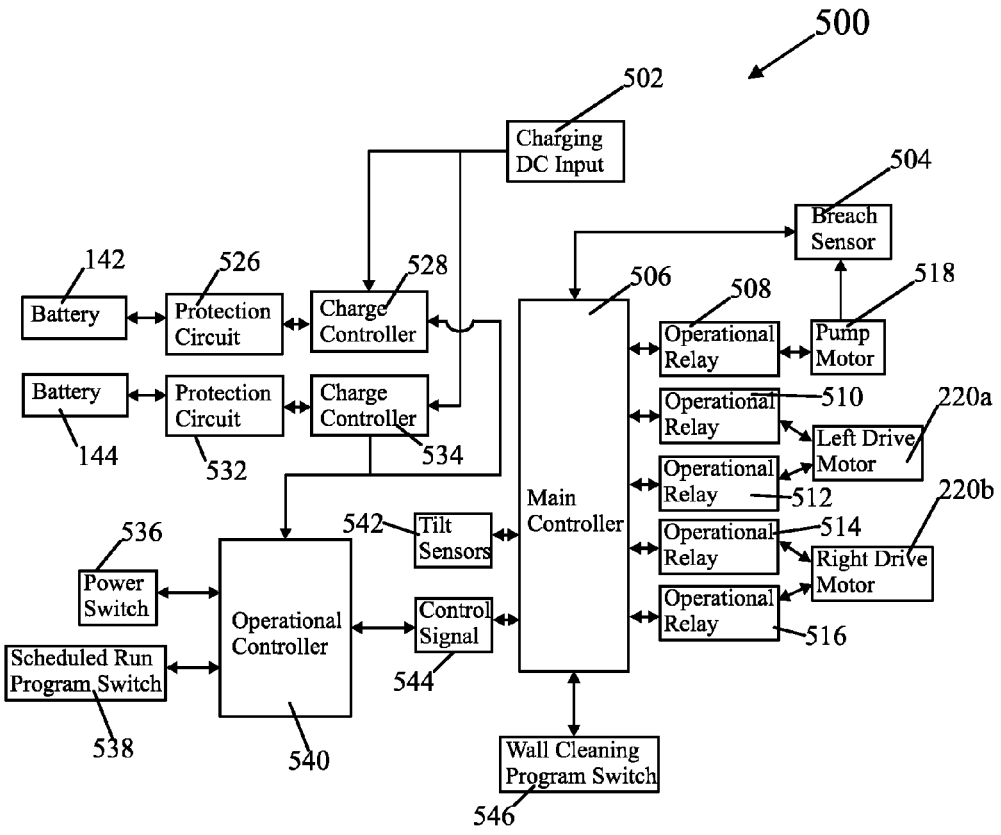
FIG. 37 is a simplified circuit diagram to show where sensors used in the apparatus of FIG. 1 are connected.

FIG. 36 is a flow chart 400 illustrating a method of operating of the apparatus when it moves out of the water of, for example, a swimming pool. At step 402, a water sensor or breach sensor 504 shown in FIG. 37, is checked by the computer processor 306 of FIG. 35 and/or the main controller 506 of FIG. 37 to determine if the apparatus 1 is out of the water. The water breach sensor may be "checked" at selected time intervals. The breach sensor 504 is known in the art. If the computer processor 306 and/or the main controller 506 of FIG. 37 determines that the apparatus is not out of the water, then the computer processor 306 and/or the main controller 506 executes a computer program stored in the computer memory 302, and goes back to executing a main computer software program of the apparatus, at step 404. If the apparatus is determined to be out of the water, then the computer processor 306 and/or the main controller 506 determines if the apparatus has been found to be out of the water for four consecutive checks of the breach sensor 504 at step 406, and if so then the apparatus is powered off at step 408.

The system works on the premise that if the device has been out of water for long enough, it has presumably been removed from the pool deliberately and can shut down. If the device is out of the water but has not been out for that long, it is likely that it reached the surface as part of a pool cleaning process which it should attempt to return to the bottom of the pool. Typically this would mean the apparatus either reached the water line of a wall in a wall-cleaning mode, or that it is off course and somehow floating at the surface towards the center of the pool. The timing of breach sensor "checks" can be varied and the number of consecutive "out of the water" checks which results in powering down can be more or less than four.

If the apparatus has not been found to be out of the water for four consecutive checks, then the computer processor 306 and/or the main controller 506 starts an attempt to return the apparatus 1 to the water by turning off the pump motors. This assumes the apparatus has climbed up a wall and is floating on the surface of the water, due to air entering the internal volume of the apparatus. By shutting everything off, including the pumps pulling water in from the bottom, water can more easily displace trapped air from the internal volume of the apparatus and this eventually leads to the apparatus sinking to the bottom of the swimming pool because of is slightly negative buoyancy. The two pump motors 9, 9 can also work as two separate pumps as controlled by a program segment stored in the memory, to steer the apparatus using different thrust from the two exhaust grills 77. In at least one embodiment, the two pump motors are used to provide maximum performance and incidental balance to the apparatus, though such may not be necessary at step 410. At step 412 the drive motors 42, 42 have their direction reversed, such that if they were being driven in a forward direction, they are switched to reverse, and if they were being driven in a reverse direction, they are switched to forward.

The computer processor 306 and/or the main controller 506 then causes the apparatus to drive in a straight line in the forward or reverse direction, whichever has just been set, for ten seconds, at step 414. At step 416, one or both the water pump motors is/are turned back on. The computer processor 306 and/or the main controller 506 then loops back to step 402 and the process continues until the apparatus is either in the water, as detected by breach sensor 504 or until the water or breach sensor 504 has been checked four consecutive times by the computer processor 306 and/or the main controller 506, and it has been determined that the apparatus 1 is out of the water, in which case the apparatus is turned off at step 408.

FIG. 37 is a block diagram 500 of one embodiment of various components of the apparatus. The components shown in FIG. 37 may be part of the control device 300 shown in FIG. 35 or may be components in addition to the control device. The components in FIG. 37 include charging DC (direct current) input 502, breach or water sensor 504, main controller 506 (which may be computer processor 306 or may be part of computer processor 306), operational relays 508, 510, 512, 514, and 516, pump motor 518 or 9, left drive motor 9, right drive motor 9, batteries 71 and 71, protection circuits 526 and 532, charge controllers 528 and 534, power switch 536, scheduled run program switch 538, operational controller 540, tilt sensors 542, control signal 544, and wall cleaning switch 546.

The power provided from the batteries 71 passing through charge protection circuits 526 and 532, connected to charge controllers 528 and 534, respectively, drives two onboard micro controllers, such as main controller 506 and operational controller 540, which may be connected in series. The computer processor 306 may include main controller 506 and operational controller 540.

The operational controller 540, in at least one embodiment, controls what kind of cleaning cycle, when to turn on, when to shut off, which then powers the main controller 506 which works to ensure consistent operation amongst all output devices (such as the pump motors 9, 9, and the drive motors 42, 42), and to prevent damage to those components.

A DC power source can be connected to the charging DC (direct current) input 502 in order to charge the batteries 71. The batteries, when charged, power all of the operations of the portable, cordless and autonomous robotic apparatus of the invention.

The breach or water sensor 504 may be any known sensor, which provides an out of water signal to the main controller 506 (and/or the computer processor 306) when the apparatus is not in water. The absence of an out of water signal from the breach sensor 504 indicates that the apparatus is in water, such as in the water of a swimming pool.

The main controller 506 may include the computer processor 306, the computer memory 302, the computer interactive device 304, the computer input/output port 310, and the computer display 308 shown in FIG. 35. Alternatively, one or more of the components 302, 304, 306, 308, and 310 may be provided in addition to the main controller 506. The main controller 506 is configured to communicate by communications links with the operational relays 508, 510, 512, 514, and 516, the tilt sensors 542, the control signal 544, the breach sensor 504, and the wall cleaning program switch 546.

The tilt sensors 542 determine if the apparatus is in a tilted state, such as when leaning against a swimming pool vertical wall. The tilt sensors 542 are generally known. Tilt sensors may sense tilt with respect to a single axis, to two axes, or to multiple axes. Tilt is typically measured with respect to the surface of the Earth, which will be roughly parallel with the bottom of the flat portion of a pool. In preferred embodiments the apparatus is able to distinguish between a steeply sloped or fully vertical pool wall, and more gently sloping pool floor between deep and shallow ends of a pool. For example, "tilting" might only be indicated is the apparatus is tilted at least 30°, 45°, 50°, 60°, 70°, or at least 80° from gravitational horizontal. The tilt sensor may, without limitation, comprise an accelerometer, or a mercury switch. A mercury switch (also known as a mercury tilt switch) is a switch which opens and closes an electrical circuit through a small amount of liquid mercury which is moved by gravity.

The control signal 544 provides power to the main controller 506 according to the schedule defined in FIG. 44. This schedule is dictated by the operational controller 540. The wall cleaning program switch 546 can be switched on to cause the main controller 506 and/or the computer processor 306, to execute a wall cleaning operation, such as a vertical swimming pool wall cleaning operation.

Wall cleaning mode is achieved by the fluid forces from the pump motors 9 that both cause the flow of water through the valve and filter bag, and press the apparatus against the wall by the reactive thrust of water jetting form grills 77. This thrust is more than enough to keep the nearly neutrally buoyant apparatus pressed against the wall with enough force to allow the belts 81 to move the apparatus along the wall and to effectively brush and clean the wall surface using the rotating brush assemblies.

The apparatus is placed in wall cleaning mode by pressing program switch 546. The power switch 536 may be pressed once to turn the apparatus on and a second time to turn it off. A third push button switch 538 is pressed to activate a scheduled run for the apparatus. These three switched are hermetically sealed under the oval display area of housing 58, under respective small resilient dome areas that can be pressed for easy and simple operation of the apparatus. To further simplify operation and render it intuitive and user-friendly, these domes form push buttons that are labeled "ON/OFF" for power switch 536, "FLOOR & WALL" or "FLOOR ONLY" for mode selector switch 546, and "WEEKLY" or "DAILY" for run switch 538.

Figure 38A:
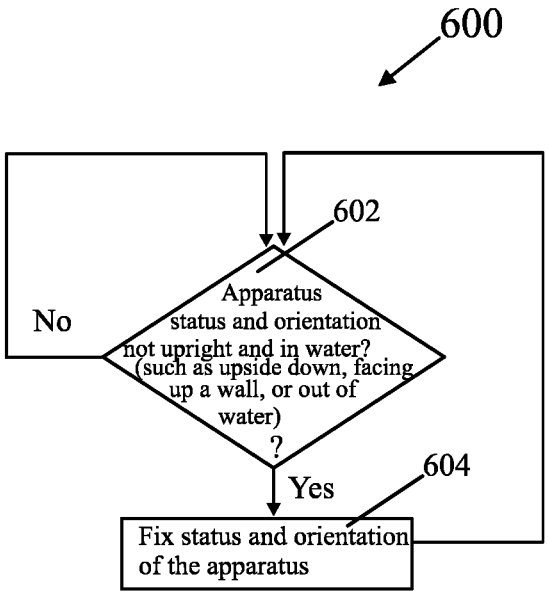
FIG. 38A is a flow chart illustrating a Self Correction routine of the invention.

FIG. 38A is a flow chart 600 of a method of operating the apparatus when the apparatus is not oriented right side up. The method of flow chart 600 may be implemented by the computer processor 306 and/or the main controller 506, such as by a computer program stored in the computer memory 302. At step 602 the computer processor 306 may determine whether the apparatus is not upright and in the water, such as the water of a swimming pool. For example, the apparatus may be upside down, may be facing up against a wall, or may be out of the water of a swimming pool. At step 604, the computer processor 306 and/or the main controller 506 may fix the status and/or orientation of the apparatus, such as by operating the pump motors 9 and/or the drive motors 42 to cause the apparatus to go into the water of a swimming pool or to change its orientation to right side up. If the apparatus is right side up and in the water of a swimming pool the loop is repeated with step 602 until the apparatus 1 is not right side up and/or not in the water.

In at least one embodiment, the apparatus can be detected to be out of the water by the computer processor 306 and/or the main controller 506 based on detection of the current draw to the water pump motors 9. When the apparatus is out of water, air will flow through the apparatus, the internal volume and around the propellers 5 contained within ducted shrouds below the exhaust grills 71, 71, reducing the torque needed for the pump motors 9 to operate. This in turn lowers the current draw, i.e. the electrical current used by the pump motors, significantly, which is detected by an onboard current sensor, which may be part of the computer processor 306 and/or the main controller 506.

Figure 38B:
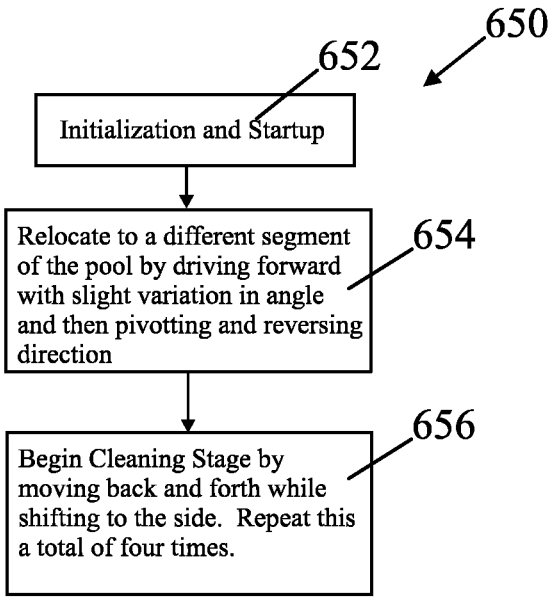
FIG. 38B is a flow chart illustrating a simplified Full Program of the invention.

FIG. 38B is a flow chart of a method of operating the apparatus of FIG. 1, in order to relocate the apparatus to another location, for example in a swimming pool, for a cleaning method in accordance with an embodiment of the present invention. The processes of FIGS. 38A and 38B may be implemented at the same time by the computer processor 306 and/or the main controller 506. In FIG. 38B, at step 652, various variables and registers may be initialized in the computer memory 302 of the control device 7 by the computer processor 306 (same as main controller 506), such as; PORTA and PORTC registers responsible for the inputs and outputs of the processor 506, CMCON responsible for controlling and reading the breach sensor 504, and "hs" a variable responsible for setting the amount of time that each step in the main program will run for.

After initialization of the variables and registers at step 652, a relocation process is started by the computer processor 306 and/or the main controller 506. At step 654 the apparatus is relocated to a different segment of a swimming pool by driving the apparatus forward with a slight variation in angle, and then pivoting and reversing direction. This can be done by activating driver motors 42, at the same time in, for example, a forward direction, and then turning the apparatus, by, for example, activating the left drive motor 42, while not activating the right drive motor 42, and then activating both drive motors in a reverse direction.

At step 656 a cleaning stage is begun by moving the apparatus back and forth while shifting to the side. This can be done by the computer processor 306 and/or the main controller 506 activating drive motors 42 in a forward direction, then activating drive motors 42 in a reverse direction. Each drive motor 42 has two operational relays 508. One relay is for turning the motor on and off, the other relay is for controlling which direction FWD/REV the motor runs by setting or reversing the voltage across the motor. A DC motor will spin clockwise/counterclockwise depending on whether there is a positive or negative voltage difference across its input and output pins.

The apparatus shifts to the side by either reversing the direction of only one drive motor of the motors 42 and 42, i.e. pivoting in place, or by stuttering one of the motors. Typically "stuttering" involves one track turns at normal speed, while the other track is pulsed on and off, such as every half second, so that it moves a shorter total distance. Both of these methods will rotate the apparatus and thus change its angle of travel direction. In at least one embodiment, the apparatus cannot move perpendicularly from its central vertical axis, however, it can turn perpendicularly, move forward, then turn perpendicularly again to achieve the same result.

This cleaning stage can be repeated a total of four times as determined the computer processor 306 implementing a computer program stored in the computer memory 302.

Figure 39:
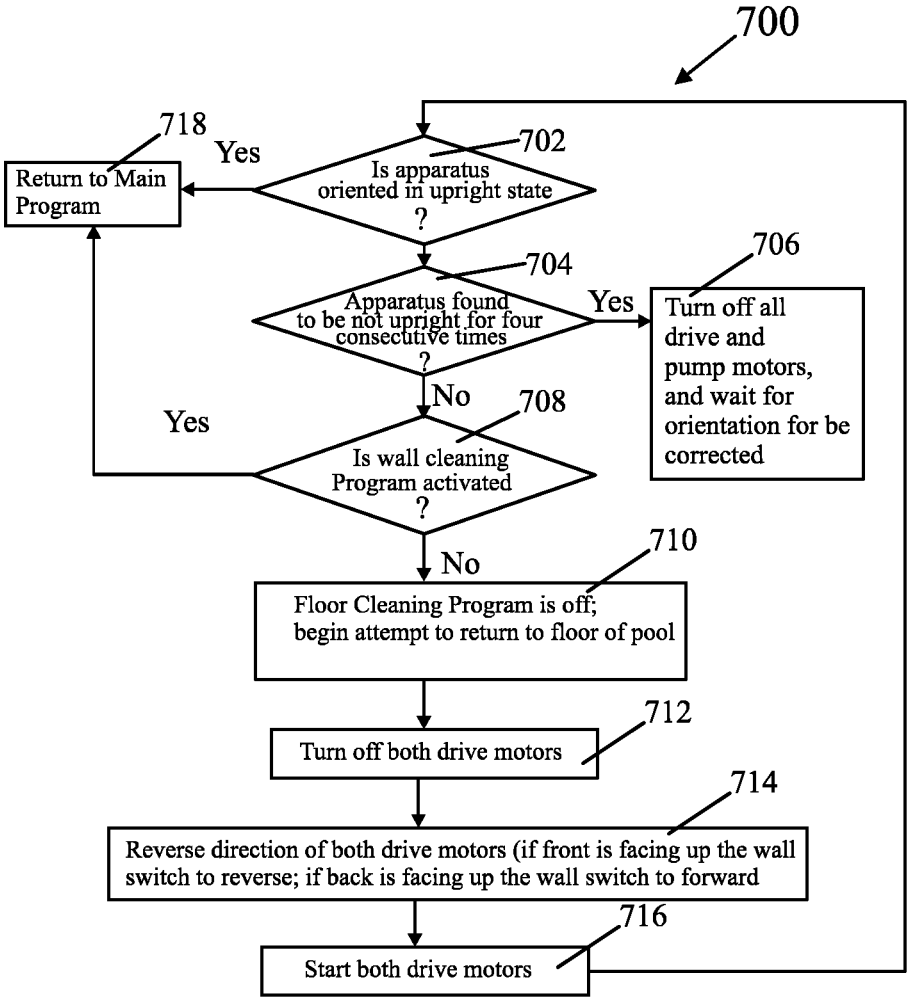
FIG. 39 is a flow chart illustrating a Wall, Down Wall Cleaning Routine of the invention.

FIG. 39 is a flow chart 700 of a method of operating the apparatus when it goes into a tilted state, such as when cleaning a wall. At step 702, the computer processor 306 and/or the main controller 506 determines if the apparatus is oriented right side up, by for example checking a signal or signals from tilt sensors 542 which may indicate whether the apparatus is in an upright state such as shown in FIG. 1, i.e. with the six road wheels 83 under the two belts, all on the ground.

There are preferably two tilt sensors of tilt sensors 542 mounted on the apparatus, in at least one embodiment, each set at a forty-five degree angle vertically from the horizontal but in opposite orientations. One or other numbers of tilt sensors, depending on the type, and tilt sensors set for other angles are also contemplated. The two tilt sensors 542 are preferably mounted opposite each other and parallel to the central vertical axis. One tilt sensor or sensors 542 can sense whether the apparatus is tilted forward up (a positive measured angle from the horizontal) of any angle greater than forty-five degrees and will generate a binary signal (1/0) to the main controller 506 (and/or computer processor 306) depending on whether the apparatus is below or above the forty-five degrees respectively. The other tilt sensor or sensors 542 can sense if the robot is tilted reverse up (a negative measured angle from the horizontal) of any angle greater than forty-five degrees and will send a similar signal to the main controller 506 (computer processor 306). The main controller 506 can sense whether the apparatus is oriented forward up, reverse up, and upside down based on whether the apparatus receives a signal from the first tilt sensor of sensors 542, the second tilt sensor of sensors 542, or both respectively.

If the apparatus is oriented in an upright state, then the computer processor 306 and/or the main controller 506 returns to implementing a main computer program at step 718. If the apparatus is not found to be upright, then at step 704, the computer processor 306 and/or the main controller 506 determines if the apparatus has been found to be not upright for four consecutive times, and if so then the drive motors 42 and the pump motors 9 are turned off at step 706. If the apparatus is not upright, but not found to be so four consecutive times, then it is determined if the wall cleaning program has already been activated by the computer processor 306 and/or the main controller 506 at step 708. If so, then the computer processor 306 and/or the main controller 506 returns to the main program at step 718.

If the wall cleaning program has not been activated then at step 710 (i.e. the apparatus is in Floor Mode) the computer processor 306 and/or the main controller 506 begins an attempt to return the apparatus to the floor of a pool, by first turning off both drive motors 42 at step 712. At step 714, the computer processor 306 and/or the main controller 506 reverses the direction of both drive motors 42, i.e. if the front of the apparatus is facing up a wall, the computer processor 306 and/or the main controller 506 switches to reverse and if the back of the apparatus is facing up the wall, the computer processor 306 and/or the main controller 506 switches to forward. At step 716, both drive motors 42 are started. The process then loops back to the step 702.

In at least some embodiments, when the unit is in FLOOR MODE, the pumps do not turn off before, during, or after tilting. In such embodiments, when the unit has tilted past a set degree—for example, an angle greater than 45 degrees measured from the front or back of the unit to the horizontal—the robot will:

1. Change the direction of both drive motors to drive away from the wall. The direction may be determined by whichever of a pair of mercury switches gives the signal when the tilt sensors are mercury switches. If one or both motors are off, it will turn on the one or both motors in the direction away from the wall.

2. Continue driving in that direction until the sensor(s) indicate that the unit is horizontal, at which point the robot will continue driving in the same direction for some set amount of time programmed into the unit.

3. Move onto the next step of the program, skipping the recent step that caused the unit to hit a wall. The next step could be to pivot in place, a gradual turn, or even driving straight towards a second opposite wall until the sensors change input again. For example, indicating the apparatus is tilted another way.

This type of regimen would be useful for pools with cornered edges so that the vacuum climbs slightly up the slopes, and so has a better chance of getting debris caught in the corner.

Figure 40:
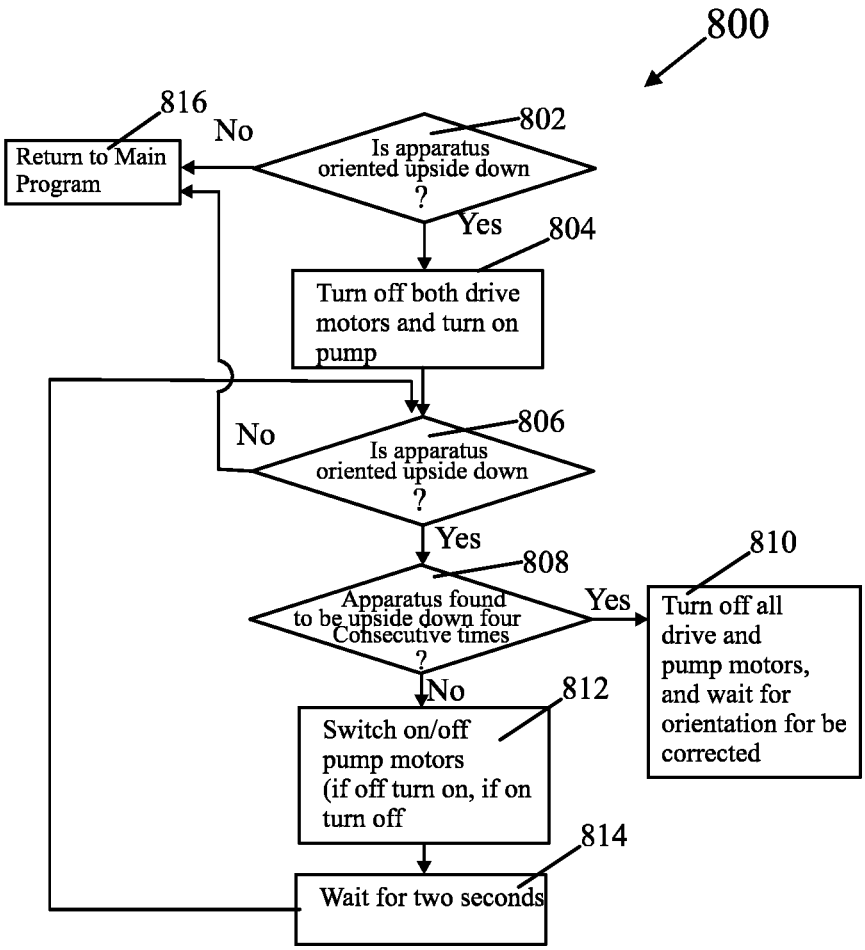
FIG. 40 is a flow chart illustrating an Upside Down routine of the invention.

FIG. 40 is a flow chart 800 of a method of operating the apparatus when it goes into an upside down state. At step 802 the computer processor 306 and/or the main controller 506 determines if the apparatus is in an upside down state. If no, then the computer processor 306 and/or the main controller 506 returns to the main program at step 816. If yes, then the computer processor 306 and/or the main controller 506 turns off both drive motors 42 and 42 and turns on one pump motor 9 to turn one way and the other pump motor to either not turn or to turn in an opposite direction. The differential thrust from exhaust grills 77 then cause the nearly neutrally buoyant apparatus to rotate to one side or the other about its travel direction axis to right itself.

At step 806, the computer processor 306 and/or the main controller 506 determines if the apparatus is oriented upside down. If no, then the computer processor 306 and/or the main controller 506 returns to the main program at step 816. If yes, then the computer processor 306 and/or the main controller 506 determines if the apparatus has been found to be upside down for four consecutive times at step 808. If yes then the computer processor 306 and/or the main controller 506 turns off the drive motors 42 and the pump motors 9, or 518 at step 810, and waits for the orientation to be corrected. When the pump motors and the drive motors are powered off and the apparatus is suspended in a water, the center of gravity of the apparatus will draw the apparatus towards the lowest possible point due to its buoyancy and due to its center of mass being tuned to be below its center of buoyancy by strategic location of the foam sheet and foam cylinders in the apparatus frame. The apparatus therefore automatically reorients itself so that the exhaust grills 77 and the apparatus are in the correct position.

If the apparatus has not been found to be upside down for four consecutive times at step 808, then the computer processor 306 and/or the main controller 506 switches on or off the pump motors 9 at step 812, i.e. if pump motors were on, they are turned off, and off, they are turned on.

In at least one embodiment, the pump motors are connected directly to each other and they will either both be powered off or both be powered on. The computer processor 306 and/or the main controller 506 then delays or waits for two seconds at step 814 and then the computer processor 306 and/or the main controller 506 then loops back to check the apparatus orientation at step 806 and continues with processing.

In at least one embodiment, a multi-day program is stored in the computer memory 302 of the operational controller 540. It uses the control signal 544 to turn on/off the power to main controller 506 (computer processor 306). It takes an input from the scheduled run program switch 538 (which is user controlled) to decide whether to run continuously or on its stored multi-day timing schedule.

Cleaning modes are adjustable through user controlled buttons or switches. Scheduled run program switch 538 controls whether the user would like the robot to run continuously until the battery dies or on a set schedule. Wall cleaning program switch 546 allows the user to decide if they want the apparatus to clean just the floors or the floors and the walls (FIG. 39).

In at least one embodiment, the apparatus must have slight positive buoyancy for the apparatus to drive itself into the water. However, in other embodiments, the unit or apparatus has either neutral or slightly negative buoyancy. Pump motors 9 push the apparatus to the bottom just like the wall cleaning already explained above.

Figure 41:
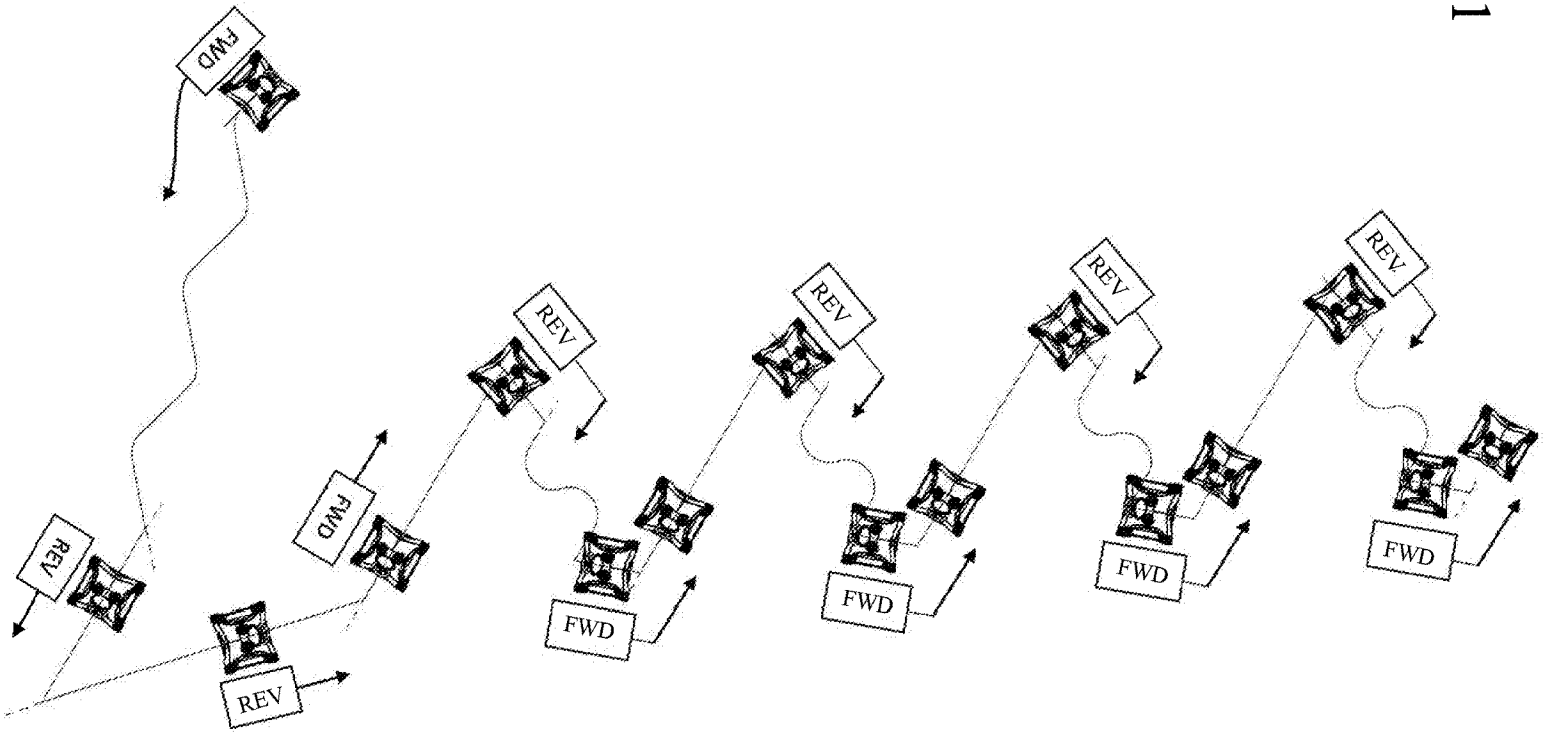
FIG. 41 is a time elapse image of a path taken by the apparatus of the invention according to one embodiment of its programming.

Unique cleaning paths as illustrated in FIGS. 41 and 42 can be is dictated by the main controller 506 or computer processor 306 and are stored in the computer memory 302.

The terms "wireless" and "cordless", and their synonyms, are considered equivalent for the purposes of this disclosure.

Persons of skill in the art should appreciate that all reasonable combinations, subsets, and sub-combinations of the elements, devices, and methods described in this disclosure are contemplated and disclosed as part of the invention, both individually and collectively. The invention includes a particular pool cleaning robot, as well as all of the various components and systems of the robot individually. The invention includes the use of outside wheels with frictional elements to provide motive force at the sides of a pool cleaner. The invention includes the use of trapezoidal belt paths in pool cleaners, both alone and combined with the disclosed outside wheels. The invention includes water intake arrangements including duckbill valves. The invention includes battery-powered pool cleaning robots which do not require a cord connection to provide power or guidance. The invention includes methods of operating and programming autonomous pool cleaning robots, including but not limited to the particular robots disclosed. The invention includes methods of regulating pool cleaning robots using water sensors and/or tilt sensors.

While specific embodiments of the invention have been shown and described in detail to illustrate the application of the principles of the invention, it will be understood that the invention may be embodied otherwise without departing from such principles.

What is claimed is:

1. An autonomous robotic apparatus for cleaning surfaces of a swimming pool comprising:

a frame, the frame having a travel direction axis, a transverse axis, and a vertical axis;

a first plurality of pulley wheels mounted for rotation to one side of the frame with respect to the transverse axis and defining a first belt path;

a second plurality of pulley wheels mounted for rotation to an opposite side of the frame with respect to the transverse axis and defining a second belt path;

first and second track belts respectively extending around the first and second belt paths, at least a portion of each belt being adapted to engage a swimming pool surface;

at least one drive motor mounted to the frame and operatively engaged to at least one pulley wheel for rotating at least one track belt with respect to the frame to thereby move the frame along a swimming pool surface;

at least one first forward outside wheel connected to one of the first plurality of pulley wheels at a forward side of the first belt path with respect to the travel direction axis;

at least one first rearward outside wheel connected to one of the first plurality of pulley wheels at a rearward side of the first belt path with respect to the travel direction axis;

at least one second forward outside wheel connected to one of the second plurality of pulley wheels at a forward side of the second belt path with respect to the travel direction axis;

at least one second rearward outside wheel connected to one of the second plurality of pulley wheels at a rearward side of the second belt path with respect to the travel direction axis;

the outside wheels extending laterally outward from the apparatus, the outside wheels rotating with their respective pulley wheels and having outer friction surfaces adapted to engage a swimming pool surface for moving the frame with respect to the swimming pool surface;

at least one inlet at a lower side of the frame with respect to the vertical axis, the inlet being for receiving water from a swimming pool into a free volume of the frame;

a filter unit having an opening positioned for receiving water from said inlet for filtering debris from the water before water exits the filter unit;

a pump assembly mounted in the frame for pumping water through the free volume and out of the frame; and a computer processor assembly electrically connected to the at least one drive motor and the pump assembly for controlling the drive motor and pump assembly, the computer processor assembly including a computer memory for storing an operating program for controlling operation of the drive motor and pump assembly for moving the apparatus along programmed paths along swimming pool surfaces and for pumping water through the free volume.

2. The apparatus of claim 1, further comprising:

at least one brush assembly mounted for rotation on the frame for brushing a swimming pool surface, the at least one brush assembly being operatively engaged to said at least one drive motor for rotating the at least one brush assembly.

3. The apparatus of claim 2, wherein said at least one brush assembly comprises polyvinyl acetate.

4. The apparatus of claim 2:

wherein said at least one brush assembly comprises a forward brush assembly mounted for rotation to the forward side of the frame for brushing a swimming pool surface, and a rearward brush assembly mounted for rotation to the rearward side of the frame for brushing a swimming pool surface;

the apparatus further comprising a plurality of panels covering portions of the frame, including panels for covering the front and rear of the frame;

wherein said panels covering the front and rear of the frame are concave for exposing central portions of the forward and rearward brush assembles, and are spaced inwardly of the forward and rearward portions of the track belts and inwardly of the outside wheels, so that at least one of a belt and an outside wheel contacts swimming pool surfaces before a panel contacts the surface.

5. The apparatus of claim 2, wherein the at least one brush assembly includes at least one flexible blade brush cylinder, the at least one blade brush cylinder comprising a plurality of flexible elongated blades spaced around and protruding from the flexible blade brush cylinder.

6. The apparatus of claim 2:

wherein the at least one brush assembly includes at least one flexible blade brush cylinder, the at least one blade brush cylinder comprising a plurality of flexible blades spaced around the flexible blade brush cylinder, wherein the at least one brush assembly also includes at least one pair of polyvinyl acetate cylinder brushes on opposite transverse sides of the flexible blade brush cylinder.

7. The apparatus of claim 1, further comprising:

a forward brush assembly mounted for rotation to the forward side of the frame for brushing a swimming pool surface; and a rearward brush assembly mounted for rotation to the rearward side of the frame for brushing a swimming pool surface.

8. The apparatus of claim 1, further comprising:

at least one rechargeable battery assembly mounted in the frame and containing at least one rechargeable battery that is electrically connected to the computer processor assembly, to the at least one drive motor, and to the pump assembly, for powering the computer processor assembly, the drive motor, and the pump assembly;

wherein the apparatus is adapted for cordless operation.

9. The apparatus of claim 1:

wherein a total density of the apparatus is no more than 10% more than the density of water so that the apparatus has nearly neutral buoyance, a center of gravity of the apparatus being below a central area of the vertical axis so that the apparatus is self-righting when in water at any orientation other than with the vertical axis of the frame extending vertically.

10. The apparatus of claim 1, wherein said inlet comprises at least one one-way valve embodied as a duck bill valve having at least one flexible wall.

11. The apparatus of claim 1:

wherein said inlet comprises at least one one-way valve embodied as a duck bill valve having two flexible walls; and wherein the flexible walls of each valve define inlet edges where water enters the valve and outlet edges where water leaves the valve, each valve having spaced apart inlet edges and, when no water is passing through the valve, engaged together outlet edges.

12. The apparatus of claim 1:

wherein said at least one inlet comprises a duck bill valve, and wherein the duck bill valve and the filter unit are both removable from said apparatus.

13. The apparatus of claim 1:

wherein said at least one inlet comprises two one way valves spaced from each other along the travel direction axis, each valve comprising a duck bill valve having a pair of facing flexible walls extending parallel to the transverse axis of the frame and positioned between the valve inlet and the valve outlet, wherein the flexible walls of each valve define inlet edges where water enters the valve and outlet edges where water leaves the valve, each valve having spaced apart inlet edges, and, when no water is passing through the valve, engaged together outlet edges, each valve having a valve axis that extends at an acute angle to the travel direction axis of the frame, the inlet of the valve on the rearward side facing at an acute angle rearwardly and the inlet of the valve on the forward side facing at an acute angle forwardly.

14. The apparatus of claim 1:

wherein each outside wheel has an outer dome surface with a circular periphery, and a plurality of projections for increasing a frictional engagement of the outside wheels with a swimming pool surface.

15. The apparatus of claim 1:

wherein each outside wheel has a dome shaped outer surface with a circular periphery, and a plurality of projections for increasing a frictional engagement of the outside wheels with a swimming pool surface, the apparatus comprising two each of first forward outside wheels, first rearward outside wheels, second forward outside wheels, and second rearward outside wheels, with each pair of outside wheels comprising an upper outside wheel and a lower outside wheel;

wherein, for each pair of outside wheels, the upper outside wheel of each pair is positioned further out than the lower one of each pair of outside wheels, with respect to the travel direction axis and the transverse axis.

16. The apparatus of claim 1:

wherein the first and second track belts are each in a substantially trapezoidal configuration, each trapezoid shaped track belt comprising four corners defined by four pulley wheels, each trapezoid shaped track belt comprising two horizontal parallel sides and two other sides connecting the horizontal sides, with a shorter of the horizontal sides of each track belt oriented downward for contacting a pool surface and a longer of the horizontal sides oriented upward;

the apparatus comprising two each of first forward outside wheels, first rearward outside wheels, second forward outside wheels, and second rearward outside wheels, with each pair of outside wheels comprising an upper outside wheel and a lower outside wheel, and with each outside wheel being axially aligned with a pulley wheel at a corner of a trapezoidal shaped track belt;

wherein, for each pair of outside wheels, the upper outside wheel of each pair is positioned further out than the lower of each pair of outside wheels, with respect to the travel direction axis, so that when the apparatus is traveling along the travel direction axis and encounters a vertical pool wall the pool wall will be first contacted by one or more upper outside wheels.

17. The apparatus of claim 1:

wherein said filter unit comprises a filter bag made of flexible porous material.

18. The apparatus of claim 1, further comprising:

a first plurality of road wheels mounted for rotation to one side of the frame with respect to the transverse axis and defining a portion of the first belt path;

a second plurality of road wheels and pulley wheels mounted for rotation to an opposite side of the frame with respect to the transverse axis and defining a portion of the second belt path.

19. An autonomous robotic apparatus for cleaning surfaces of a swimming pool comprising:

a frame, the frame having a travel direction axis, a transverse axis, and a vertical axis;

a first plurality of pulley wheels mounted for rotation to one side of the frame with respect to the transverse axis and defining a first belt path;

a second plurality of pulley wheels mounted for rotation to an opposite side of the frame with respect to the transverse axis and defining a second belt path;

first and second track belts respectively extending around the first and second belt paths, at least a portion of each belt being adapted to engage a swimming pool surface;

a first drive motor mounted to the frame and operatively engaged to at least one pulley wheel of the first plurality of pulley wheels for rotating at least one pulley wheel to move the first belt with respect to the frame to thereby move the frame along a swimming pool surface;

a second drive motor mounted to the frame and operatively engaged to at least one pulley wheel of the second plurality of pulley wheels for rotating the at least one pulley wheel to move the second belt with respect to the frame to thereby move the frame along a swimming pool surface;

at least one brush assembly mounted for rotation on the frame for brushing a swimming pool surface, the at least one brush assembly being operatively engaged to at least one of said first drive motor and said second drive motor for rotating the at least one brush assembly;

at least one inlet at a lower side of the frame with respect to the vertical axis, the inlet being for receiving water from a swimming pool into a free volume of the frame;

a filter unit for filtering debris from water received by the inlet;

a pump assembly for pumping water;

a computer processor assembly electrically connected to the drive motors and the pump assembly for controlling the drive motors and the pump assembly; and a power source;

wherein the first and second track belts are each in a substantially trapezoidal configuration, each track belt comprising four corners defined by four pulley wheels, each track belt comprising two horizontal parallel sides and two other sides connecting the horizontal sides, with a shorter of the horizontal sides of each track belt oriented downward for contacting a pool surface and a longer of the horizontal sides oriented upward.

20. The apparatus of claim 19, further comprising:

at least one first forward outside wheel connected to one of the first plurality of pulley wheels at a forward side of the first belt path with respect to the travel direction axis;

at least one first rearward outside wheel connected to one of the first plurality of pulley wheels at a rearward side of the first belt path with respect to the travel direction axis;

at least one second forward outside wheel connected to one of the second plurality of pulley wheels at a forward side of the second belt path with respect to the travel direction axis;

at least one second rearward outside wheel connected to one of the second plurality of pulley wheels at a rearward side of the second belt path with respect to the travel direction axis;

the outside wheels rotating with their respective pulley wheels and having outer friction surfaces adapted to engage a swimming pool surface for moving the frame with respect to the swimming pool surface;

wherein, for each pair of outside wheels, the upper outside wheel of each pair is positioned further out than the lower of each pair of outside wheels, with respect to the travel direction axis, so that when the apparatus is traveling along the travel direction axis and encounters a vertical pool wall the pool wall will be first contacted by one or more upper outside wheels.

21. The apparatus of claim 19, wherein the at least one brush assembly comprises:

a forward brush assembly mounted for rotation to the forward side of the frame for brushing a swimming pool surface, the forward brush assembly being operatively engaged to at least one drive motor for rotating the forward brush assembly; and a rearward brush assembly mounted for rotation to the rearward side of the frame for brushing a swimming pool surface, the rearward brush assembly being operatively engaged to at least one drive motor for rotating the rearward brush assembly.

22. The apparatus of claim 19, further comprising:

a plurality of outside wheels, the outside wheels extending laterally outward from the apparatus, the outside wheels rotating during operation and having outer friction surfaces adapted to engage a swimming pool surface for moving the frame with respect to the swimming pool surface.

23. An autonomous robotic apparatus for cleaning surfaces of a swimming pool comprising:

a frame, the frame having a travel direction axis, a transverse axis, and a vertical axis;

a plurality of wheels;

at least one drive motor mounted to the frame for driving one or more of said wheels;

at least one one-way valve engaged to the frame and near a lower side of the frame with respect to the vertical axis, the one-way valve having an inlet for receiving water from a swimming pool into a free volume of the frame, and an outlet in the free volume of the frame;

a filter unit having an opening positioned for receiving water from said one-way valve for filtering debris from the water before water exits the filter unit;

a pump assembly mounted in the frame for pumping water through the free volume and out of the frame; and a computer processor assembly electrically connected to the at least one drive motor and the pump assembly for controlling the drive motor and pump assembly;

wherein the at least one one-way valve comprises a duck bill valve having at least one flexible wall extending parallel to the transverse axis of the frame and between the valve inlet and the valve outlet, the duck bill valve having a valve axis that extends at an acute angle to the travel direction axis of the frame.

24. The apparatus of claim 23 further comprising:

two one-way valves spaced from each other along the travel direction axis, each valve comprising a duck bill valve having a pair of facing flexible walls extending parallel to the transverse axis of the frame and positioned between the valve inlet and the valve outlet, wherein the flexible walls of each valve define inlet edges where water enters the valve and outlet edges where water leaves the valve, each valve having spaced apart inlet edges, and, when no water is passing through the valve, engaged together outlet edges, each valve having a valve axis that extends at an acute angle to the travel direction axis of the frame, the inlet of the valve on the rearward side facing at an acute angle rearwardly and the inlet of the valve on the forward side facing at an acute angle forwardly.

25. The apparatus of claim 23 further comprising:

at least one rechargeable battery assembly mounted in the frame and containing at least one rechargeable battery that is electrically connected to the computer processor assembly, to the at least one drive motor, and to the pump assembly, for powering the computer processor assembly, the drive motor, and the pump assembly;

wherein the apparatus is adapted for cordless operation.

* * * * *